US012605642B2

(12) United States Patent
Bilodeau et al.

(10) Patent No.: US 12,605,642 B2
(45) Date of Patent: Apr. 21, 2026

(54) TOY VEHICLE TRACK

(71) Applicant: Mattel, Inc., El Segundo, CA (US)

(72) Inventors: Maxence Rodrigue Bilodeau, Marina Del Ray, CA (US); Giang-Son Quoc Nguyen, Buena Park, CA (US); Alex Au, Kowloon (HK); Gabriel De La Torre, Los Angeles, CA (US); David Welby, Santa Monica, CA (US); Jung Jun Hwang, Inglewood, CA (US); Paul Schmid, Ojai, CA (US); Gabriel Lopez, Los Angeles, CA (US); Jeremy Fischer, Long beach, CA (US)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 18/906,955

(22) Filed: Oct. 4, 2024

(65) Prior Publication Data

US 2025/0319415 A1 Oct. 16, 2025

Related U.S. Application Data

(60) Provisional application No. 63/634,622, filed on Apr. 16, 2024.

(51) Int. Cl.
*A63H 18/02* (2006.01)

(52) U.S. Cl.
CPC ..... *A63H 18/021* (2013.01); *A63H 18/02* (2013.01)

(58) Field of Classification Search
CPC ..... A63H 18/021; A63H 18/00; A63H 18/02
See application file for complete search history.

(56) References Cited

U.S. PATENT DOCUMENTS 2,534,458 A * 12/1950 Larrabee ..... A63H 18/02 52/592.4
2,885,822 A * 5/1959 Onanian ..... A63H 33/101 174/138 D
3,667,153 A * 6/1972 Christiansen ..... A63H 33/062 446/124

(Continued)

FOREIGN PATENT DOCUMENTS

CA 1300882 C 5/1992
CA 2156450 C 9/1998

(Continued)

OTHER PUBLICATIONS

Translation EP2272576A1 (Year: 2011).*
Translation KR20160001482U (Year: 2016).*

*Primary Examiner* — Eugene L Kim
*Assistant Examiner* — Alyssa M Hyklinski
(74) *Attorney, Agent, or Firm* — Edell, Shapiro & Finnan, LLC

(57) ABSTRACT

A toy vehicle track piece of present application includes one or more connectors. Thus, two track pieces can be connected directly to each other without any additional pieces (e.g., without separate connectors pieces or pins). Moreover, the connectors are specifically designed so that young children can easily connect and disconnect two track pieces without parental intervention. Additionally or alternatively, the track pieces presented herein, as well as accessories associated therewith, may be designed to assemble at specific grid locations so that any configuration of track pieces can be connected together to form a closed track path.

16 Claims, 74 Drawing Sheets

(56) References Cited

U.S. PATENT DOCUMENTS

| | | | | | |
|---|---|---|---|---|---|
| 3,712,539 | A | | 1/1973 | Staats | |
| 3,726,476 | A | * | 4/1973 | Porter | A63H 18/04 238/10 E |
| 4,012,155 | A | * | 3/1977 | Morris | A47B 87/0207 403/360 |
| 4,081,133 | A | * | 3/1978 | Tong | A63H 18/02 238/10 F |
| 4,082,220 | A | * | 4/1978 | Cheng | A63H 18/02 238/10 F |
| 4,397,419 | A | * | 8/1983 | Fischer | A63H 18/021 238/10 F |
| 4,544,094 | A | | 10/1985 | Scholey | |
| 4,997,187 | A | | 3/1991 | Smollar et al. | |
| 5,405,080 | A | * | 4/1995 | Yeung | A63H 18/02 238/10 F |
| 5,579,997 | A | | 12/1996 | Jackson et al. | |
| 5,704,822 | A | | 1/1998 | Nilsson | |
| 5,794,846 | A | | 8/1998 | Barrett | |
| 6,299,072 | B1 | * | 10/2001 | Burns | A63H 19/30 104/53 |
| 6,883,719 | B2 | * | 4/2005 | Pyrce | A63H 18/02 238/10 B |
| 6,974,086 | B2 | | 12/2005 | Cheng | |
| 7,083,111 | B2 | | 8/2006 | Reisher et al. | |
| 8,113,961 | B2 | | 2/2012 | Yu et al. | |
| 8,726,603 | B2 | * | 5/2014 | Huang | E04F 15/02038 52/591.1 |
| 8,939,674 | B2 | * | 1/2015 | Zimmer | B29C 66/1282 403/14 |
| 9,345,980 | B2 | | 5/2016 | Lee | |
| 9,839,860 | B2 | * | 12/2017 | Rakhsha | A63H 33/04 |
| D828,880 | S | * | 9/2018 | Tiffin | D21/540 |
| 10,086,305 | B2 | * | 10/2018 | Juliano | A63H 19/30 |
| 10,343,080 | B2 | * | 7/2019 | Jang | A63H 33/08 |
| 10,898,819 | B2 | | 1/2021 | Tiffin et al. | |
| 11,364,448 | B2 | * | 6/2022 | Cheung | A63H 17/26 |
| 12,296,278 | B1 | * | 5/2025 | Bilodeau | A63H 18/021 |
| 2007/0037478 | A1 | | 2/2007 | Zane | |
| 2007/0037479 | A1 | * | 2/2007 | Margay | A63H 18/02 238/10 F |
| 2010/0081356 | A1 | | 4/2010 | Lutchen et al. | |
| 2010/0248586 | A1 | * | 9/2010 | Cochella | A63H 18/02 446/444 |
| 2012/0071063 | A1 | * | 3/2012 | Mataya | A63H 18/00 446/444 |
| 2012/0080533 | A1 | * | 4/2012 | Mimlitch, III | A63H 11/20 238/10 R |
| 2012/0324708 | A1 | | 12/2012 | Minin | |
| 2013/0126628 | A1 | * | 5/2013 | DiBartolo | A63H 18/08 238/10 A |
| 2014/0087621 | A1 | * | 3/2014 | Spielberger | A63H 18/08 446/124 |
| 2016/0074762 | A1 | * | 3/2016 | Klein | A63H 33/42 446/174 |

FOREIGN PATENT DOCUMENTS

| | | | | | |
|---|---|---|---|---|---|
| CA | 2365193 | A1 | | 6/2003 | |
| CA | 2311771 | C | | 5/2007 | |
| CA | 2485771 | C | | 11/2008 | |
| CN | 1886180 | A | | 12/2006 | |
| CN | 100571832 | C | | 12/2009 | |
| CN | 103845904 | A | | 6/2014 | |
| CN | 104511169 | B | | 12/2016 | |
| CN | 112041040 | A | | 12/2020 | |
| CN | 112957750 | B | | 4/2023 | |
| EP | 98784 | B1 | | 1/1984 | |
| EP | 370579 | A3 | | 5/1990 | |
| EP | 522646 | A1 | | 1/1993 | |
| EP | 963224 | A4 | | 12/1999 | |
| EP | 1846131 | B1 | | 1/2011 | |
| EP | 2272576 | A1 | * | 1/2011 | A63H 19/30 |
| GB | 399825 | A | | 10/1933 | |
| GB | 2575968 | A | * | 2/2020 | G09B 1/36 |
| KR | 20160001482 | U | * | 5/2016 | A63H 18/02 |

* cited by examiner

TOY VEHICLE TRACK

CROSS-REFERENCE TO RELATED APPLICATIONS

This application claims the benefit of U.S. Provisional Patent Application No. 63/634,622, filed Apr. 16, 2024, entitled "Toy Vehicle Track," the entire disclosure of which is incorporated by reference herein.

FIELD OF THE INVENTION

The present invention relates to a toy vehicle track with which a toy vehicle can be used and in particular, to a toy vehicle track that can be easily assembled, disassembled, configured, and/or re-configured.

BACKGROUND OF THE INVENTION

Conventional toy vehicle track sets include one or more sections of track along which a toy vehicle can travel. In some instances, a track configuration is built from modular pieces of track that allow an end user to build a variety of play configurations. Additionally or alternatively, accessories that act on a toy vehicle may be incorporated into play configurations. The accessories may act on the toy vehicle when the toy vehicle is traveling along a track path or when the toy vehicle reaches the end of a track path. However, often, it is difficult for young children, for whom toy vehicles are often popular, to build the play configurations from the modular pieces and/or accessories. In a competitive toy landscape, it is also important that the tracks be effective across a wide range of toy vehicle types/shapes, that the tracks be manufactured efficiently and effectively, and that the tracks provide a wide range of play features.

SUMMARY OF THE INVENTION

A toy vehicle track system is disclosed herein. The toy vehicle track set includes track pieces that can include one or more connectors. Thus, two track pieces can be connected directly to each other without any additional pieces (e.g., without separate connectors pieces, pins, etc.). Moreover, the connectors included on the track pieces presented herein are specifically designed so that young children can easily connect and disconnect two track pieces without parental intervention. Additionally or alternatively, the track pieces presented herein, as well as accessories associated therewith, may be designed to assemble at specific grid locations so that any configuration of track pieces can be connected together to form a closed track path. Further features and advantages are described herein.

BRIEF DESCRIPTION OF THE DRAWINGS

Like reference numerals have been used to identify like elements throughout this disclosure.

DETAILED DESCRIPTION OF THE INVENTION

Overall, the present application is directed to new toy vehicle track pieces. In some instances, the new toy vehicle track pieces include integral connectors. Thus, two track pieces can be connected directly to each other without any additional pieces (e.g., without separate connectors pieces or pins). Moreover, the connectors are specifically designed so that young children can easily connect and disconnect two track pieces without parental intervention. Additionally or alternatively, the track pieces presented herein, as well as accessories associated therewith, may be designed to assemble at specific grid locations so that any configuration of track pieces can be connected together to form a closed track path. Further features and advantages of the track pieces are described below.

Connector System

Figure 1:
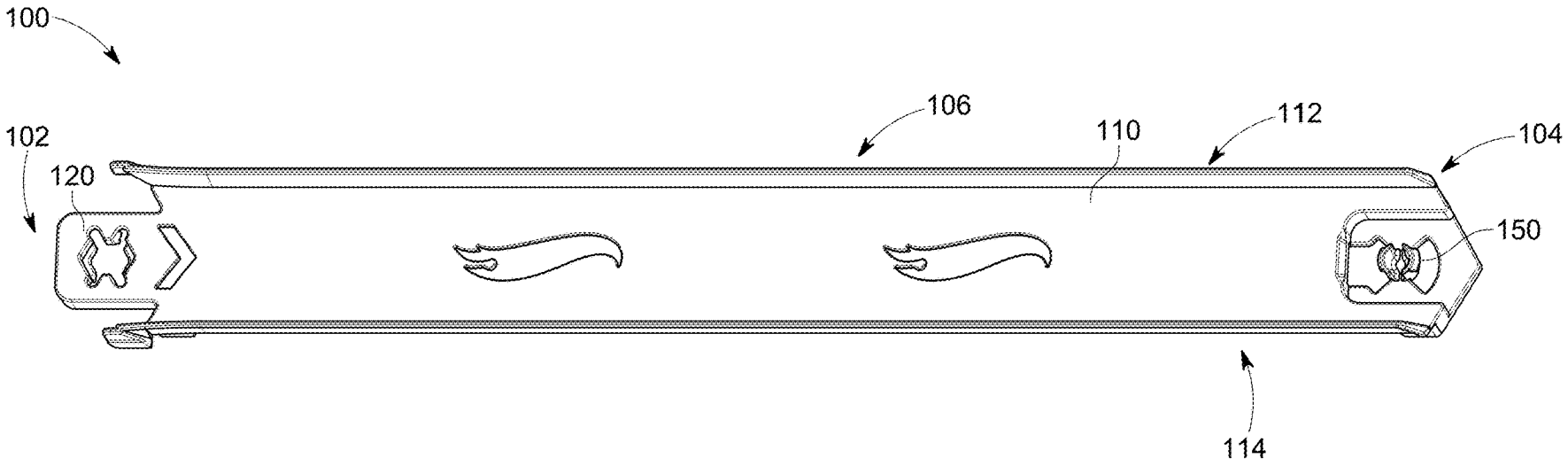
FIG. 1 illustrates a top perspective view of an example embodiment of track pieces formed in accordance with an embodiment of the present application.

FIG. 1 illustrates an example track piece formed in accordance with the present application. Generally, the track piece 100 extends from a first end 102 to a second end 104 and includes a pathway 106 defined by a bottom 110 that is bounded by opposing sidewalls 112 and 114. Thus, the track piece 100 generally defines a track pathway 106 extending from a first end 102 to a second end 104. In many track systems, the track pathway 106 terminates at an end of the track piece 100 and a separate connector is required to connect one track piece 100 to another track piece 100. However, here, the track piece 100 includes connectors that are formed integrally with the track pathway 106. Specifically, track piece 100 includes a female connector 120 formed integrally with the track pathway 106 at the first end 102 of the track piece 100 and a male connector 150 formed integrally with the track pathway 106 at the second end 104 of the track piece 100, so that the track piece is a monolithic piece.

In some embodiments, the track pathway 106 may taper towards the male connector 150 and/or the female connector 120. Tapering may provide a lead in for a snap connection and, thus, may make it easier to couple one of connectors 120/150 to a corresponding connector 120/150 of another track piece. However, such tapering is optional and one of a number of features that might facilitate snap fit connections.

In any case, among other advantages, integral connectors may make the track piece 100 easier for kids to play with. First, a child will not need to maintain a supply of tracks and a supply of connectors; a child can build a track configuration from track pieces 100 alone. This may reduce the storage requirements as well, which is often a purchase barrier for parents. Second, integral connectors 120, 150 may be easier to couple to each other as compared to systems that require a separate connector. With a separate connector, two connections must be made to couple two track pieces together: the connector to the first piece and the connector to the second piece. Moreover, young children may struggle with friction fit connections that are often used to connect a connector to a track piece. The track pieces 100 presented herein can include a snap or quick fit connection that is easier for young children to manipulate without parental intervention. The track piece 100 may also be easier to manufacture because the track piece can be molded instead of extruded, which may save manufacturing costs.

Figure 2:
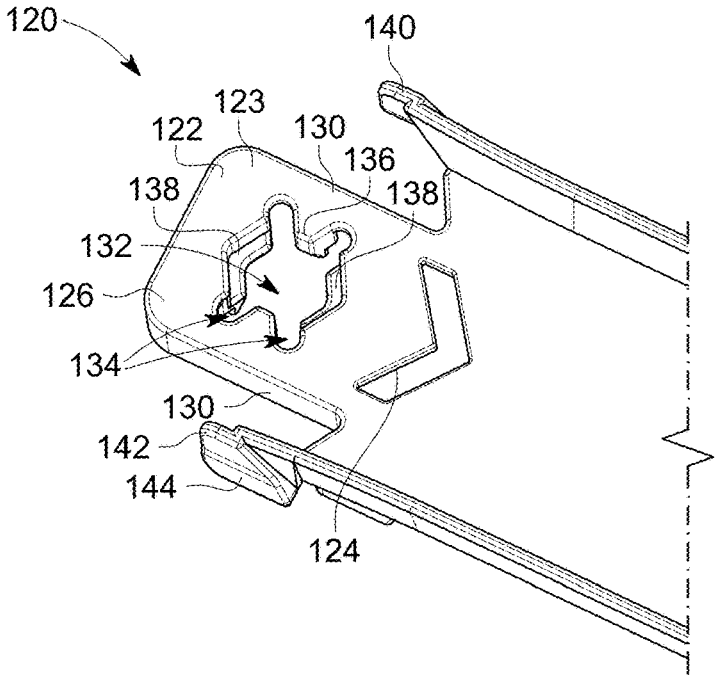
FIGS. 2 and 3 illustrate a top perspective view and a bottom perspective view, respectively, of a female connector included on the track piece of FIG. 1.
Figure 3:
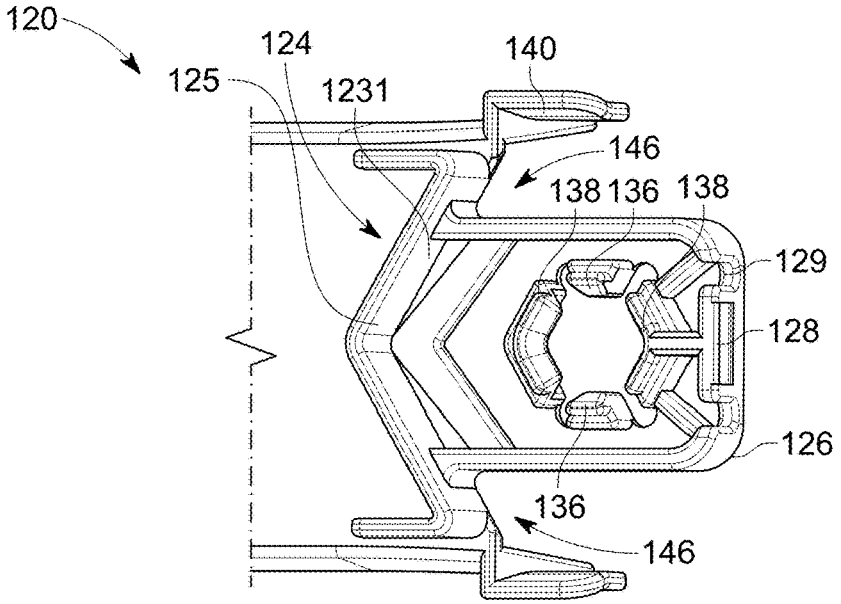
Figure 4:
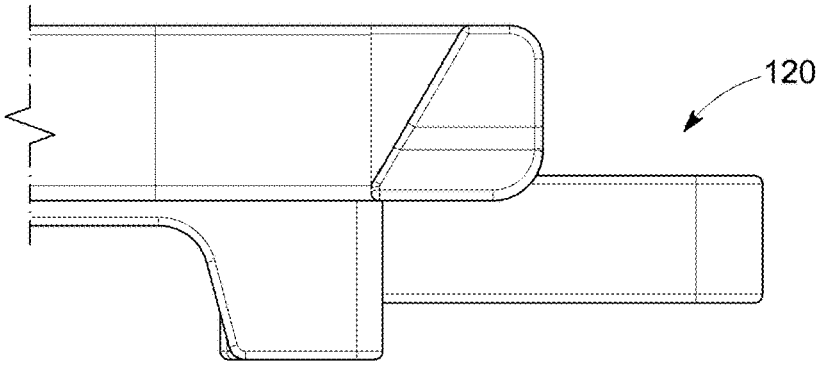
FIGS. 4-8 illustrate a side view, a front view, a rear view, a top view, and a bottom view of the female connector of FIGS. 2 and 3.
Figure 5:
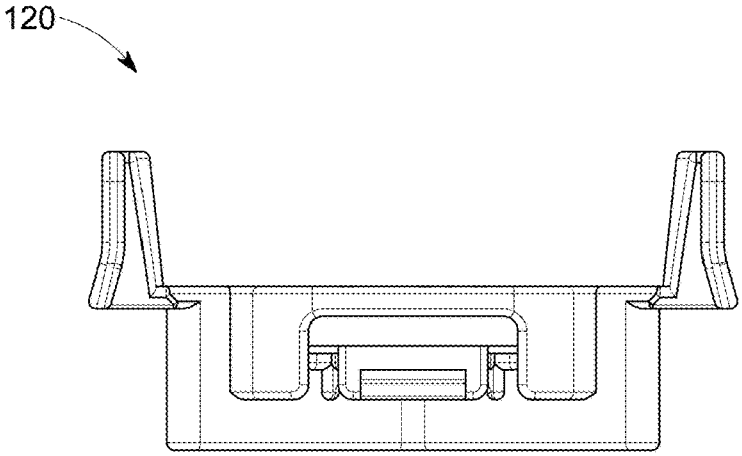
Figure 6:
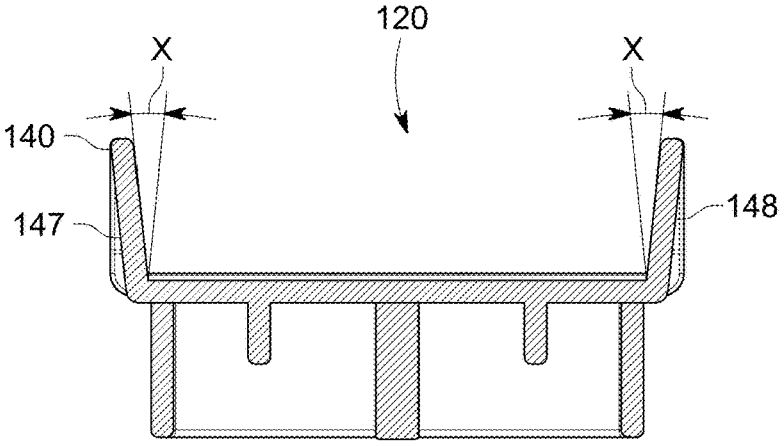
Figure 7:
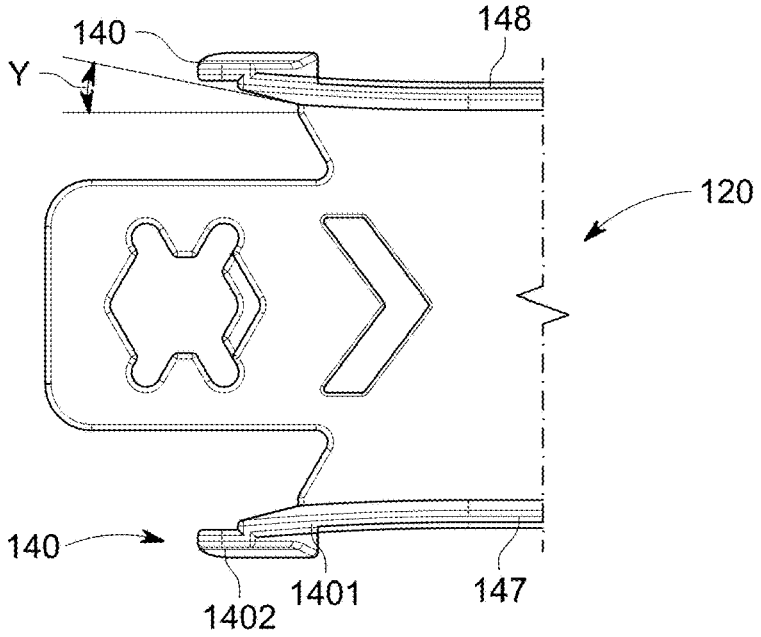
Figure 8:
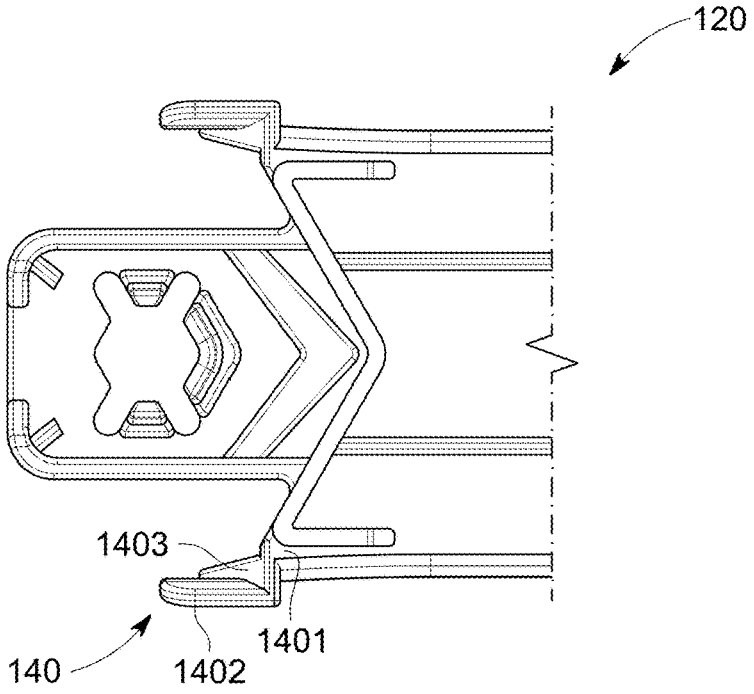

FIGS. 2 and 3 show an example embodiment of the female connector 120 in greater detail. As can be seen, the female connector includes a main body 122 that extends from a proximal end 124 to a distal end 126, between lateral edges 130. In the depicted embodiment, the main body 122 is generally rectangular with rounded corners, but other embodiments may include a main body 122 with a different shape, size, configuration, etc. In any case, a receiver 132 is formed in the main body 122 and is configured to receive a protrusion 160 (see FIG. 9) of a male connector 150.

In the depicted embodiment, the receiver 132 extends entirely through the main body 122 and has lobes 134 that extend towards the lateral edges 130 of the main body 122. The lobes 134 are each split (e.g., bisected by guides 136 that extend away (e.g., downwards) from the main body 122). Additionally, stepped surfaces 138 extend into and/or from the lobes 134 while also extending generally parallel to the proximal end 124 and distal end 126, but at a central portion of the receiver 132. That is, both the guides 136 and the stepped surfaces are disposed within an elevational extension of the lobes (e.g., between a top and bottom of the lobe height), or at least extend therein to be at least partially elevationally positioned therein. As is detailed below, the guides 136 and/or stepped surfaces 138 may allow the female connector 120 to be removably coupled to a male connector 150. That said, in other embodiments, the female connector 120 need not include a receiver 132 with these specific features and may include any desirable receiver that allows the female connector 120 to be removably coupled to a corresponding male connector 150.

In the depicted embodiment, the main body 122 of the female connector 120 is disposed between lateral guides 140 but spaced from the lateral guides 140 by openings 146. The openings 146 may be sloped at their proximal end (e.g., when viewed in an x-z plane) to correspond to a feature of the male connector 150 (detailed below). Correspondence/mating between such features may allow the female connector 120 and male connector 150 to cooperatively define wheel pathways around the main body 122 of the female connector 120. Thus, the wheel pathways may avoid the receiver 132 and associated features that could disrupt wheel rolling and/or create unwanted friction for wheels traveling thereover. In some instances, a narrow main body 122 may also provide a more secure base in which the male connector 150 can be secured to the female connector 120. This is because a narrow body may experience less deflection than a wider body. Any deflection, bend, warping, etc. of the main body 122 may reduce the effectiveness of a snap fit connection formed between the female connector 120 and the male connector 150.

Meanwhile, the lateral guides 140 each extend to a distal end 142 that is configured to mate with a corresponding portion of the male connector 150. Such mating forms continuous sidewalls laterally exteriorly of the wheel pathways. In the depicted embodiment, the lateral guides 140 each include a stepped flange 144 configured to receive a wall of the male connector 150. Again, this may discourage or prevent the wheels of a toy vehicle traversing a joint between two track pieces from encountering unwanted friction or hindrances.

Still referring to FIGS. 2 and 3, in the depicted embodiment, the female connector 120 includes a stand 125 and a central flange 128. The stand 125 is disposed adjacent the proximal end 124 of the main body 122 and the central flange 128 is disposed adjacent the distal end 126 of the main body 122. One or both of the stand 125 and the central flange 128 may help to elevate the main body 122 from a support surface on which a track piece 100 including the female connector 120 is positioned. This may help a user (e.g., a child) who is attempting to couple the female connector 120 to a male connector 150 (e.g., to build a track configuration) to grasp an underside of the toy vehicle track during the coupling process, thereby easing the coupling process. Additionally or alternatively, this elevation may properly position a track piece including the female connector 120 to interact/interplay with various track accessories. As an example, in some embodiments, the stand 125 may position the main body so that a top surface 123 of the main body 122 is approximately 0.4 inches to 0.6 inches above a support surface (e.g., 0.43 inches).

Still further, the central flange 128 and/or the stand 125 may help to position and/or orient a male connector 150 with respect to the female connector 120 and, specifically with respect to the receiver 132. For example, a proximal end of a male connector 150 may engage the stand 125 when a male connector 150 is aligned with the female connector 120 to couple two track pieces 100 together. Meanwhile, or alternatively, the central flange 128 can engage a slot or groove included in the male connector 150 to position and/or orient a male connector 150 with respect to the female connector 120. In the depicted embodiment, the central flange 128 is laterally bounded by grooves 129 that provide clearance for the central flange 128 and/or improve the flexibility of the central flange 128. Other embodiments, however, need not include grooves 129. In fact, other embodiments need not include central flange 128 and/or stand 125.

FIGS. 4-8 provide additional isometric views that further depict the female connector 120 and the features thereof. Among other features, these Figures clearly depict how the female connector 120 is laterally bounded by sidewall 147 and sidewall 148, each of which are disposed longitudinally interiorly of lateral guides 140 (i.e., between lateral guides 140 and the pathway of a track along the length of the track piece). These opposing sidewalls 147, 148 may be formed integrally with (i.e., formed monolithically with) or otherwise coupled to opposing sidewalls of a track pathway extending between the female connector 120 and a male connector 150 so that the female connector 120 cooperates with the pathway of a track piece to provide a continuous sidewall. For example, opposing sidewalls 147, 148 may be formed integrally with sidewalls 112 and 114 of pathway 106 (see FIG. 1).

In the depicted embodiment, sidewalls 147, 148 extend from the main body 122 at an angle X and terminate at guides 140. Angle X provides more space between the sidewalls 147, 148, e.g., as compared to sidewalls extending perpendicularly and, thus, may enable toy vehicles with varying chasses to pass through female connector 150. The opposing walls of a track pathway (e.g., sidewalls 112, 114 of pathway 106) and/or a male connector 150 connected thereto may have the same angling or different angling, as is discussed further below. However, critically, the lateral guides 140 may further taper from sidewalls 147, 148 to enable lateral guides 140 to smoothly capture opposing sidewalls of a male connector 150 to which the female connector 120 is connected.

More specifically, the lateral guides 140 may each include a widening section 1401 and a capture flange 1402. The widening flange 1401 tapers laterally away from sidewall 147 or sidewall 148 at an angle Y and the capture flange 1402 extends longitudinally away from a distal end of its widening section 1401. However, at the same time, the widening section 1401 and/or the capture flange 1402 may be angled along its height (e.g., elevationally or along a y-axis) so that the guides 140 can extend around and closely conform to opposing sidewalls of a male connector 150 to which the female connector 120 is coupled. Then, the lateral guides 140 can ensure that opposing sidewalls 147, 148 are connected to opposing sidewalls of male connector 150 (discussed below) via a continuous sidewall connection. For example, taper angle Y may ensure that guides 140 slide along opposing sidewalls of a male connector 150 to which the female connector 120 is coupled. Moreover, in at least some embodiments, an underside 1403 of the widening section 1401 may be tapered along a Y-axis (e.g., a height direction) to match a taper included on an end of opposing sidewalls and further ensure that the female connector 120 and the male connector 150 form continuous opposing sidewalls when coupled together.

Figure 9:
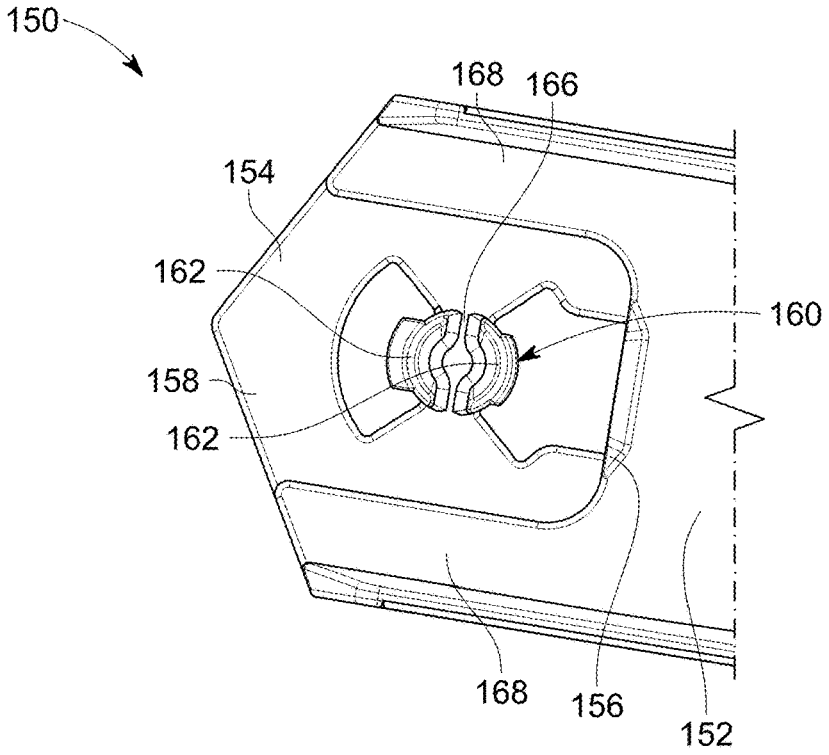
FIGS. 9 and 10 illustrate a top perspective view and a bottom perspective view, respectively, of a male connector included on the track piece of FIG. 1.
Figure 10:
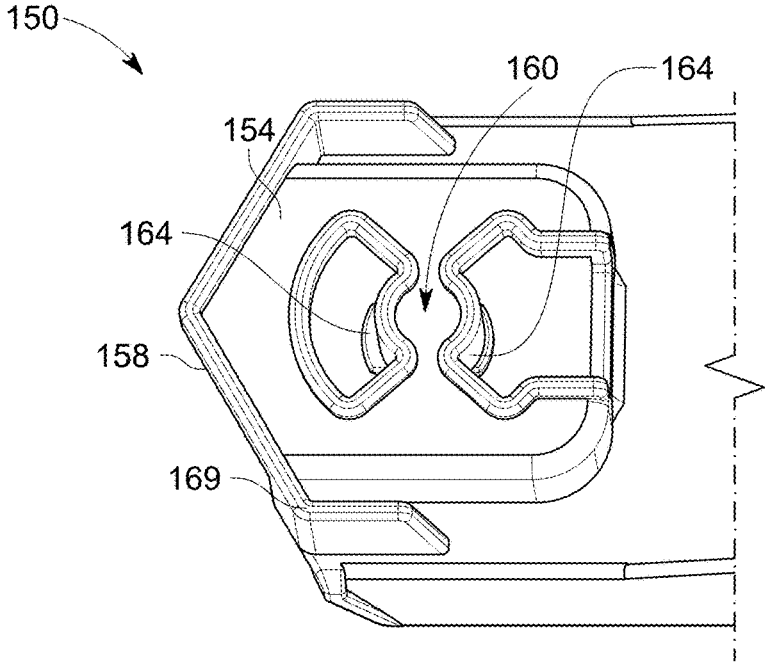
Figure 11:
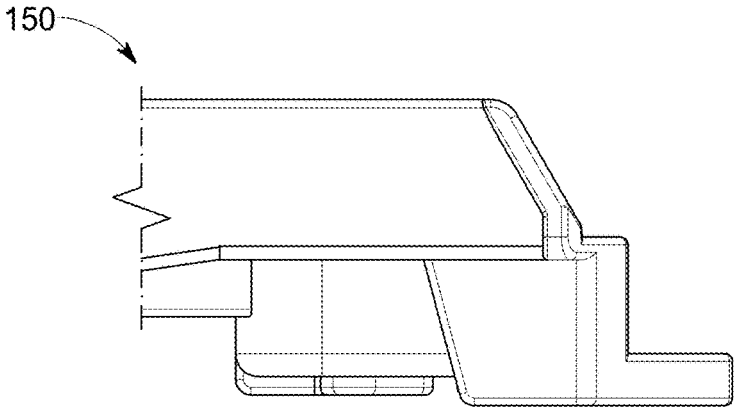
FIGS. 11-15 illustrate a side view, a front view, a rear view, a top view, and a bottom view of the female connector of FIGS. 9 and 10.
Figure 12:
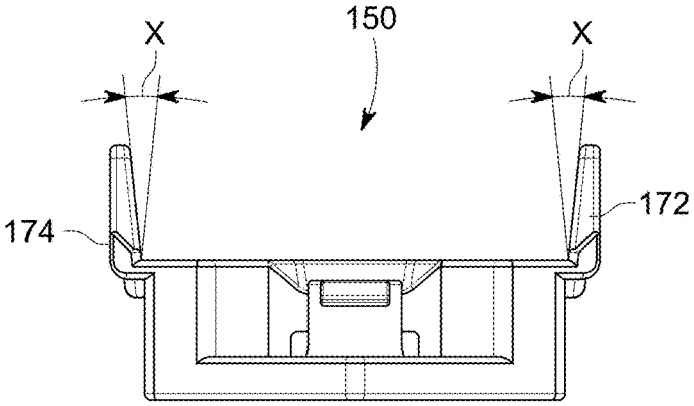
Figure 13:
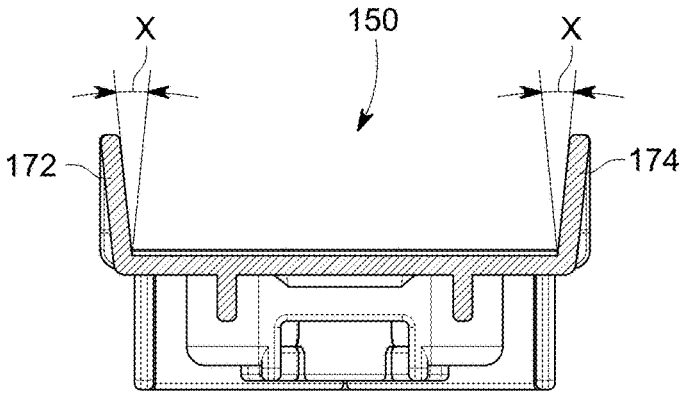
Figure 14:
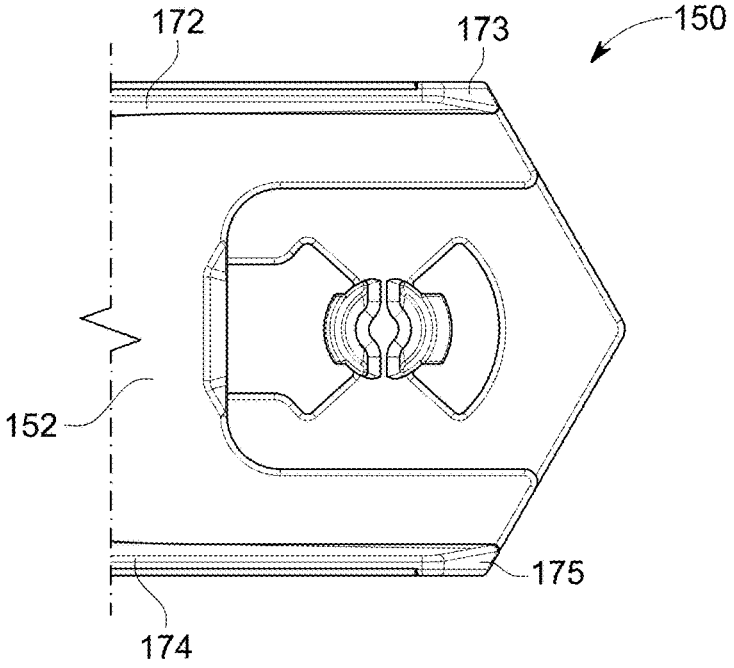
Figure 15:
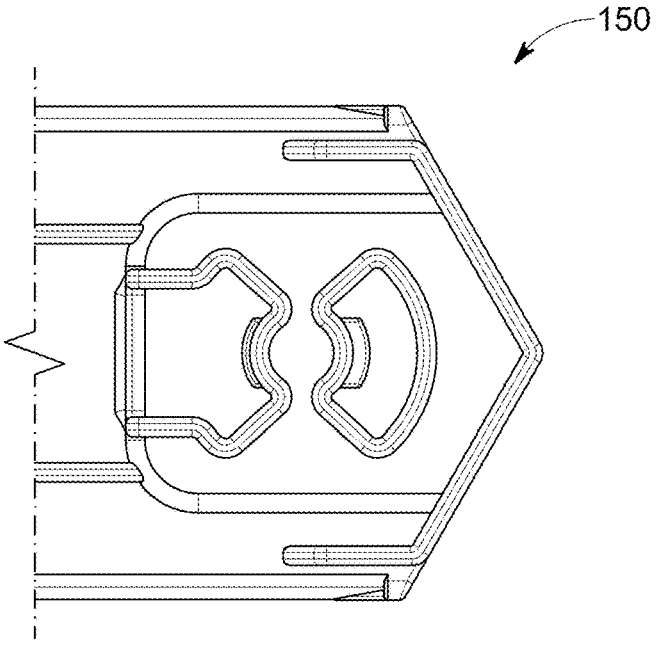

Now turning to FIGS. 9 and 10, the male connector 150 generally includes a main body 152 with an inset 154. The inset 154 is laterally bounded by lateral planar surfaces 168 and extends from a proximal end 156 to a distal end 158. The distal end 158 of the depicted embodiment has arrow/chevron style shaping that provides a directional indication, e.g., of a direction in which the male connector 150 should be installed into a female connector 120. This shaping may also mate with the stand 125 of the female connector 120. However, other embodiments may have any shape, size, configuration, etc.

A protrusion 160 extends away from the inset 154, in a direction towards a plane of the lateral planar surfaces 168 (but to be clear, the lateral planar surfaces 168 need not be flat). That is, the protrusion 160 may extend upwards or "elevationally" from the inset 154. In the depicted embodiment, the protrusion 160 includes two extensions 162 separated by a gap 166. Thus, the extensions 162 may flex towards or away from each other, e.g., to slide into the receiver 132 of the female connector 120 and to snap back thereafter (thereby providing a snap fit between the female connector 120 and the male connector 150). Moreover, in the depicted embodiment, the extensions 162 each include a barbed cap 164 that further facilitates the snap fit engagement but does not prevent disengagement of this snap fit engagement. That is, the barbed cap 164 facilitates a removable, but stable and secure snap fit connection between the protrusion 160 of the male connector 150 and the receiver 132 of the female connector 120. This connection is detailed further below. For simplicity, extensions 162 with barbed caps 164 may be referred to as "barbed extensions" in this application.

As can be seen in the bottom view of FIG. 10, in at least some embodiments, the male connector 150 may include a stand 169 disposed proximate or adjacent to the distal end 158. The stand 169 may generally be configured to align a top surface of the inset 154 with a bottom surface 1231 of the main body 122 of the female connector 120 while also elevationally aligning the lateral planar surfaces 168 with the top surface 123 of the main body 122 of the female connector 120. Thus, the stand 169 can ensure that a female connector 120 can be securely connected to a male connector 150 when two track pieces 100 are resting on the same support surface while also ensuring that the female connector 120 and male connector 150 can collectively provide a flat top surface along which a toy vehicle can travel during play with the track (i.e., that the top surfaces are elevationally aligned). Thus, a toy vehicle can traverse a joint formed by the female connector 120 and the male connector 150 without encountering significant hindrances, obstacles, enhanced friction, etc.

FIGS. 11-15 provide additional isometric views that further depict the male connector 150 and the features thereof. Among other features, these Figures clearly depict how the main body 152 of the male connector 150 is laterally bounded by sidewall 172 and sidewall 174. These opposing sidewalls 172, 174 may be formed integrally with (i.e., formed monolithically with) or otherwise coupled to opposing sidewalls of a track pathway extending between the male connector 150 and a female connector 120 so that the male connector 150 cooperates with the pathway of a track piece to provide a continuous sidewall. For example, opposing sidewalls 172, 174 may be formed integrally with sidewalls 112 and 114 of pathway 106 (see FIG. 1).

In the depicted embodiment, sidewalls 172, 174 extend from the main body 152 at angle X from the main body 152 and terminate at tapered ends 173, 175, respectively (i.e., the same angle X as sidewalls 147, 148 of female connector 120). Again, angle X provides more space between the sidewalls 172, 174, e.g., as compared to sidewalls extending perpendicularly from the main body 152 and, thus, may enable toy vehicles with varying chasses to pass through male connector 150. Moreover, providing a constant wall angle over the track pathway (e.g., sidewalls 112, 114 of pathway 106), the male connector (e.g., sidewalls 172, 174) and the female connector (e.g., sidewalls 147, 148) may ensure that a smooth, continuous sidewall is provided along a length of track pieces, reducing or eliminating potential sources of friction from the track piece. Moreover, as is discussed above, sidewalls 172, 174 and/or tapered ends 173, 175 may ensure that a coupling between female connector 120 and male connector 150 is bounded by continuous opposing sidewalls.

Figure 16:
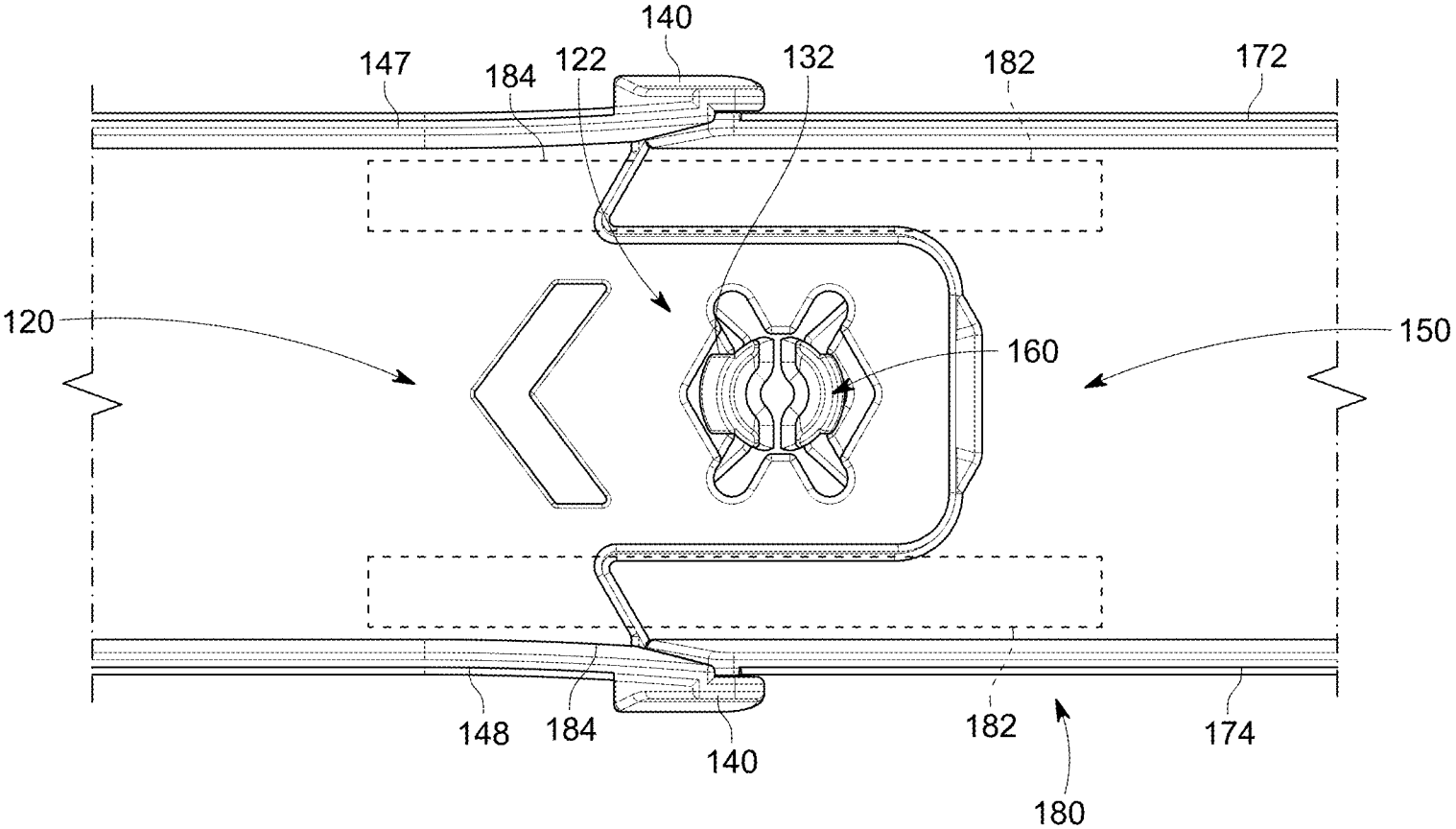
FIG. 16 illustrates a male connector of FIGS. 2 and 3 coupled to a female connector of FIGS. 9 and 10, in accordance with an embodiment of the present application.

FIG. 16 depicts a top view of a coupling 180 between a female connector 120 and a male connector 150. Notably, in this coupling 180, lateral guides 140 extend around and capture sidewalls 172 and 174 so that the coupling 180 is laterally bounded by continuous opposing sidewalls 184. More specifically, when lateral guides 140 capture sidewalls 172 and 174, the capture flange 1402 of each lateral guide may extend around sidewalls 172 and 174, holding sidewalls 172 and 174 against the inwardly facing, tapered surface of the widening section 1401, in alignment with sidewalls 147 and 148 of the female connector 120. Moreover, in the depicted embodiment, the undersides 1403 of the widening section 1401 may sit atop of tapered ends 173 and 175 when lateral guides 140 capture sidewalls 172 and 174. This may ensure that top edges of sidewalls 172 and 174 are held in alignment with sidewalls 147 and 148. However, other embodiments may be considered aligned without such features (e.g., with lateral guides 140, but without underside 1403 and mating tapered ends 173 and 175).

In FIG. 16, the continuous opposing sidewalls 184 define a laterally exterior boundary of toy vehicle wheel paths 182 that span the coupling 180, which are depicted by dashed boxes in FIG. 16. Meanwhile, the interior lateral boundary of the toy vehicle wheel paths 182 are disposed laterally exterior of the main body 122 of the female connector 120, or at least laterally exterior of the receiver 132 of the female connector 120 (in which the protrusion 160 is installed to form coupling 180). This ensures that the toy vehicle wheel paths 182 extending across coupling 180 do not directly traverse the receiver 132 or the protrusion 160, removing potential obstacles and/or sources of friction from the toy vehicle wheel paths 182. Or, from another perspective, this prevents the wheels of a toy vehicle from impacting the coupling 180 secured by protrusion 160 and receiver 132 and accidentally dislodging and/or damaging the coupling 180.

In view of the foregoing, the location of the toy vehicle wheel paths 182 is critical to ensuring that the male connector 150 and female connector 120 can be and remain properly secured together. The location of the toy vehicle wheel paths 182 is also critical to ensuring that a wide variety of toy vehicles can smoothly traverse the track without experiencing unwanted friction or obstacles at a coupling 180. In turn, this ensures that the toy vehicles can travel at high speeds and maintain speed along a length of track pieces. This adds play value to the track set because it allows toy vehicles to travel further distances, higher heights, and/or over more and/or larger obstacles and accessories.

Figure 16A:
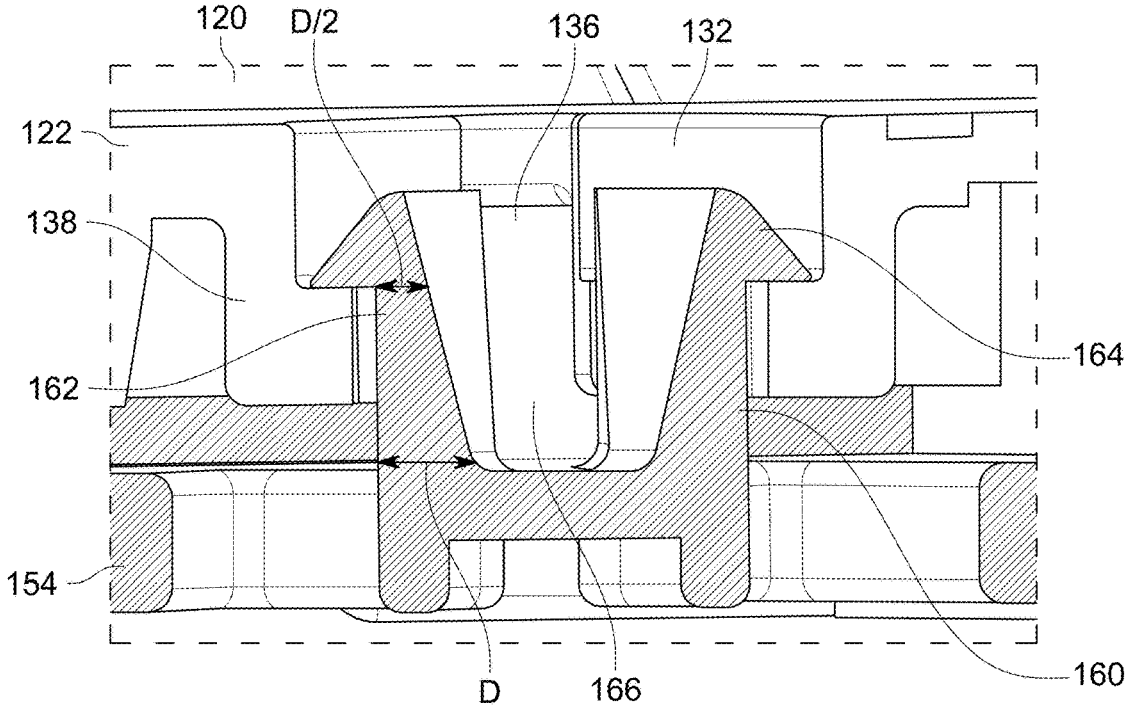
FIGS. 16A and 16B illustrate sectional views of a male connector of FIGS. 2 and 3 coupled to a female connector of FIGS. 9 and 10, in accordance with an embodiment of the present application.
Figure 16B:
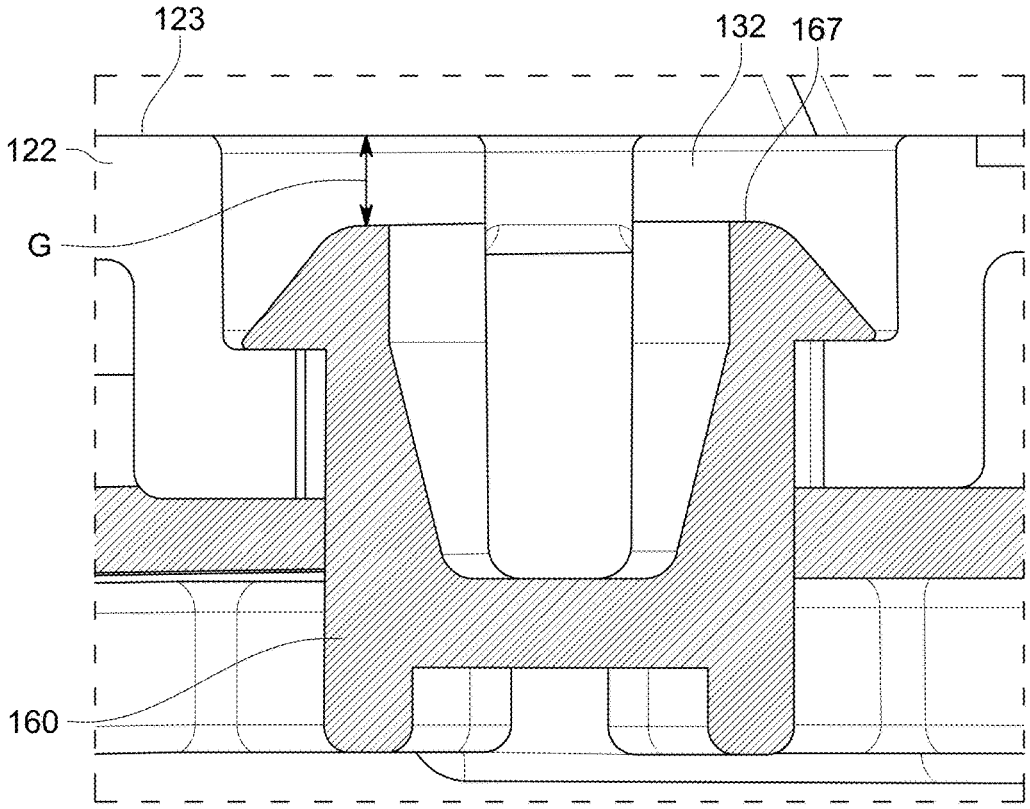
Figure 17A:
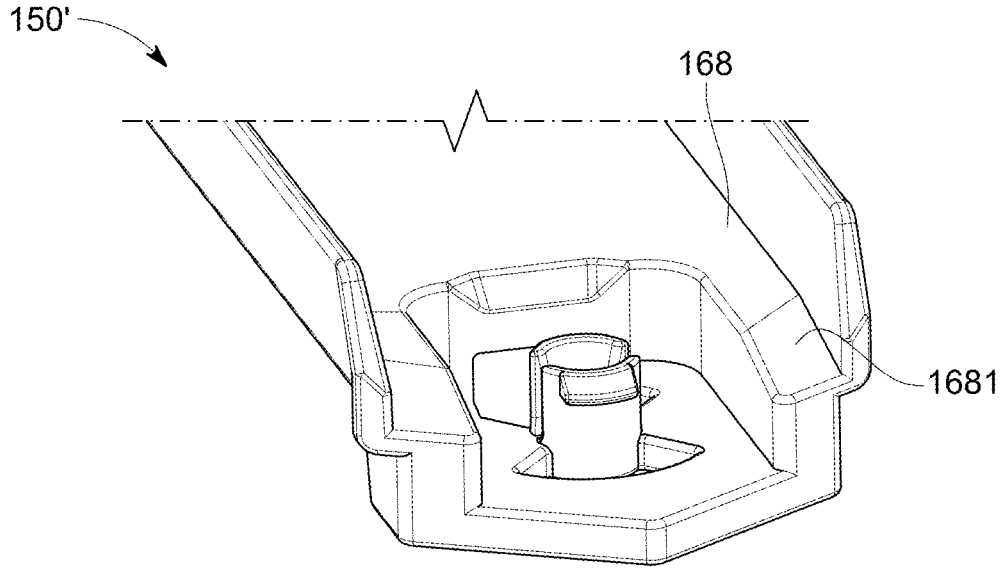
FIG. 17A illustrates a top perspective view of another embodiment of a male connector that may be included on the track pieces presented herein.
Figure 17B:
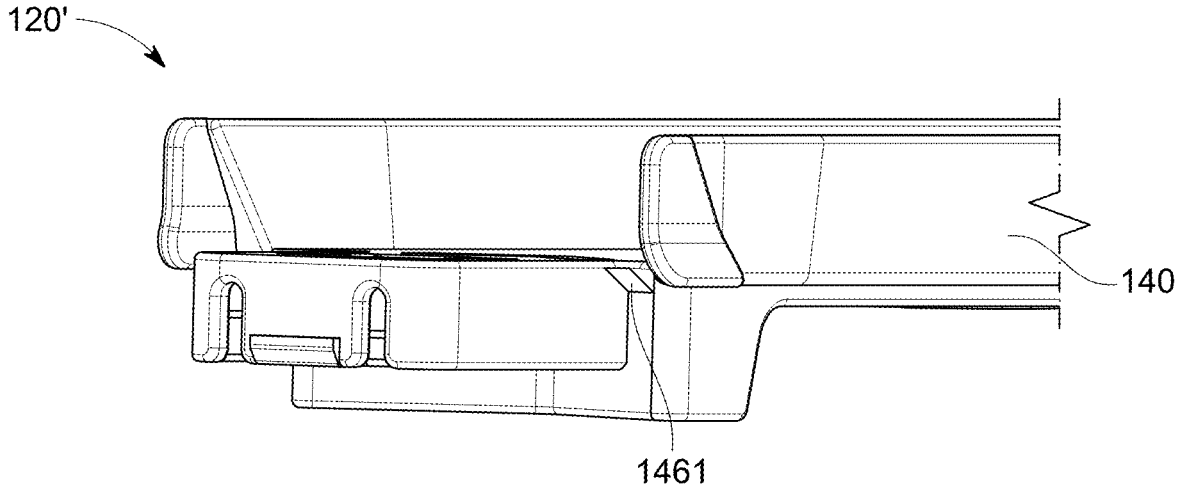
FIG. 17B illustrates a side perspective view of another embodiment of a female connector that may be included on the track pieces presented herein.

FIGS. 16A and 16B show sectional schematic views of a female connector 120 removably coupled to a male connector 150. Notably, when the female connector 120 is removably coupled to a male connector 150, the barbed cap 164 sits atop of the stepped surfaces 138 that bound the receiver 132. The barbed cap 164 may also, or alternatively, sit atop of guides 136. In any case, the protrusion 160 cannot disengage from the receiver 132 unless a force applied to the protrusion 160 causes the extensions 162 to flex towards each other. Flexure of the barbed extensions causes the barbed caps 164 to disengage from the receiver 132.

In the depicted embodiment, a base of each extension 162 has a width D and a distal end distal end of each extension 162 (adjacent barbed cap 164) has a width that is half as large (D/2). This provides extensions 162 with sufficient strength to prevent accidental disengagements from receiver 132 while also allowing a young child to easily disengage the female connector 120 from the male connector 150 when desired. Still further, such widths enable a young child to easily engage the female connector 120 with the male connector 150 (e.g., by pushing barbed cap 164 through stepped surfaces 138 and into receiver 132) via a snap fit connection.

Moreover, in the depicted embodiment, each extension 162 and its barbed cap 164 has a height that allows the protrusion 160 to sit in the receiver 132 without protruding above the receiver 132. Specifically, the guides 136 and/or the stepped surfaces 138 are elevationally positioned or countersunk within the receiver 132 and the protrusion 160 is sized so that it leaves a gap G between a distal end 167 of the protrusion 160 and the top surface 123 of the main body 122 of the female connector 120. This prevents the protrusion 160 from extending into or onto a track pathway defined by the female connector 120 and hindering or obstructing a toy vehicle traversing a joint formed by the female connector 120 and the male connector 150.

Now turning to FIGS. 17A, 17B, 18, and 19A-C, as mentioned, different embodiments of the female connector 120 and/or the male connector 150 presented herein may incorporate any number of different features. FIGS. 17A, 17B, 18, and 19A-C provide examples of alternative features. First, in FIGS. 17A and 17B, the lateral planar surfaces 168 of a male connector 150' include sloped distal ends 1681 (FIG. 17A) that are configured to mate with sloped bottom surfaces 1461 (FIG. 17B) of a female connector 120'. Collectively, these features may allow for top-down alignment and engagement of the female connector 120' and the male connector 150'. Additionally, the sloped distal ends 1681 may allow for a smooth roll-off when the male connector 150' is included in a track piece 100 that is being used without connecting male connector 150' to a female connector 120'. Still further, the sloped bottom surfaces 1461 may prevent wall deformation.

Figure 18:
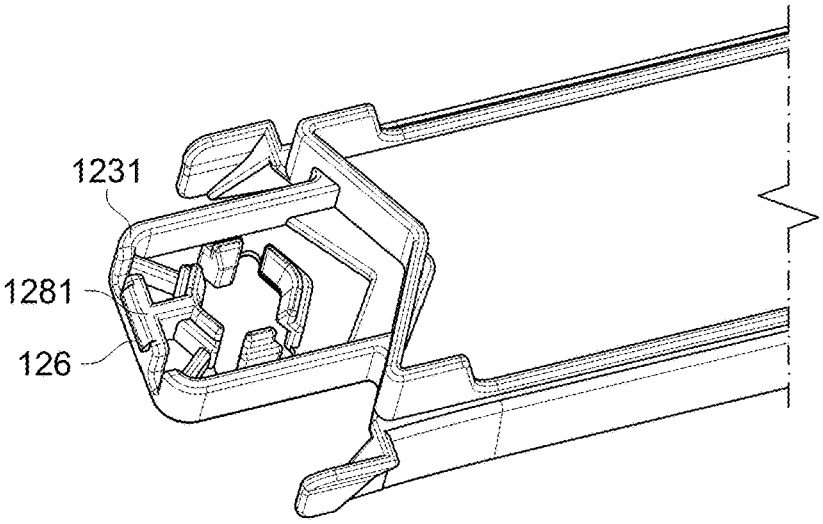
FIG. 18 illustrates a bottom perspective view of yet another embodiment of a female connector that may be included on the track pieces presented herein.

Meanwhile, in FIG. 18, the distal end 126 of the main body 122 includes a central flange 1281 that extends longitudinally along a bottom surface 1231 of the main body 122 (by comparison, central flange 128 extends generally laterally). Flange 1281 may be used instead of or together with the central flange 128 to help align a male connector 150 with a female connector 120.

Figure 19A:
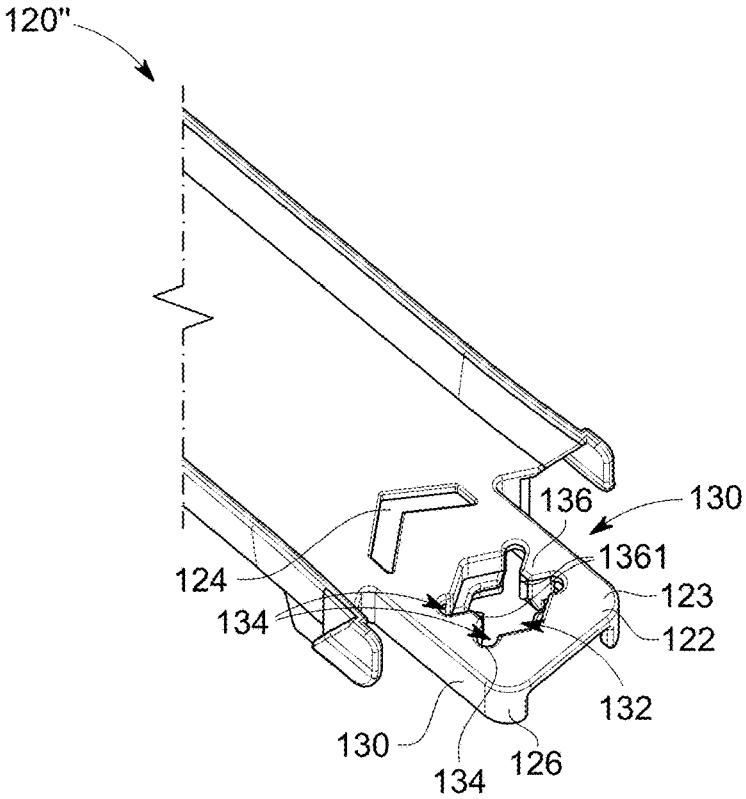
FIGS. 19A-19C illustrate top and bottom perspective views of yet another embodiment of a female connector that may be included on the track pieces presented herein.
Figure 19B:
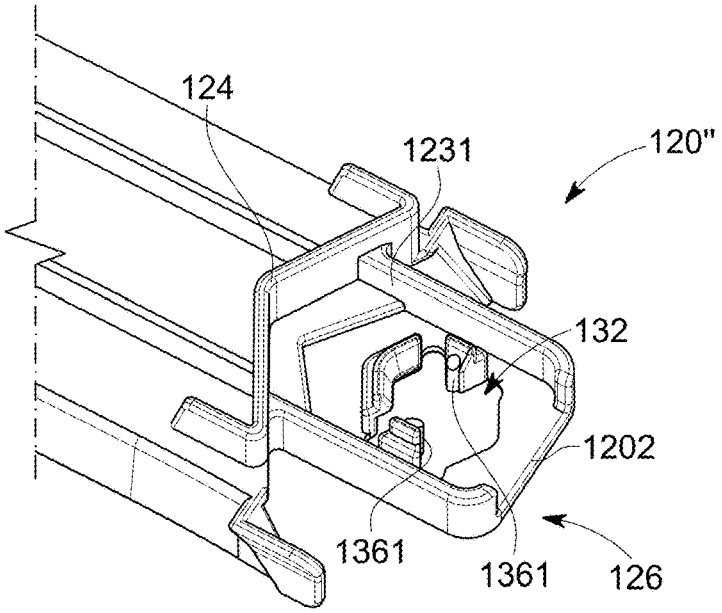
Figure 19C:
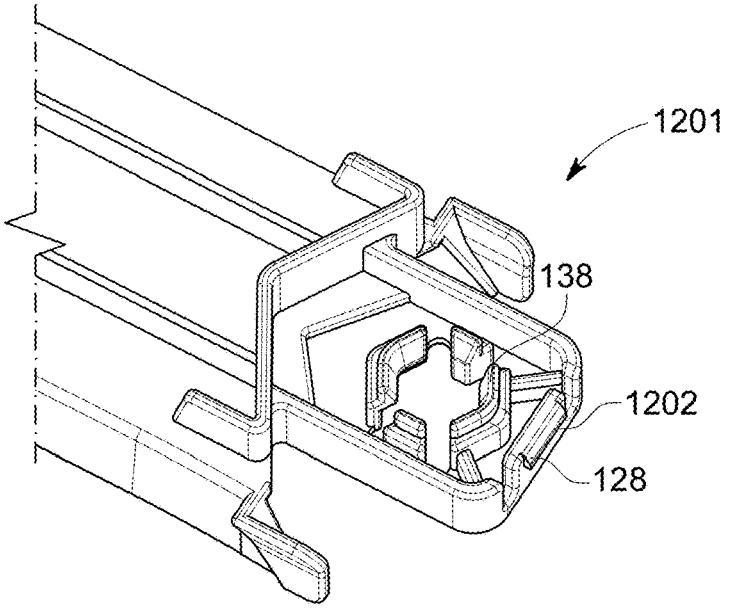

Finally, FIGS. 19A and 19B depict a female connector 120" that allows both top-down and slide-in couplings. That is the female connector 120" allows a user to couple two track pieces together by moving the couplers laterally into each other (e.g., by sliding along a support surface) and/or by moving one track piece downwards onto another. FIG. 19C is an illustration 1201 that compares female connector 120" to female connector 120. One significant difference between female connector 120 and female connector 120" is that the area 1202 marked in hashing/coloring in FIG. 19C is removed in female connector 120". This removes the central flange 128 and the stepped surface 138 closest to the distal end 126 of the female connector 120 from female connector 120".

Instead, as can be seen in FIG. 19B, area 1202 is empty on female connector 120". Thus, the distal end 126 of the female connector 120" can slide atop the inset 154 of a male connector 150 (e.g., with the protrusion 160 of the male connector 150 riding along or in close proximity to the bottom surface 1231 of main body 122) until the protrusion 160 of the male connector 150 enters the receiver 132 of the female connector 120". Connecting track pieces together via a side and/or sliding coupling may be particularly advantageous in instances where there are both male and female track connectors on the same side of a track piece (eliminating the need to tilt the playset to engage both sets of connectors) and/or when the playset is too big or cumbersome to lift. Thus, for example, female connector 120" may be ideal for "tile"-style track pieces that are often slid into engagement with one another and/or with another track piece, as is detailed further below.

Moreover, the track pieces including female connector 120" may often be heavier pieces, such as launchers, accessories, tiles, etc. (examples of which are discussed below). With these heavier pieces, less fiction is needed to secure a secure connection (e.g., a snap fit connection) between the female connector 120" and a male connector 150. The weight of the pieces may facilitate the connection and tend to discourage a disconnection.

One other difference between female connector 120 and female connector 120" is that female connector 120" includes extended guides 1361, which are extended as compared to the guides 136 of female connector 120. The extended guides 1361 still extend between lobes 134 (e.g., in the same location as guides 136); however, the extended guides 1361 extend further away from the lateral edges 130 of the main body 122 of the female connector 120" (further into the receiver 132). In fact, in some instances, the extended guides 1361 may be additional features that extend from a distal ends of guides 136 (thus guides 136 are marked in FIG. 19A).

The extended guides 1361 ensure that a protrusion 160 of a male connector 150 entering the receiver 132 of the female connector 120" will still snap into the receiver 132 of female connector 120, despite the absence of one of the stepped surfaces 138. That is, as a male connector 150 slides into engagement with female connector 120", moving from the distal end 126 towards the proximal end 124 of main body 122, the protrusion 160 of the male connector 150 may move into contact with extended guides 1361 and snap into engagement therewith. For example, the protrusion 160 may snap towards the top surface 123 of the main body 122 and form a snap-fit connection, such as the one shown and described in connection with FIGS. 16A and 16B.

Straight Track Pieces

Figure 20:
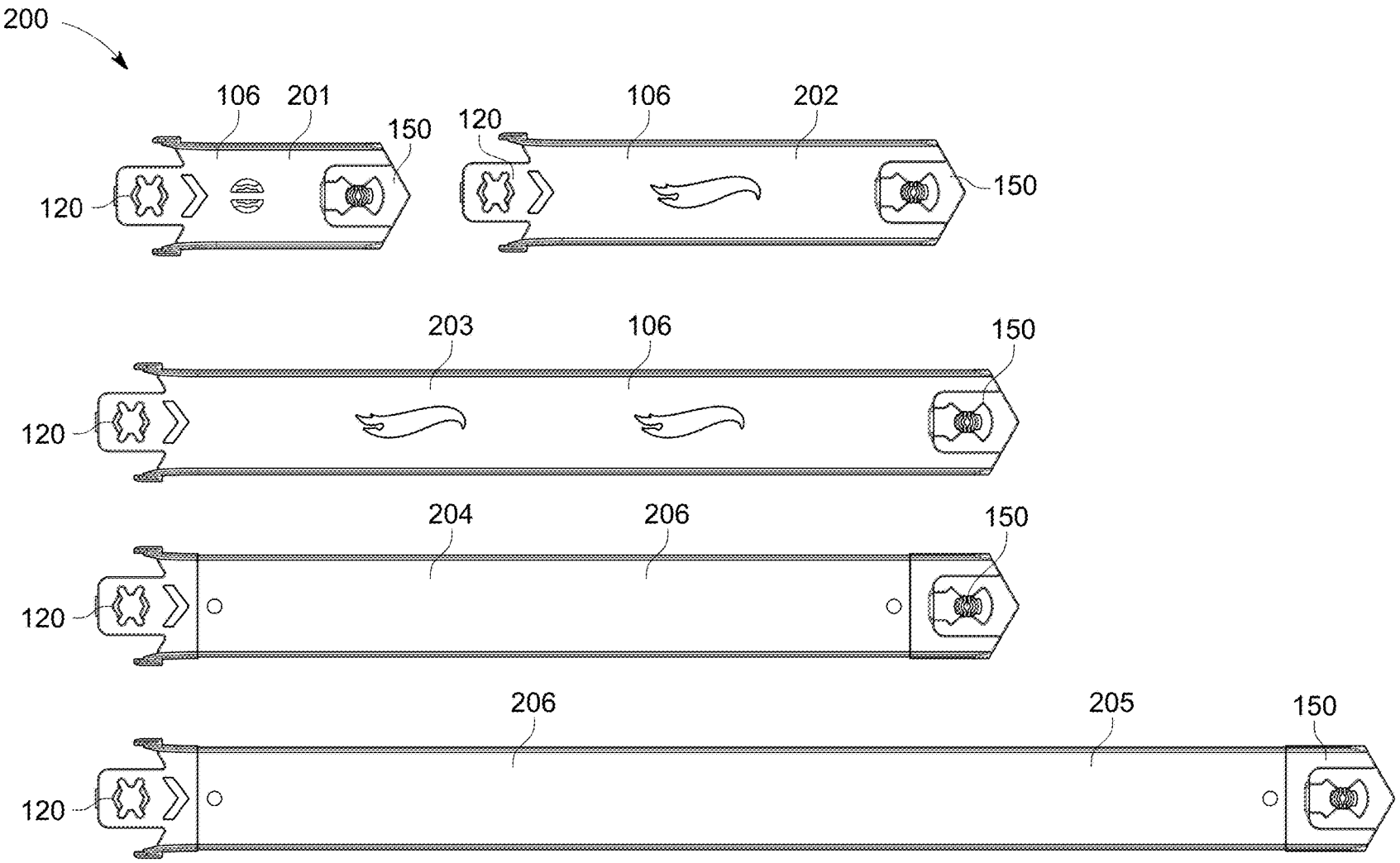
FIG. 20 illustrates a set of track pieces formed in accordance with the techniques presented herein.

FIG. 20 illustrates a set of track pieces 200 including track pieces with connectors that are fixedly coupled thereto. In this set 200, track pieces 201, 202, and 203 have female connector 120 and male connector 150 formed integrally with a track pathway 106. Meanwhile, track pieces 204 and 205 include a track pathway 206 formed separately from female connector 120 and male connector 150, but fixedly coupled thereto. However, track pieces 201, 202, 203, 204, and 205 are merely examples and any feature of one of these example track pieces could be incorporated into another. For example, while track pieces 203 and 204 demonstrate two options for forming tracks of the same length, it is also possible to form tracks of any other length in accordance with these two options (or more options).

In at least some embodiments, track pieces 201, 202, and 203 may be formed in a single manufacturing process, e.g., via molding, casting, etc. By comparison, the connectors 120, 150 included in track pieces 204 and 205 may be formed via one manufacturing process and the track pathway 206 of track pieces 204 and 205 may be formed from a second manufacturing process that is the same or different from the first manufacturing process. As an example, track pathways 206 may be formed via an extrusion process and the connectors 120, 150 included in track pieces 204 and 205 may be formed via a molding process.

Thus, in at least some embodiments, track pieces 201, 202, 203 may be relatively stiff or relatively unmovable while track pieces 204 and 205 are flexible between female connector 120 and male connector 150. Thus, track pieces 204 and 205 may be usable to form inclines, declines, loops, twists, and other stunts, turns, etc. while track pieces 201, 202, and 203 may, in some embodiments, only form straight tracks. However, in at least some embodiments, female connector 120 and male connector 150 may provide some play or pliability (e.g., some freedom of movement) so that, for example, even a stiff/inflexible track piece 201, 202, 203 could provide an incline, decline, slight turn, or other small degree of change or turn. Alternatively, molded track pieces may be molded to provide such features, as is detailed below. Regardless of how the parts of track pieces 204, 205 are manufactured, connectors 120, 150 may be coupled to track sections 210 via any techniques now known or developed hereafter, including via couplers (e.g., bolts), ultrasonic welding techniques, friction stir welding techniques, compression, heat sealing, etc.

Now turning to FIGS. 21A-21E, FIGS. 22A-22E, FIGS. 23A-23E, FIGS. 24A-24E, and FIGS. 25A-25E, the track pieces of set 200 generally have dimensions that make the track pieces compatible with each other. Most notably, all of track pieces 201, 202, 203, 204, and 205 have the same width W and overall height H when viewed from the front and from the side, respectively. Although not shown, track pieces 201, 202, 203, 204, and 205 also have the same trackway height (e.g., a dimension measure from the bottom of dimension H to the top surface of track pathways 106 or track pathway 206). Thus, when track pieces 201, 202, 203, 204, and 205 are connected to each other, the track pieces will form a continuous track pathway bounded by continuous walls of the same height. This may be functionally advantageous because continuous walls and track pathways allow toy vehicles to travel unimpeded (on top of also being aesthetically beneficial).

On the other hand, most of track pieces 201, 202, 203, 204, and 205 have different overall lengths (L1, L2, L3, L3, and L4, respectively). The overall lengths are determined based on the length of the connectors 120, 150 and the distance between mounting points of the connectors (e.g., between the receiver 132 of the female connector 120 and the protrusion 160 of the male connector 150). The distance between mounting points is referred to herein as a "coupler span length." Notably, in this embodiment, the coupler span lengths of track pieces 201, 202, 203, 204, and 205 are increments of a base unit. Specifically, track piece 201 has a coupler span length X, track piece 202 has a coupler span length that is double that of length X, track pieces 203 and 204 each have a coupler span length that is quadruple that of length X, and track piece 205 has a coupler span length that is six times that of length X. As is explained in further detail below, these coupler span lengths allow the track pieces of set 200 to connect in a grid arrangement.

In the depicted embodiment, track pieces 202, 203, 204, and 205 each include one or more indicia 207 representative of the coupler span length of that specific track. In fact, in the specific embodiment depicted in FIGS. 21A-21E, FIGS. 22A-22E, FIGS. 23A-23E, FIGS. 24A-24E, and FIGS. 25A-25E, each indicum 207 represents a coupler length of 2X. Thus, track piece 202, which has a coupler length of 2X, includes a single indicum 207. Meanwhile, track pieces 203 and 204 include two indicia 207 spaced along a coupler length of 4X and track piece 205 has three indicia 207 spaced along a coupler length of 6X. If, for example, a 2X span is six inches, the single indicum 207 on track 202 indicates that track 202 has a coupler span length of 6 inches, the two indicia 207 on tracks 203 and 204 indicate that these tracks have a coupler span length of 12 inches, and the three indicia 207 on track 205 indicate that track 205 has a coupler span length of 18 inches.

On the other hand, track piece 201 does not include an indicum 207 because track piece has a coupler span length X that is less than the 2X associated with indica 207. However, in other embodiments, indicia 207 may be representative of a different coupler span unit (e.g., 1X instead of 2X) and tracks may be marked accordingly. In any case, indicia representative of coupler length may be advantageous because it may allow younger children to easily gauge track lengths and create closed track configurations.

In the depicted embodiment, the one or more indicia 207 have the shape of a flame or flame logo. Moreover, in this specific instance, the one or more indicia 207 are evenly spaced along an overall coupler length of a track piece and are centered on the track pathway of a track piece. However, in other embodiments, one or more indicia 207 may have any shape, size, or style, may be disposed in any desirable location on a track piece, and/or may be spaced in any desirable manner along a coupler span length. Still further, when track pieces of the present application include one or more indicia 207, the indicia 207 may be printed, imprinted, embossed, cutout, or formed on a track in any other manner now known or developed hereafter.

Now turning specifically to FIGS. 21A-21E, in some embodiments, track pieces 201, 202, 203, 204, and 205 may include additional features that facilitate track building. As one example, track piece 201 includes a riser mount 220 disposed beneath track pathway 106. The riser mount 220 allows track piece 201 to be mounted onto a support, e.g., to elevate, incline, or decline track piece 201. Riser mount 220 could also be included, at any position, on track pieces 202, 203, 204, and 205. Also, to reiterate, riser mount is just one example of a feature that may be added to a track piece.

FIGS. 26A-26E provide top, side, bottom, top perspective, and front views of yet another track piece 230 formed in accordance with the present application. Track piece 230 is substantially similar to track piece 202 in that it has the same overall length (L2) and coupler span length (2X); however, now track piece 230 has side-by-side track pathways 106. Each of the track pathways 106 initiates at a female connector 120 and terminates at a male connector 150. Each of the track pathways 106 may also be marked separately with one or more indica 207.

The track pathway 106 also share a central wall 232 so that each of the track pathways 106 is bounded by opposing walls; however, the central wall 232 is thicker than walls included on one-lane straight track pieces (e.g., track pieces 201, 202, 203, 204, and 205). Thus, a lateral coupler span Y between the two male connectors 150 and the two female connectors 120 of track piece 230 is sufficient to allow two one-lane straight track pieces to separately and independently connect to the two male connectors 150 and/or the two female connectors 120 on track piece 230. That is, the lateral coupler span Y allows two single-lane track pieces to attach to one end of track piece 230. This results in track piece 230 having an overall width 2W that is double the width W of track pieces 201, 202, 203, 204, and 205.

Flexible Track

Now turning to FIGS. 27A-C, 28, 29A-B, and 30A-E, these figures depict two embodiments of yet another track piece 270, 270' that may be formed in accordance with the techniques presented herein. That is, FIGS. 27A-C, 28, 29A-B, and 30A-E depict another track piece that can include or incorporate female connector 120 and male connector 150. More specifically, flexible track piece 270, 270' can include an integrally formed female connector 120 and an integrally formed male connector 150 and can still be flexible so that it may be usable to form inclines, declines, loops, twists, and other stunts, turns, etc. Notably, while track pieces 204 and 205 can provide flexibility, track pieces 204 and 205 are formed by coupling connectors 120 and 150 to a track pathway 206 formed separately from connectors 120 and 150. Since track pieces 270, 270' are formed integrally with a female connector 120 and a male connector 150, the entire track piece 270, 270' can be formed in a single manufacturing operation. In fact, flexible track pieces 270, 270' can be formed via molding or injection processes that typically produce stiff, inflexible pieces, and can leverage the costs advantages of these techniques. Also, track pieces 270, 270' may also be marked with one or more indica 207 during its formation or thereafter.

First referring to FIGS. 27A-27C and 28, track piece 270 is able to achieve the foregoing advantages because of its structure. Specifically, while flexible track piece 270 includes a track pathway 271 that is similar to track pathways 106 and 206 (and, in fact, track pathway 271 can have identical dimensions to track pathway 106 and/or track pathway 206), the track pathway 271 includes gaps 275 formed in opposing sidewalls 274, 276. Gaps 275 allow sidewalls 274, 276 to bend or flex which, in turn, allows the bottom 272 of track pathway 271 to be flexible and provide inclines, declines, ramps, loops, etc. More specifically, flexible track piece 270 includes gaps 275 spaced intermittently along its opposing sidewalls 274, 276 and each gap 275 is exteriorly surrounded by a flexibility element 280.

The flexibility elements 280 each include a base 282 that extends beneath the bottom 272 of the flexible track piece 270 and side extensions 284, 286 that extend exteriorly of the opposing sidewalls 274, 276 of flexible track piece 270. In the depicted embodiment, the gaps 275 extend generally vertically in sidewalls 274, 276 and, thus, side extensions 284, 286 extend generally perpendicular to a length of flexible track piece 270. Additionally, in the depicted embodiment, the bases 282 each extend perpendicularly to a length of the flexible track piece 270 so that the side extensions 284, 286 extend generally perpendicular to the base 282. Other embodiments need not extend in the same manner.

Figure 27A:
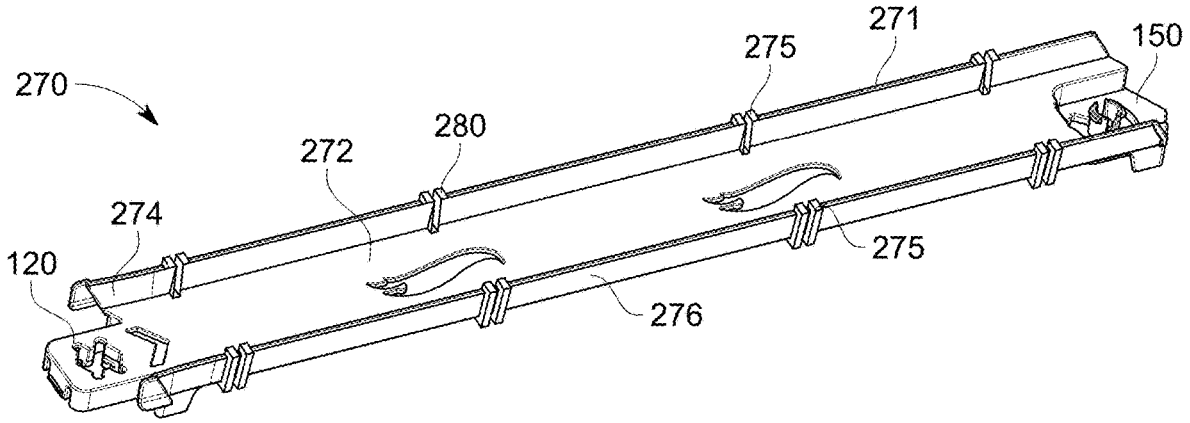
FIG. 27A is a top perspective view of a flexible track piece formed in accordance with an example embodiment of the present application.
Figure 27B:
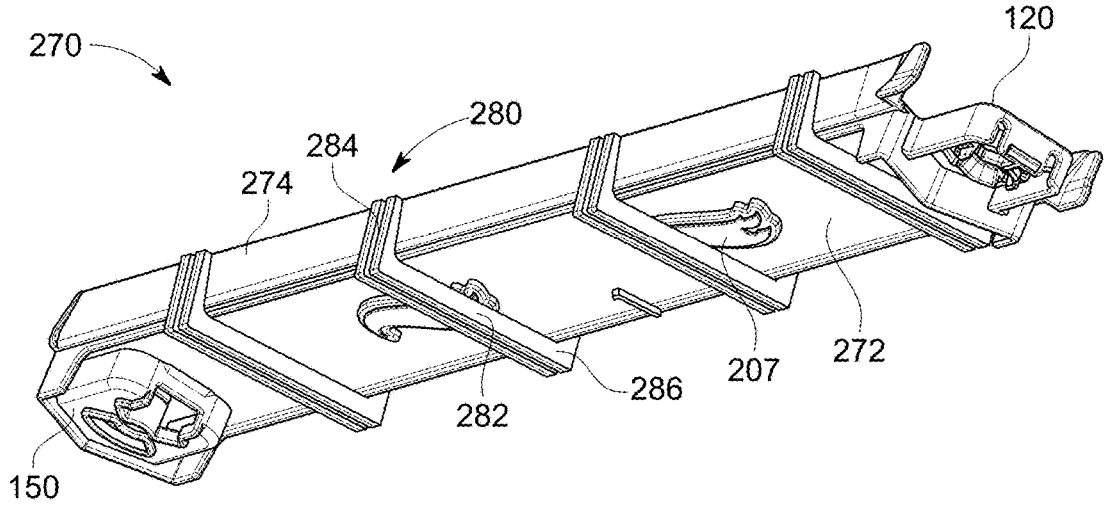
FIG. 27B is a bottom view of the flexible track piece of FIG. 27A.
Figure 27C:
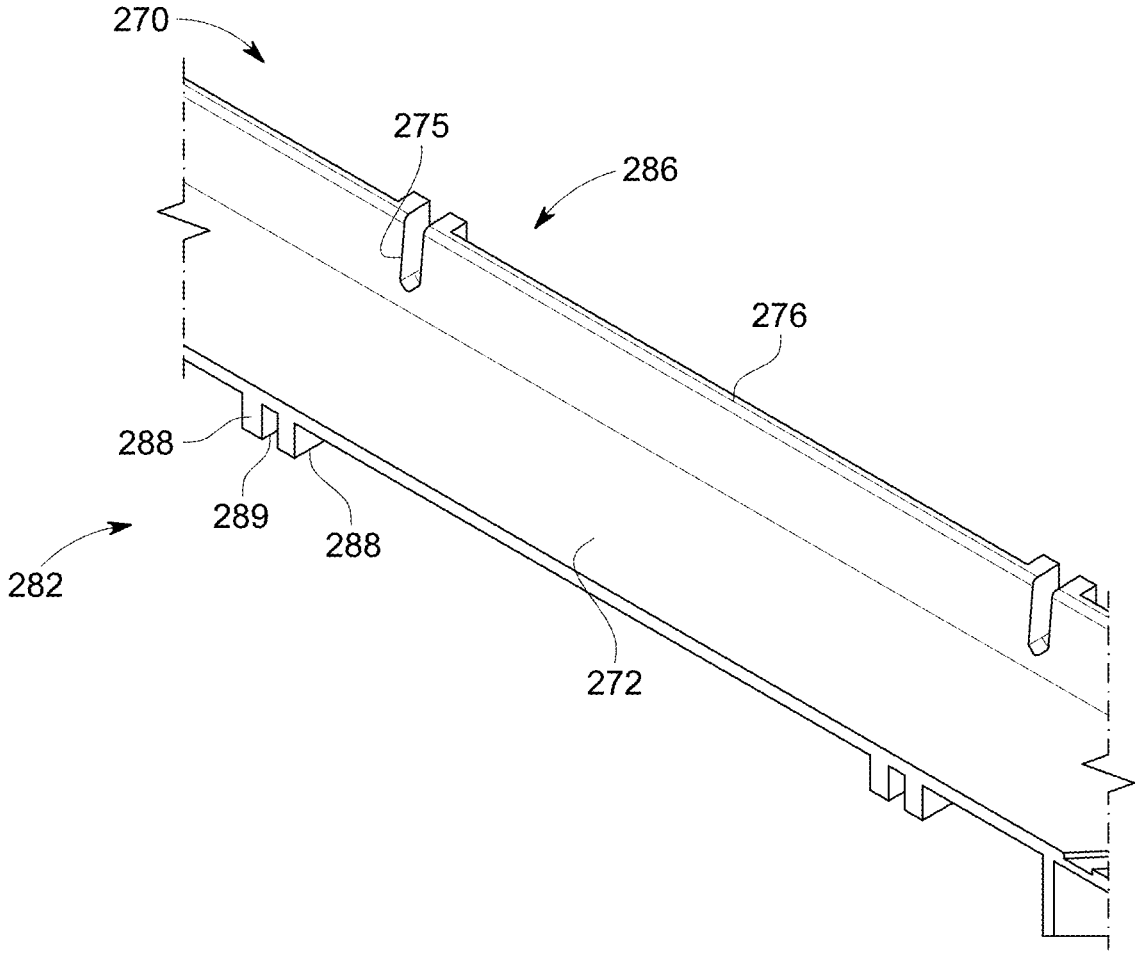
FIG. 27C is a sectional view of the flexible track piece of FIG. 27A.

Moreover, as can be seen in the sectional view of FIG. 27C, the flexibility element 280 includes two protrusions 288 that laterally border the gaps 275 on the sidewalls 274, 276. While the gaps 275 do not extend into the bottom 272 of the flexible track piece 270, the flexibility element 280 includes a channel 289 in its base 282 so that the two protrusions 288 are separated along a length of each flexibility element 280. However, in other embodiments, the flexibility elements 280 need not include channel 289 (e.g., the flexibility element 280 could be solid beneath the bottom 272 of the flexible track piece 270).

Figure 28:
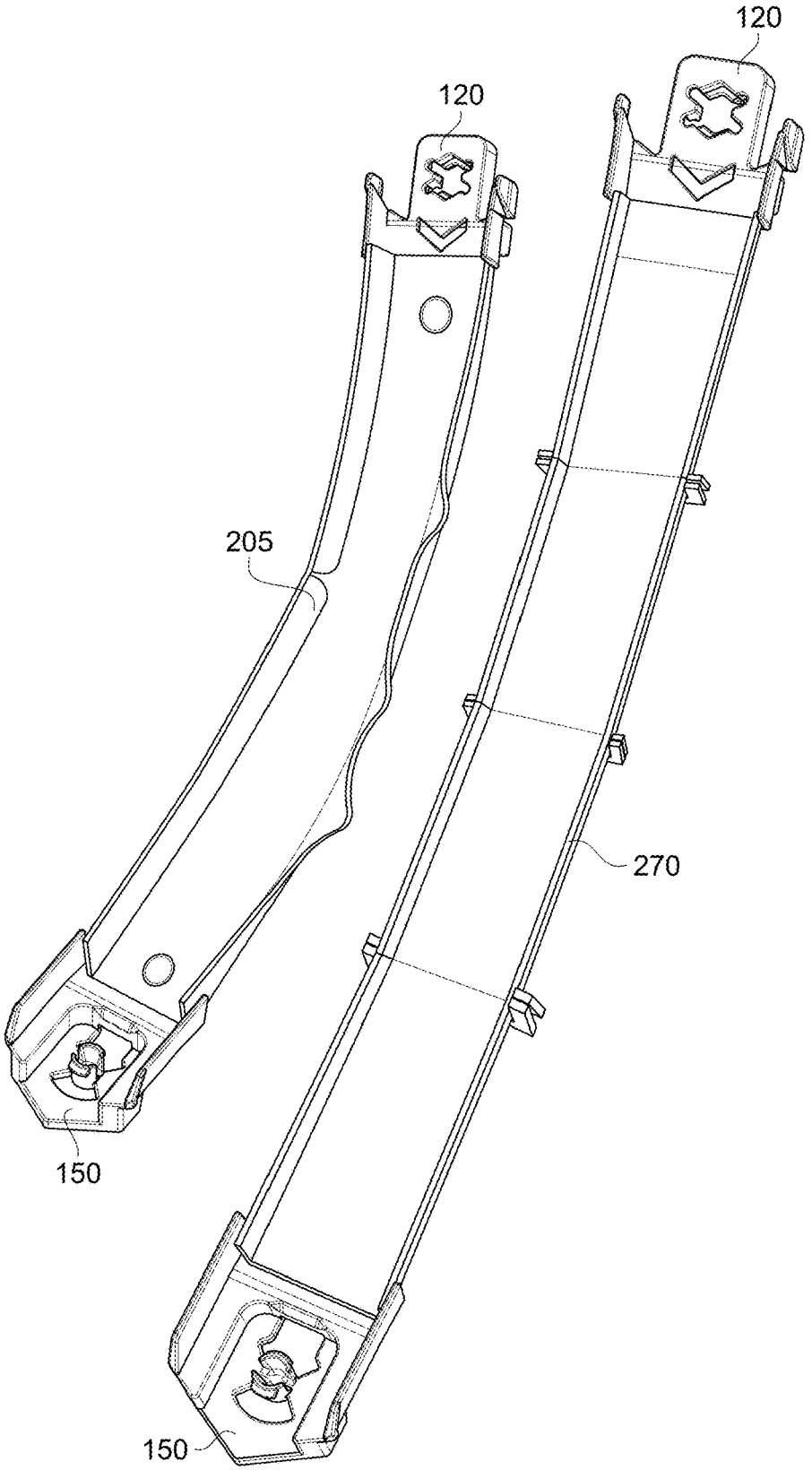
FIG. 28 is a perspective view of the flexible track of FIG. 27A being compared to a track piece included in the set of track pieces of FIG. 20.
Figure 29A:
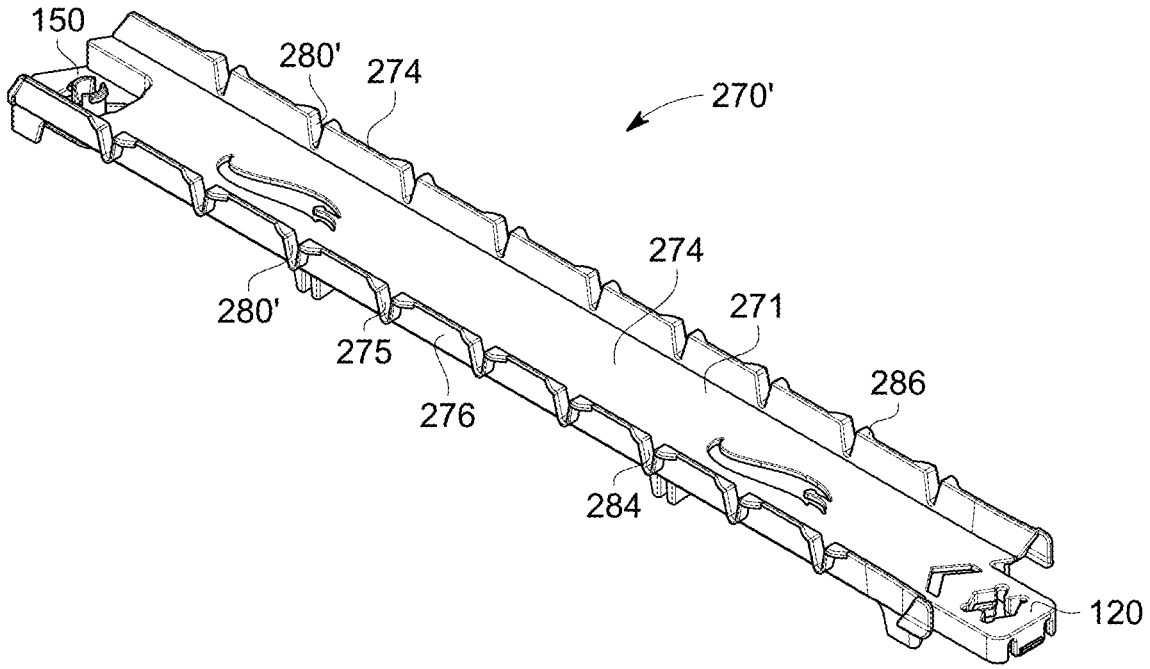
FIG. 29A is a top perspective view of a flexible track piece formed in accordance with an example embodiment of the present application.
Figure 29B:
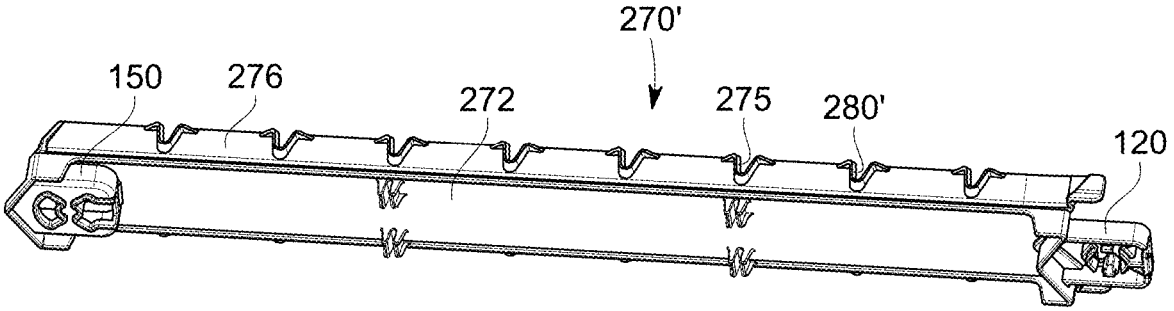
FIG. 29B is a bottom perspective view of the flexible track piece of FIG. 29A.

Regardless of the specific shape, structure, etc. of the flexibility elements 280, gaps 275 surrounded by flexibility elements 280 allow the sidewalls 274, 276 to flex while retaining their shape and stability. Put another way, the flexibility elements 280 and gaps 275 cooperate to create flex points that are, or are similar to, living hinges in the flexible track piece 270. Thus, as can be seen in FIG. 28, the flexible track piece 270 can be bent to provide an incline and/or a decline (or other similar features) without destroying the structural integrity of the track.

By comparison, when track piece 205 is flexed or bent, the sidewalls may tend to deform. This may be detrimental because it may wear the walls, potentially to failure, and cause the track to look worn or unusable. In fact, if the sidewalls are bent or deformed, the track may truly be unusable. Inwardly bent sidewalls may contact a vehicle, slowing or preventing movement while outwardly bent walls may be unable to retain a toy vehicle on the track, creating frustration for a user. This may be especially frustrating on a flexible track, since flexible tracks are often used to create stunts or interesting track sections where a child will be particularly interested in seeing their toy vehicle remain on the track.

In the depicted embodiment, the flexible track piece 270 includes four flexibility elements 280 spaced evenly along a length of the flexible track piece 270 (e.g., spaced evenly along a coupler span length of flexible track piece 270). However, other embodiments of flexibility element 280 may have different overall lengths and/or include different numbers of flexibility element 280. For example, in some embodiments, a flexible track piece 270 may include one flexibility element 280 per incremental unit of coupler span length (e.g., one flexibility element 280 per length "X"). Alternatively, different embodiments may include different numbers of flexibility element 280, even for the same coupler span length, e.g., to provide different degrees of flexibility and/or to balance stress/strain. To be clear, the depicted embodiment should not be construed to be limiting in any manner; other embodiments may include any arrangement of flexibility elements 280 to create flexibility in a track piece that is integrally formed with connectors, e.g., via molding or injection techniques.

Now turning to FIGS. 29A, 29B, and 30A-30E, track 270' is another flexible track embodiment that is able to achieve and/or realize the flexibility and manufacturing advantages discussed above. The flexible track piece 270' is substantially similar to track piece 270 and, thus, any description of parts or features flexible track piece 270 provided above should be understood to apply to flexible track piece 270'. For example, flexible track piece 270' includes a track pathway 271 that includes gaps 275 formed in opposing sidewalls 274, 276 and, again, gaps 275 allow sidewalls 274, 276 to bend or flex which, in turn, allows the bottom 272 of track pathway 271 to be flexible and provide inclines, declines, ramps, loops, etc. However, flexible track piece 270' includes more gaps 275 than flexible track piece 270 and each gap 275 is exteriorly surrounded by a flexibility element 280' that differs from the flexibility elements 280 of flexible track piece 270.

More specifically, in the flexible track piece 270', the flexibility elements 280' extend around the gaps 275 along an exterior of sidewalls 274, 276, but the flexibility elements 280' do not extend beneath the bottom 272 of the flexible track piece 270'. That is, flexibility element 280' do not include a base 282. In fact, in the depicted embodiment of flexible track piece 270', the gaps 275 are substantially V-shaped and the flexibility element 280' comprise side extensions 284, 286 that generally match this V-shape and flare outwards towards a top of sidewalls 274, 276. However, other embodiments may include side extensions of different shapes and/or sizes (e.g., other shapes that still do not extend past a bottom 272 of the flexible track piece 270'. As mentioned above, regardless of the specific shape, structure, etc. of the flexibility elements 280', gaps 275 surrounded by flexibility elements 280' allow the sidewalls 274, 276 to flex while retaining their shape and stability. Thus, the flexible track piece 270 can be bent to provide an incline and/or a decline (or other similar features) without destroying the structural integrity of the track.

In the depicted embodiment, the flexible track piece 270' includes nine pairs of gaps 275 and nine corresponding pairs of flexibility elements 280' spaced intermittently along a length of the flexible track piece 270' (e.g., spaced evenly along a coupler span length of flexible track piece 270'). Testing has revealed that nine pairs of gaps 275 and flexibility elements 280' provides a desirable amount of flexibility without substantially reducing the sturdiness/lifespan of the track piece.

However, critically, the pairs of gaps 275 and flexibility elements 280' are not evenly spaced along the coupler span length of flexible track piece 270'. Instead, moving from the female connector 120 to the male connector 150, the first five pairs of gaps 275 and flexibility elements 280' are tightly grouped and the latter four pairs of gaps 275 and flexibility elements 280' are spaced further apart from each other. This spacing has been found to improve the overall flexibility of the flexible track piece 270', e.g., since the female connector 120 is often coupled to another track piece first and the tighter pairs of gaps 275 and flexibility elements 280' can provide more flexibility closest to a male-female coupling while male connector 150 is flexed/moved into place. That all said, to reiterate, the depicted embodiment should not be construed to be limiting in any manner; other embodiments may include any arrangement of flexibility elements 280' to create flexibility in a track piece that is integrally formed with connectors, e.g., via molding or injection techniques.

Regardless of the specific implementation used for a flexible track (e.g., flexible track piece 270, flexible track piece 270', or variations or combinations thereof), the specific material used to manufacture a flexible track piece may also be important. Different plastics have different degrees of flexibility and, thus, may require different arrangements of gaps 275 and/or flexibility elements 280, 280'. Moreover, some materials may show stress marks after bending, which is undesirable (e.g., for aesthetics and for preventing users from thinking the track is broken or malfunctioning). In some instances, blends of polypropylene (PP) polyethylene (PE) or other thermoplastic polymers, and/or any other desirable rubber formulation, plastic formulation, etc. may be used to form the flexible tracks presented herein. Polyethylene blends have been found to be particularly effective at providing flexibility without showing stress marks.

Generally, with a flexible track piece 270 or 270" like those shown in 27A-C, 28, 29A-B, and 30A-E, the increased flexibility of the track (e.g., resulting from the material formulation and/or the gaps 275) may decrease the strength of the connections provided by female connector 120 and/or male connector 150. Thus, in some instances, the female connector 120 and/or the male connector 150 included on a flexible track piece 270, 270' may be reinforced as compared to the female connector 120 and/or the male connector 150 included on a non-flexible piece (e.g., track pieces 100, 201, 202, 203, etc.). As an example, in FIGS. 29A and 29B, female connector 120 may include an extra support 139 (see FIG. 30E) extending between a forward/distal stepped surface 138A and the central flange 128. Meanwhile, the barbed extensions of the male connector 150 (e.g., the extensions 162 and barbed cap 164 of protrusion 160) may be stiffened as compared to other iterations, for example by reducing the depth of the gap separating the extensions and/or increasing the thickness of the extensions. These features stiffen and strengthen features of the female connector 120 and/or the male connector 150 that form a snap fit connection, and thus, make the snap fit connection more robust.

Figure 30A:
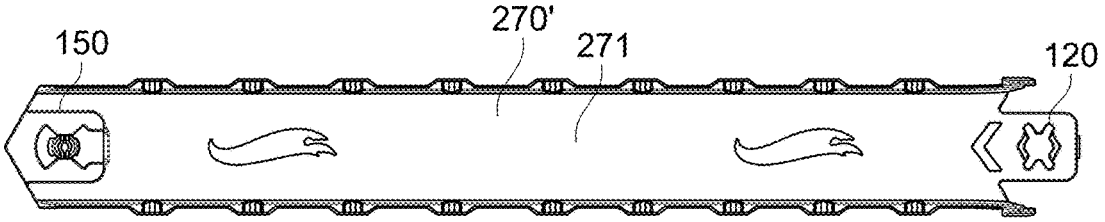
FIGS. 30A-30E illustrate a top view, a front view, a rear view, a side view, and a bottom view of the flexible track piece of FIG. 29A.
Figure 30B:
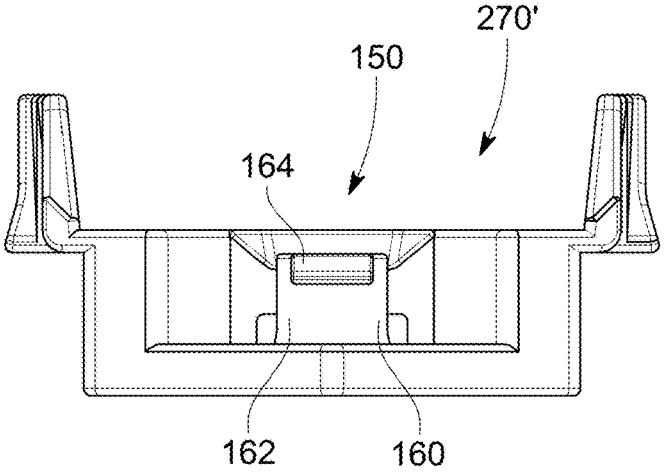
Figure 30C:
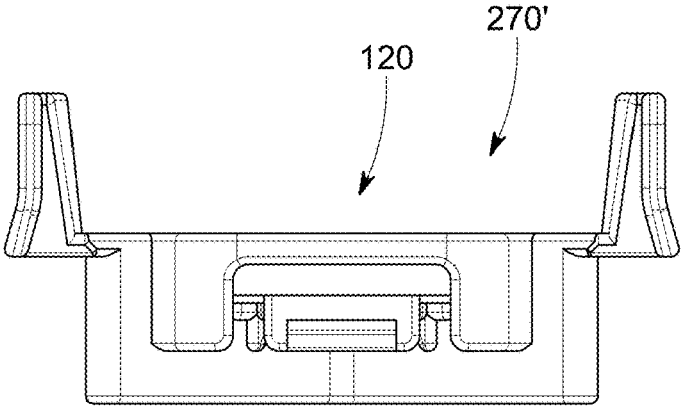
Figure 30D:
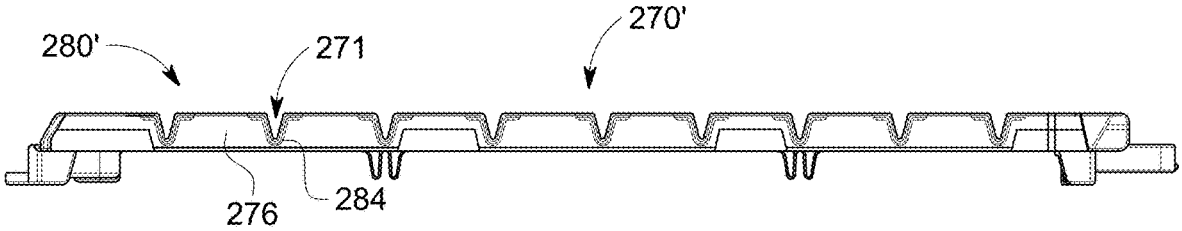
Figure 30E:
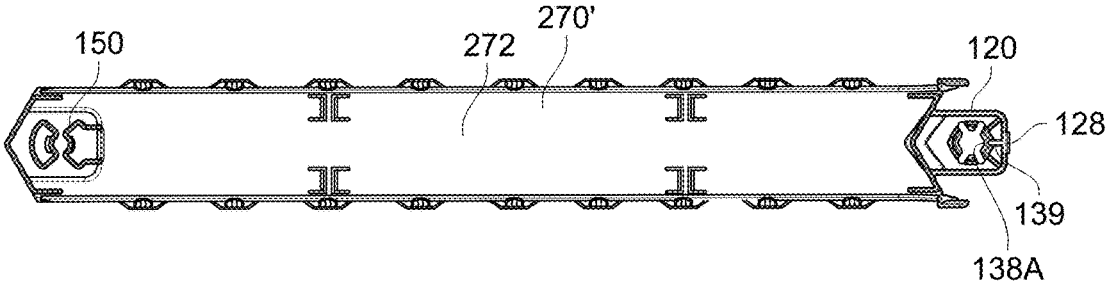
Figure 30F:
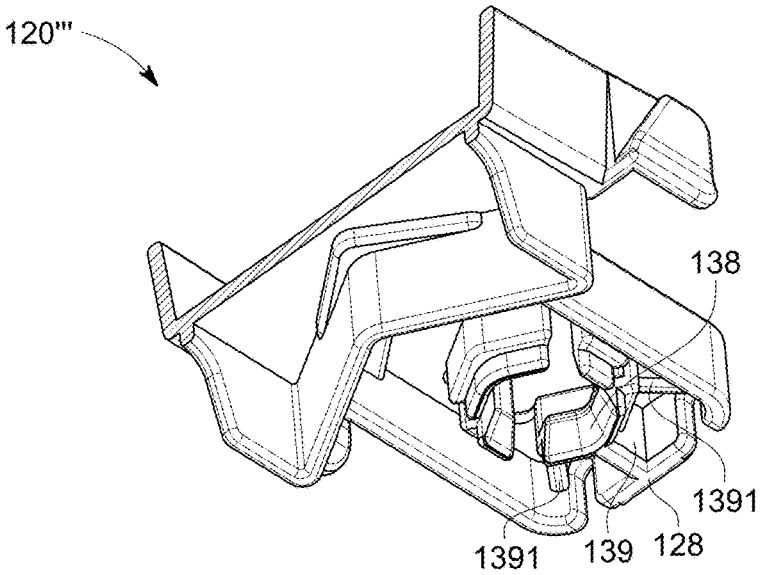
FIG. 30F illustrates a bottom perspective view of yet another embodiment of a female connector that may be included on the track pieces presented herein.

As another example of a stiffened connector, FIG. 30F depicts yet another variation of a female connector 120'" that includes extra support 139 and also includes cross-braces 1391. Cross-braces 1391 extend generally diagonally from stepped surface 138 to the proximal end 124 of the main body 122 of the female connector 120, connecting to the proximal end 124 laterally exterior of the central flange 128 (while the extra support 139 connects directly to central flange 128). Overall, extra support 139 and cross-braces 1391 may stiffen the female connector 120'" primarily by stiffening the stepped surface 138. A stiffer stepped surface 138 may resist movement in responsive to flexing its track piece and, thus, may prevent or discourage the female connector 120 from unwantedly decoupling from a male connector 150 during play and/or track building. This may be particularly important for a flexible track, like flexible track piece 270, which experiences more movement than other track pieces, both during play and track building.

Curved Track Pieces

FIGS. 31-41 depict curved track pieces that may be formed in accordance with the techniques presented herein. That is, FIGS. 31-41 depict additional track pieces that can include or incorporate female connector 120 and/or male connector 150.

Figure 31:
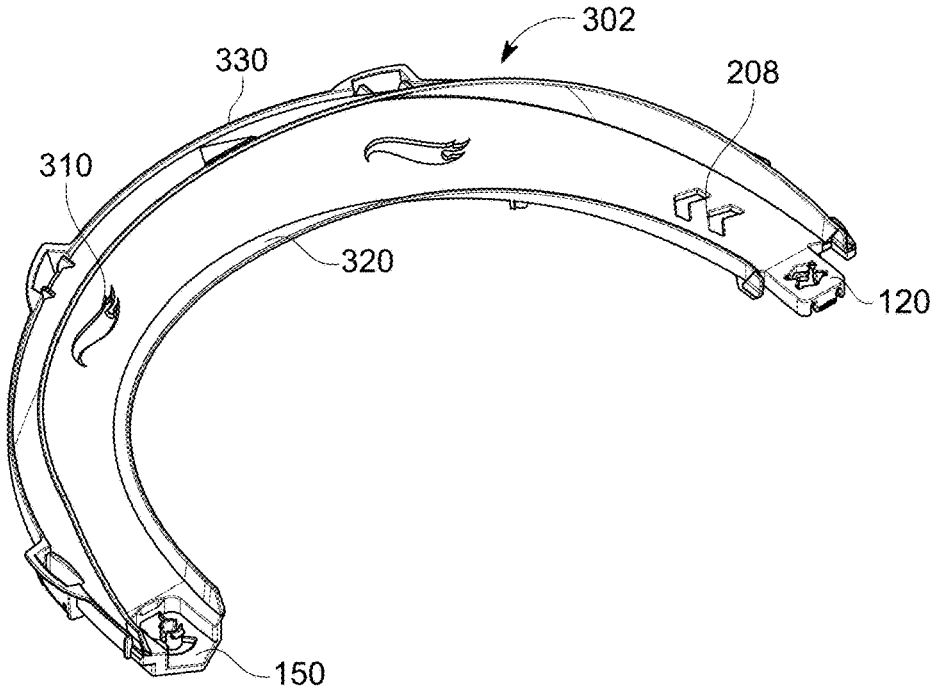
FIGS. 31-36 provide top perspective views of curved track pieces formed in accordance with example embodiments of the present application.
Figure 32:
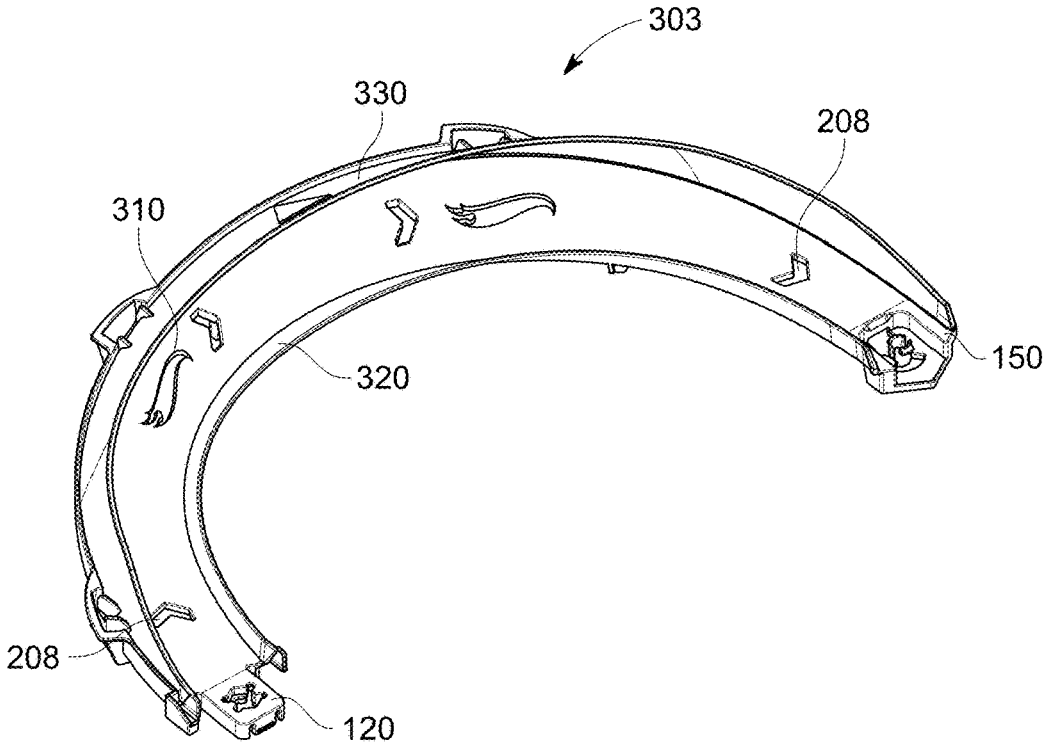
Figure 33:
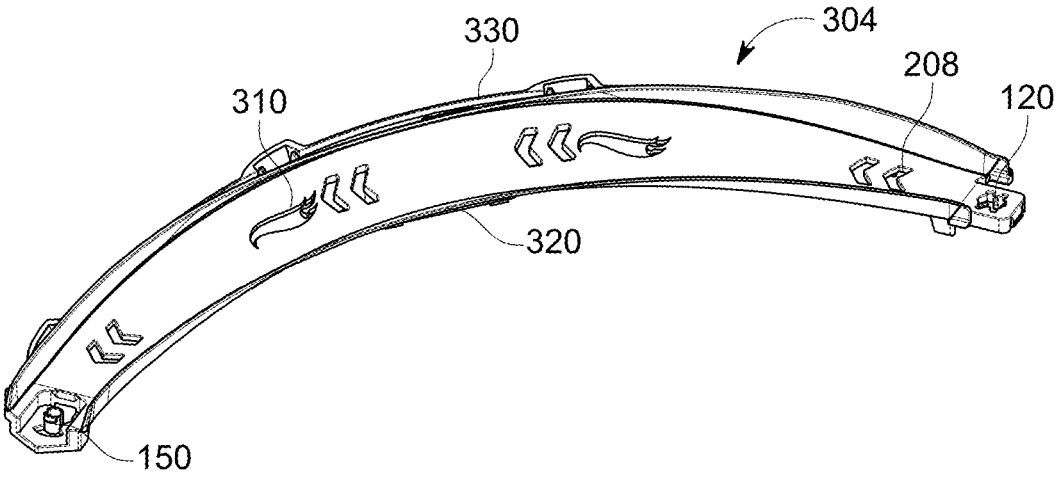
Figure 34:
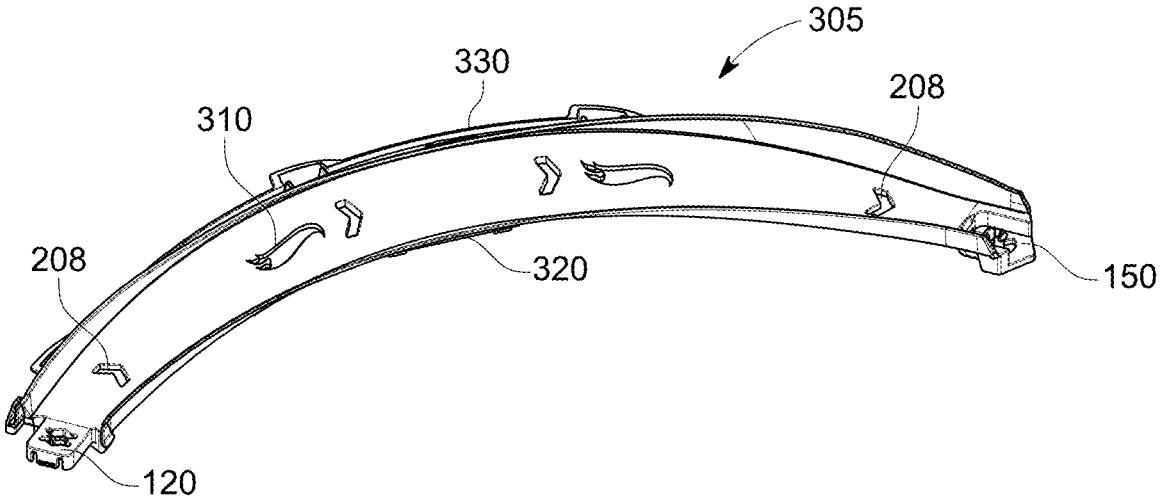
Figure 35:
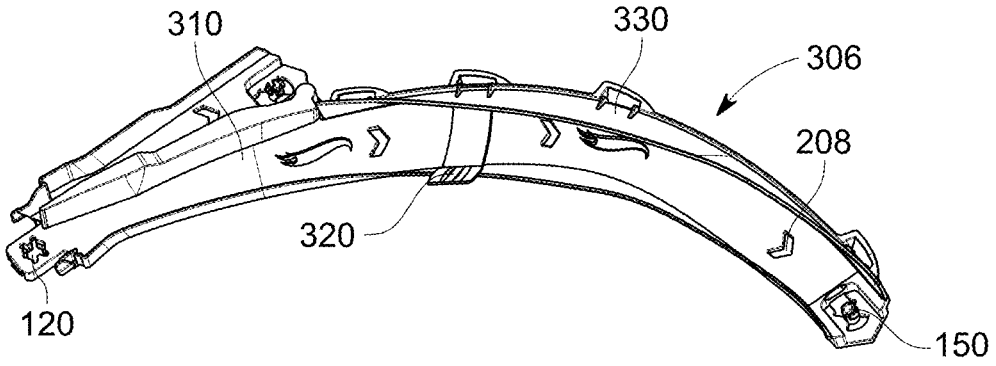
Figure 36:
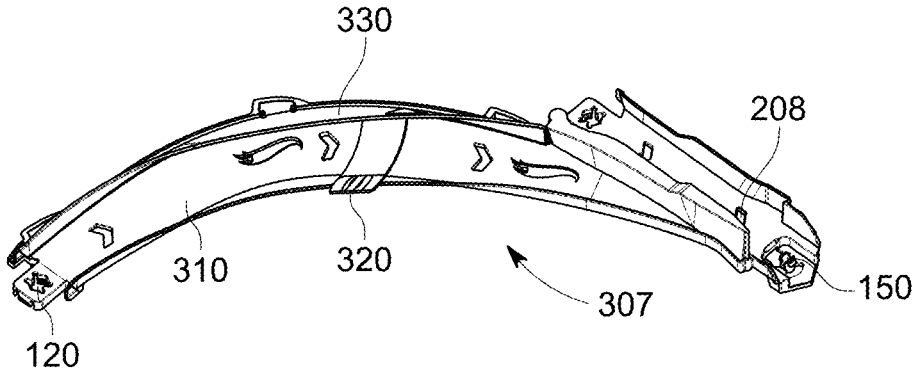

More specifically, FIG. 31 depicts a first curved track piece 302 that provides a counter-clockwise, 180 degree turn extending from a female connector 120 to a male connector 150. FIG. 32 depicts a second curved track piece 303 that provides a clockwise, 180 degree turn extending from a female connector 120 to a male connector 150. FIGS. 33 and 34 illustrate a third curved piece 304 and a fourth curved track piece 305 that provide left and right, 90 degree turns, extending from a female connector 120 to a male connector 150, respectively. FIGS. 35 and 36 illustrate a fifth curved piece 306 and a sixth curved track piece 307 that provide right, 90 degree turns, extending from a female connector 120 to a male connector 150 with a bisected and gated exit and entrance, respectively.

Each of the curved track pieces may include directional indicia 208 representative of a turn direction for which the curved track is intended. In some instances a first type or version of directional indicia 208 may indicate a left turn while a second type or version of direction indicia 208 indicates a right turn. For example, two adjacent or successive chevrons may indicate that a track piece is or includes a left turn while a single chevron may indicate that a track piece is or includes a right turn. Alternatively, a single chevron arrow pointing in a particular direction may be used across various track pieces, as is depicted in FIGS. 31-36. Directional indica 208 may be used instead of or in combination with the indicia 207 (i.e., coupler length indicia) discussed above and may again be advantageous because it may allow younger children to easily connect various track pieces in a proper direction.

To be clear, directional indicia 208 need not only be used on curved track pieces and may be incorporated into accessories, straight track, or any other type of track formed in accordance with the present application. In fact, in some instances, directional indicia 208 may be included on female connector 120 and/or male connector 150 themselves. Additionally or alternatively, directional indicia 208 may be disposed adjacent female connector 120 and/or male connector 150. In fact, in some instances, directional indicia 208 may compliment a shape of the female connector 120 and/or male connector 150, which may also be indicative of a direction in which track may connect and/or in which a toy vehicle may forwardly drive along the track (e.g., from connector 120 to connector 150).

Figure 37:
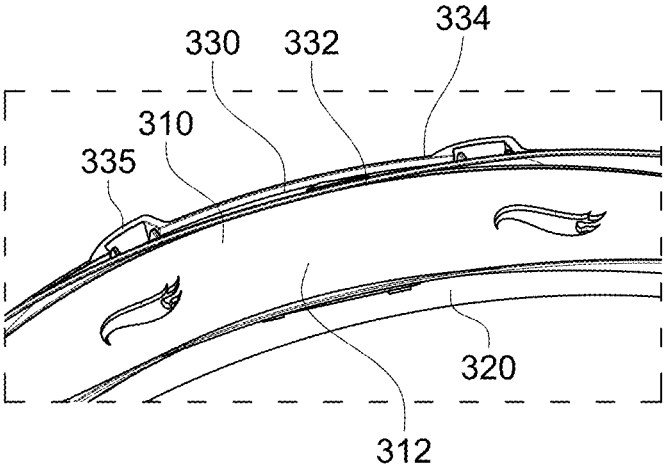
FIGS. 37-39 illustrate detail views of a curve apex included in the curved track pieces of FIGS. 33-36, taken from a top perspective, a side perspective, and a back perspective, respectively.
Figure 38:
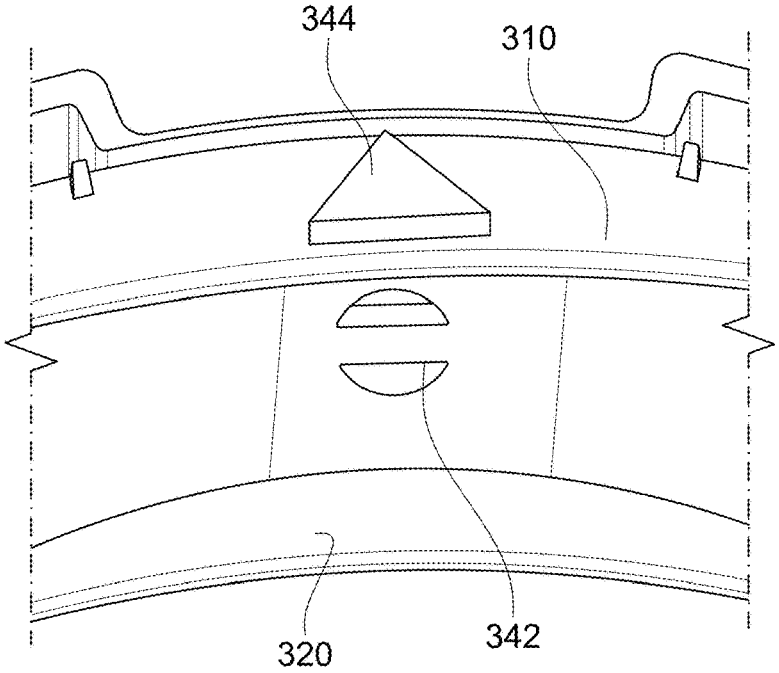
Figure 39:
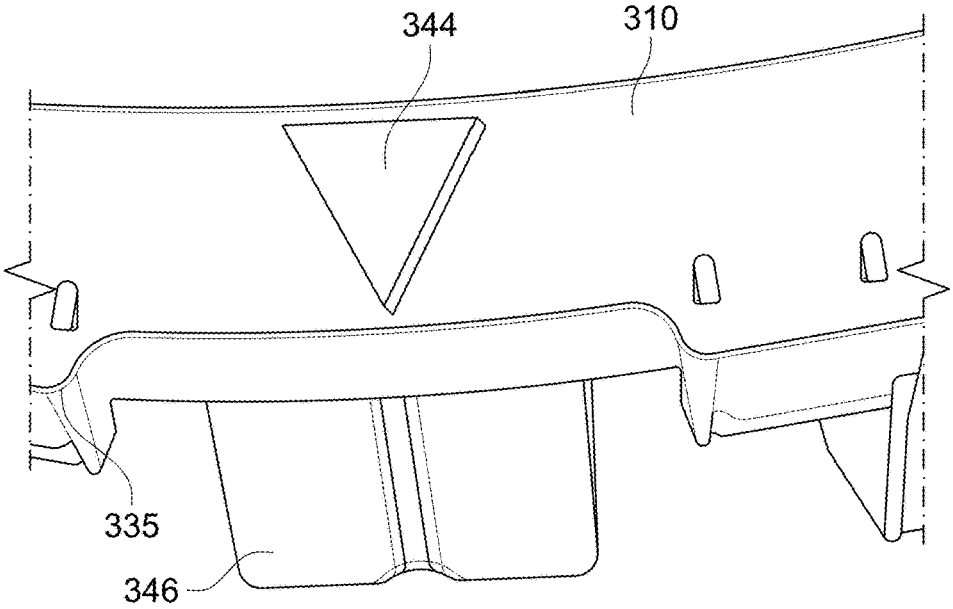

Now turning to FIG. 37, but with continued reference to FIGS. 31-36, across curved track pieces 302-307, a track pathway 310 is formed by a banked bottom 312 bounded by an extended exterior sidewall assembly 330 and an extended interior sidewall assembly 320. At a high-level, the extended exterior sidewall assembly 330 and the extended interior sidewall assembly 320 are designed to retain toy vehicles on the curved track pieces without preventing toy vehicles from traversing the track pathway 310. That is, the extended interior sidewall assembly 320 and extended exterior sidewall assembly 330 are generally designed to retain a wide variety of toy vehicles (e.g., different shapes, sizes, replicas, etc.) without inhibiting the toy vehicles as they traverse the curved track piece. To achieve this, the extended exterior sidewall assembly 330 includes an overhang 332 that increasingly overhangs the track pathway 310 towards the apex of the curved track piece and then recedingly overhangs the track pathway 310 after the apex of the curved track piece.

In some embodiments, the overhang 332 may snap into a base sidewall 334 of the extended exterior sidewall assembly 330. For example, in the depicted embodiment, the base sidewall 334 includes receptacle 335 configured to be fixedly coupled to the overhang 332 (e.g., via a one-time coupling that cannot be removed after coupling). Other embodiments could, however, utilize any desirable coupling. In any case, if the overhang 332 can be coupled to a base sidewall 334, the overhang 332 can be manufactured separately from the remainder of the curved track piece and can be carefully constructed and shaped to meet the aforementioned specifications (i.e., retaining vehicles without inhibiting them). In some embodiments, the extended interior sidewall assembly 320 may include a similar arrangement; however, the depicted embodiments includes an extended interior sidewall assembly 320 formed integrally with a remainder of the track pieces (e.g., formed during a molding or injection process used to manufacture the banked bottom 312, female connector 120, and male connector 150).

Regardless of how the extended interior sidewall assembly 320 is formed, in at least some embodiments, the extended interior sidewall assembly 320 may mirror or substantially conform to the extended exterior sidewall assembly 330 to ensure there is adequate space for toy vehicles between the extended interior sidewall assembly 320 and the extended exterior sidewall assembly 330. Thus, for example, the extended exterior sidewall assembly 330 may decreasingly overhang the track pathway 310 towards the apex of the curved track piece and then increasingly overhang the track pathway 310 after the apex of the curved track piece. In fact, in some instances, the extended interior sidewall assembly 320 can lean or angle away from the track pathway 310 at or near the apex of a curve.

One issue that arises with curved track pieces, especially curved track pieces with banked track pathways 310 and/or overhanging sidewalls like curved track pieces 302-307, is that it may be difficult to align the curved track pieces with support or stanchions. To address this issue, curved track pieces 302-307 include visual indicators in the track pathway 310 and/or on the extended exterior sidewall assembly 330. More specifically, and now turning to FIGS. 38-39, track pieces 302-307 may include a trackway indicator 342 and/or an exterior indicator 344 that indicates where a connector 346 (e.g., for connecting to a stanchion or support) is located. Thus, a user looking downwards at the track piece need not flip over the curved track piece during assembly and can easily set up an inclined banked curved, declined curve, etc. In some embodiments, connector 346 may be the same or be similar to the riser mount 220 discussed above in connection with straight track pieces.

Figure 40:
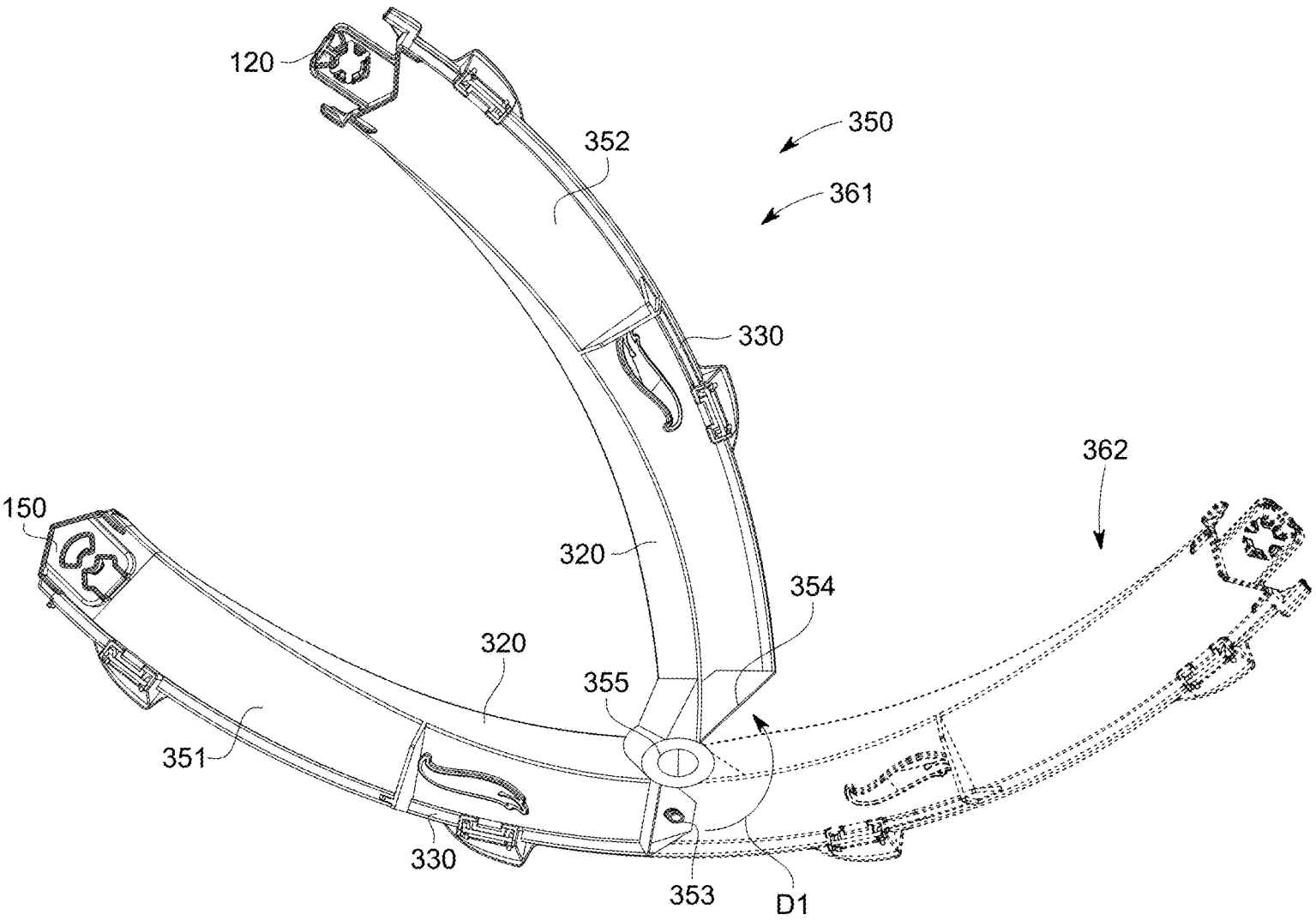
FIG. 40 is a top perspective view of yet another curved track piece formed in accordance with example embodiments of the present application.

FIG. 40 illustrates yet another embodiment of a curved track piece 350 formed in accordance with the techniques presented herein. Curved track piece 350 is a folding curve that includes a first portion 351 pivotally coupled to a second portion 352 via a pivot 355. The first portion 351 extends from a male connector 150 to a tab 353. The second portion 352 extends from a slot 354 to a female connector 120. During shipping or storage, the curved track piece 350 can be folded about the pivot 355 so that the first portion 351 is positioned alongside the second portion 352 in the first configuration 361. Then, during use, the first portion 351 and/or the second portion 352 can pivot about pivot 355 to the use configuration 362. In the use configuration 362, the tab 353 can be installed into the slot 354 to secure the first portion 351 and the second portion 352 in positions that form a continuous pathway.

In some embodiments, the pivot 355 may be a ball joint; however, other embodiments may include any type of pivot or rotational joint now known or developed hereafter. Similarly, other embodiments need not include a tab 353 and slot 354 and could removably couple together in the use configuration 362 via any desirable mechanism, parts, features, etc. Still further, while the curved track piece 350 of FIG. 40 is a 90 degree, right turn, similar concepts, or variations thereof, could also be used with other curved track pieces that turn in different directions or turn over different increments. Conversely, the curved track piece 350 can implement any of the concepts (or variations thereof) discussed above in connection with curved track pieces 302-307 (e.g., extended sidewalls, visual indicators, etc.).

Accessories

Figure 57:
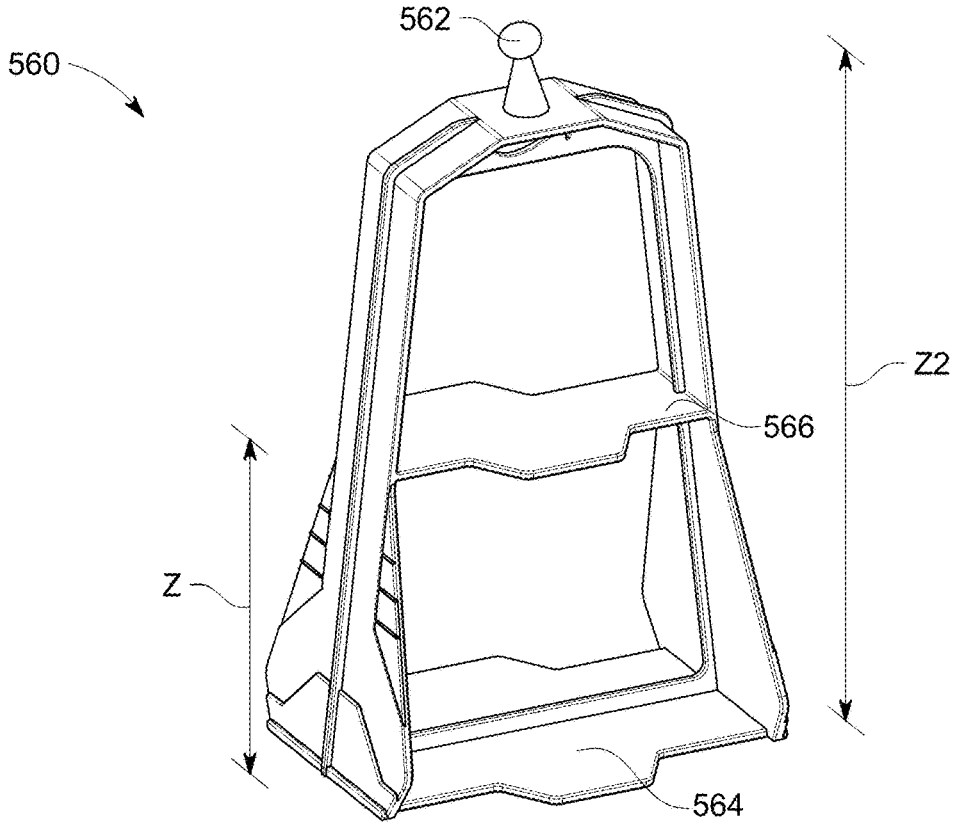
FIGS. 57 and 58 provide top perspective views of accessories that may be used with the track pieces of the present application.
Figure 58:
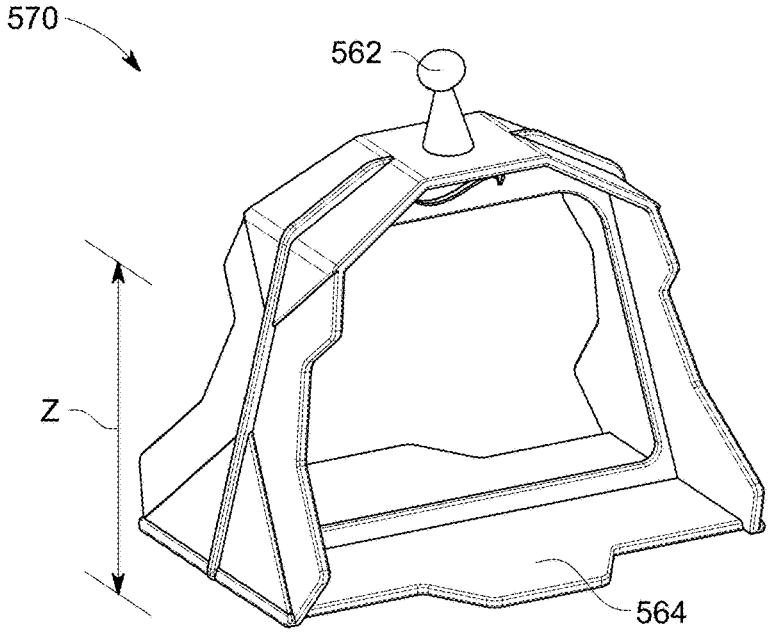

FIGS. 41-58 depict accessory track pieces that may be formed in accordance with the techniques presented herein and/or used with the track pieces presented herein. More specifically, FIGS. 41-56 depict track pieces that can include or incorporate female connector 120 and/or male connector 150 while FIGS. 57 and 58 depict accessories that can be used with the track pieces presented herein.

Figure 41:
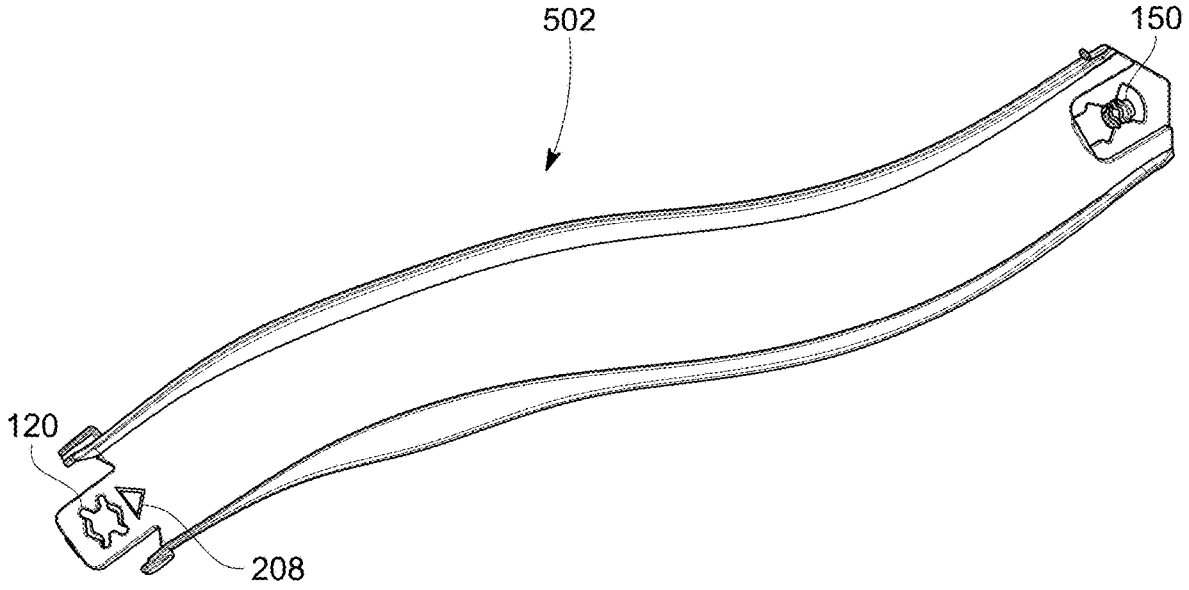
FIGS. 41-55 provide top perspective views of accessory track pieces formed in accordance with example embodiments of the present application.

FIG. 41 illustrates a chicane track piece 502 with a female connector 120 at one end and a male connector 150 at its other end. The chicane track piece 502 may incorporate coverings that are similar to those discussed above in connection with curved tracked pieces, or at least coverings that operate in accordance with similar principles to those discussed above in connection with curved tracked pieces.

Figure 42:
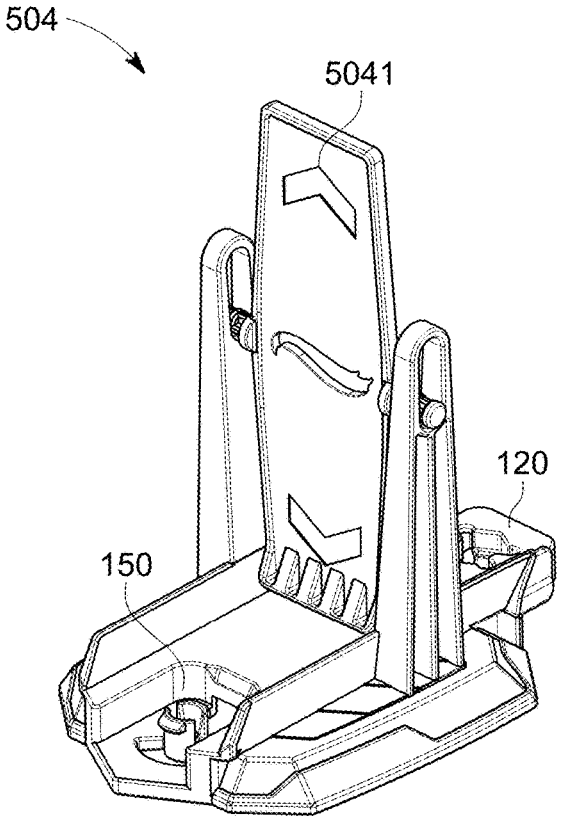

FIG. 42 illustrates a finish line 504 with a spinning flag 5041 that is disposed between a female connector 120 and a male connector 150.

Figure 43:
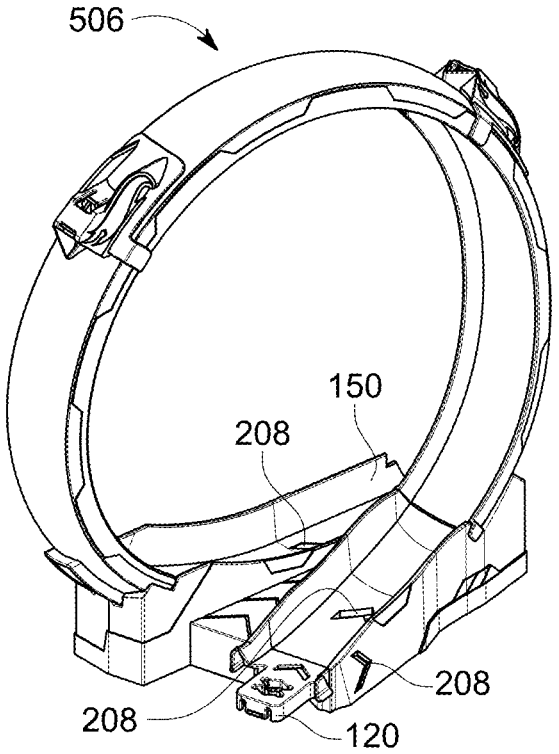

FIG. 43 illustrates a loop 506 that is disposed between a female connector 120 and a male connector 150. The loop 506 may be sized like, or similar to, the loop discussed below in connection with FIG. 59C. Additionally or alternatively, loop 506 may incorporate features of other loops discussed herein.

Figure 44:
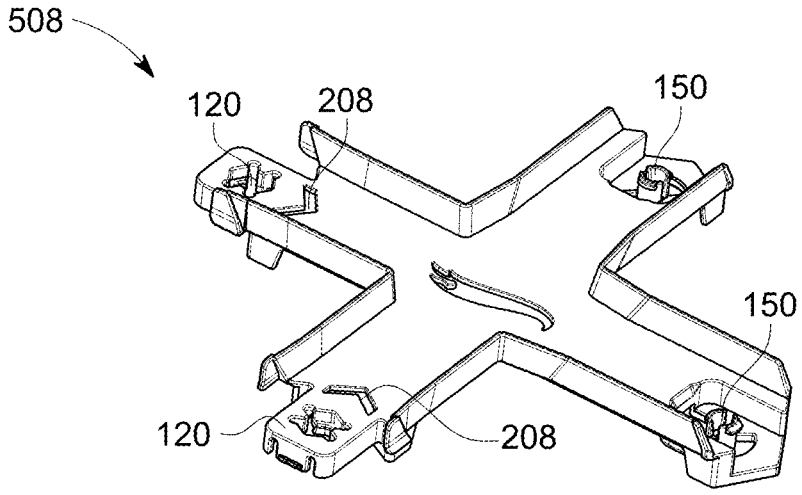

FIG. 44 illustrates an intersection 508 with two intersecting pathways that each extend from a female connector 120 to a male connector 150.

Figure 45:
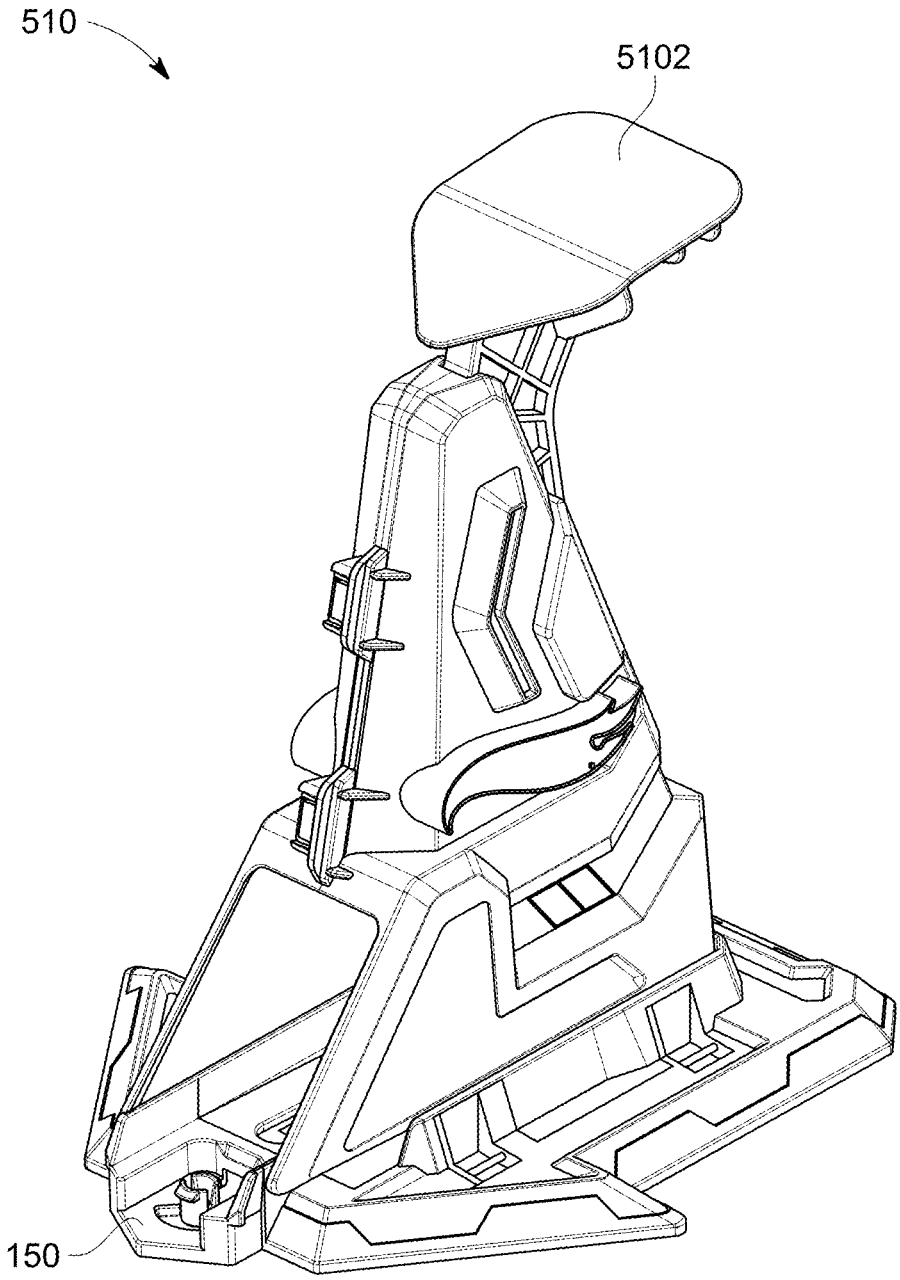

FIG. 45 illustrates a slam launcher 510 with a male connector 150. The slam launcher 510 can propel a toy vehicle away from the male connector 150 when a user imparts a force to handle 5102.

Figure 46:
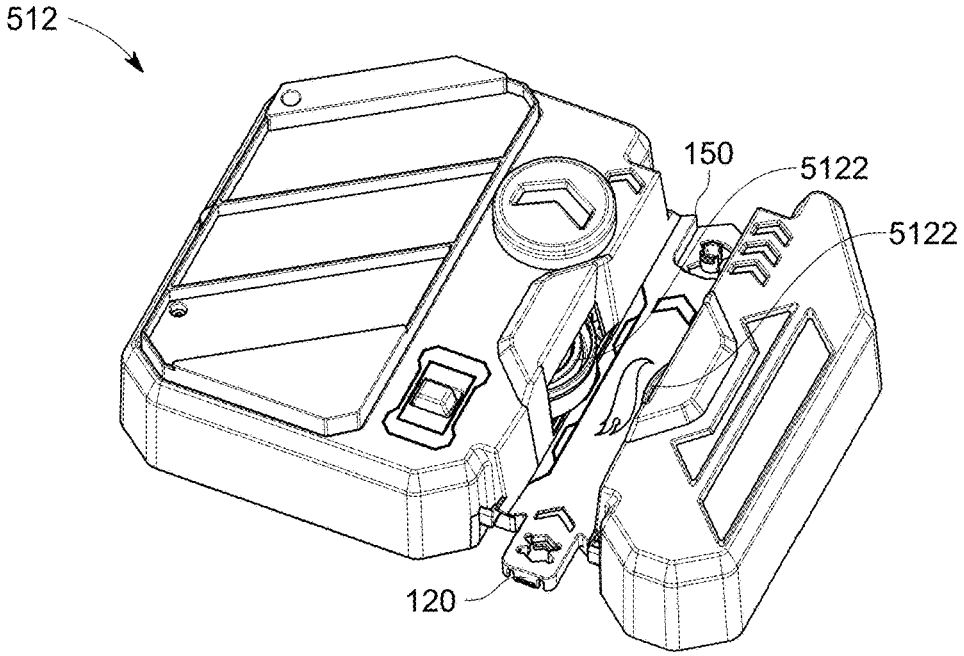

FIG. 46 illustrates a booster 512 with a track path that extends from a female connector 120 to a male connector 150. The booster 510 can propel a toy vehicle away from the male connector 150 or away from the female connector 120 (e.g., forward or reverse) when a toy vehicle contacts the booster wheels 5122 disposed between the female connector 120 and the male connector 150.

Figure 47:
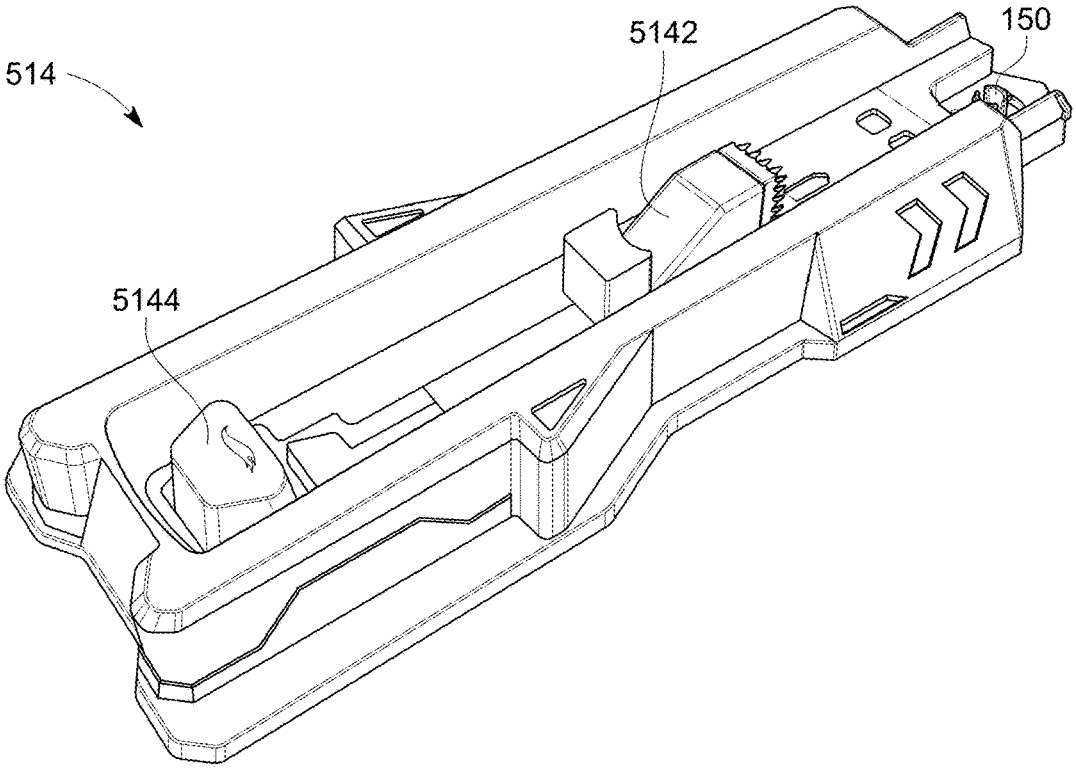

FIG. 47 illustrates a pull-back launcher 514 with a male connector 150. The pull-back launcher 514 can propel a toy vehicle away from the male connector 150 when a user loads the launch arm 5142 and actuates actuator 5144.

Figure 48:
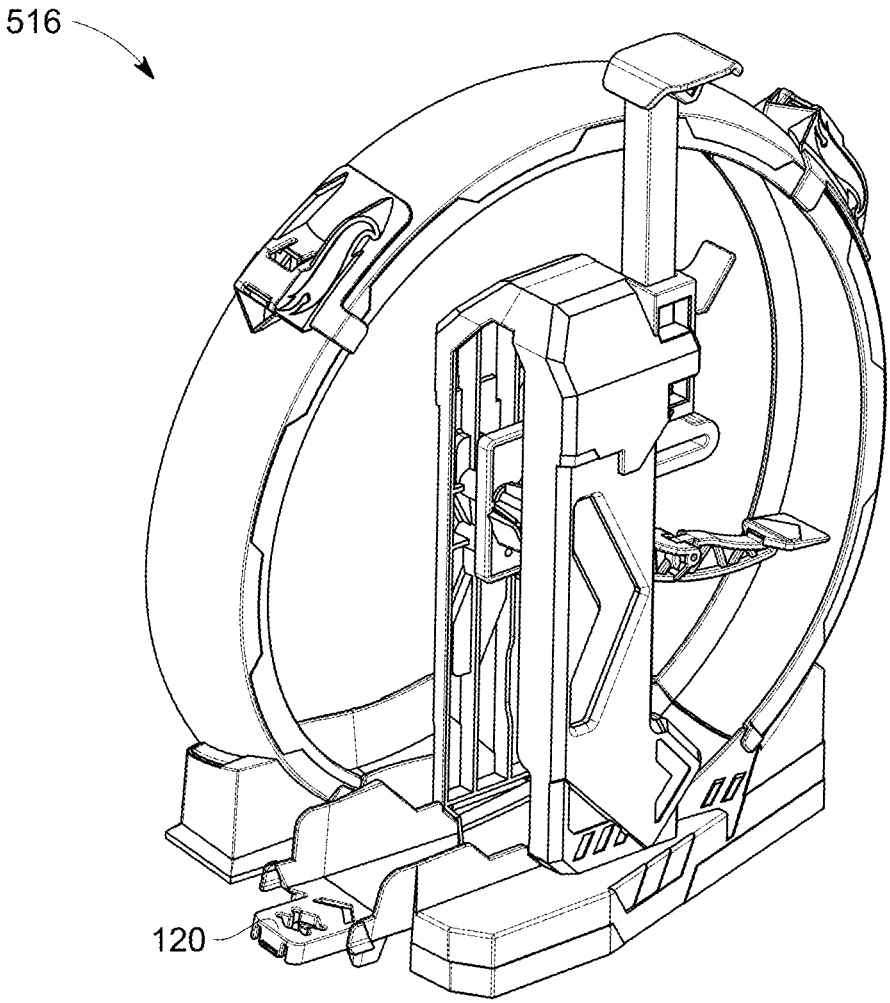

FIG. 48 illustrates a kicker loop 516 that is disposed between a female connector 120 and a male connector 150 (not shown). The kicker loop 516 can propel a toy vehicle through the loop (towards the unshown male connector 150) when in an engaged position and subsequently engaged by a toy vehicle.

Figure 49:
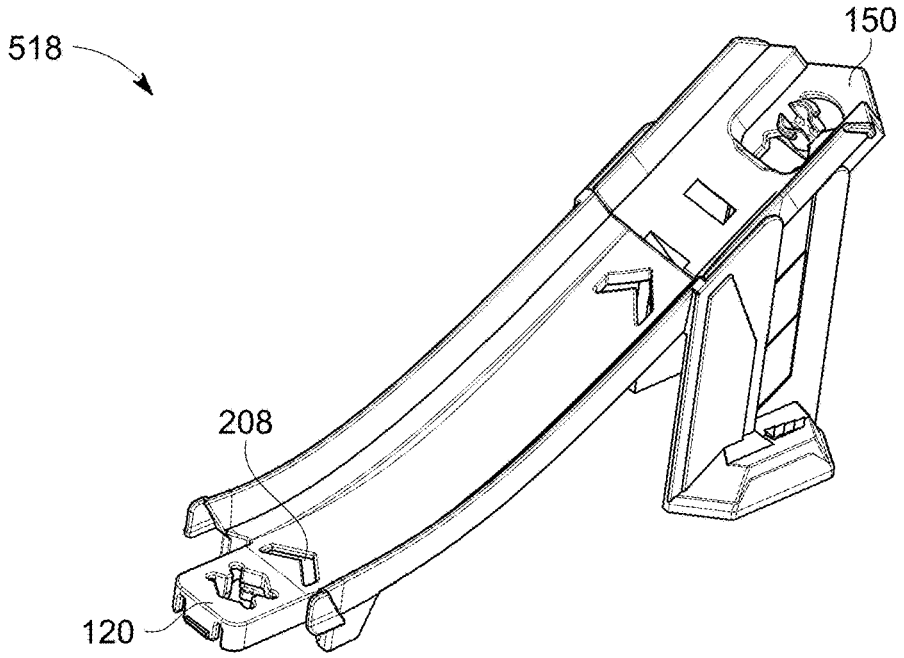
Figure 50:
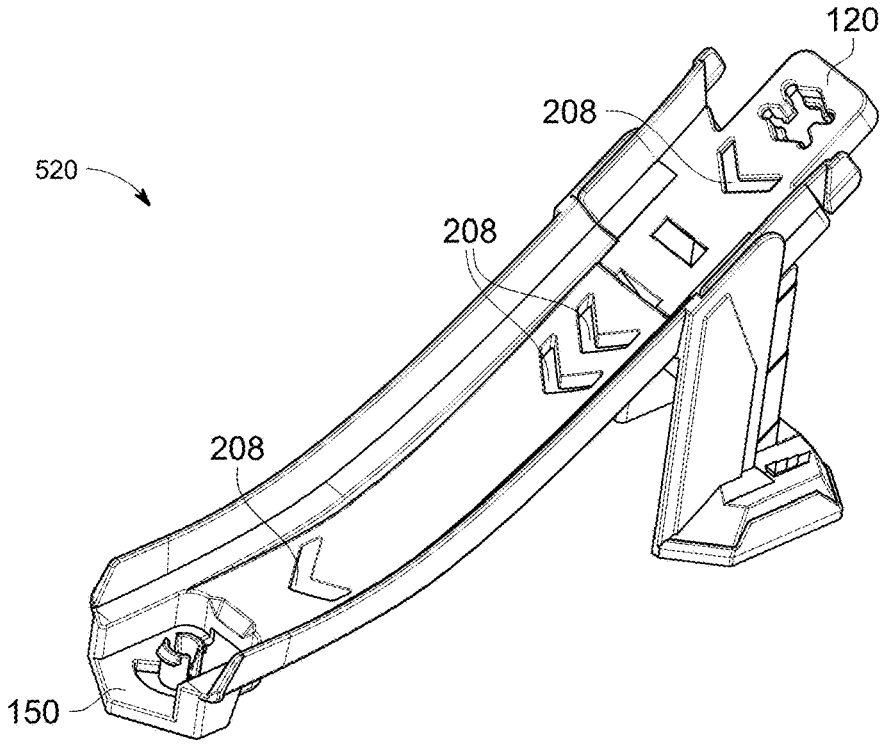

FIGS. 49 and 50 illustrate an incline track 518 and a decline track 520, respectively. The incline track 518 provides a ramp that extends upwards from a female connector 120 to a male connector 150. The decline track 520 provides a ramp that extends downwards from a female connector 120 to a male connector 150.

Figure 51:
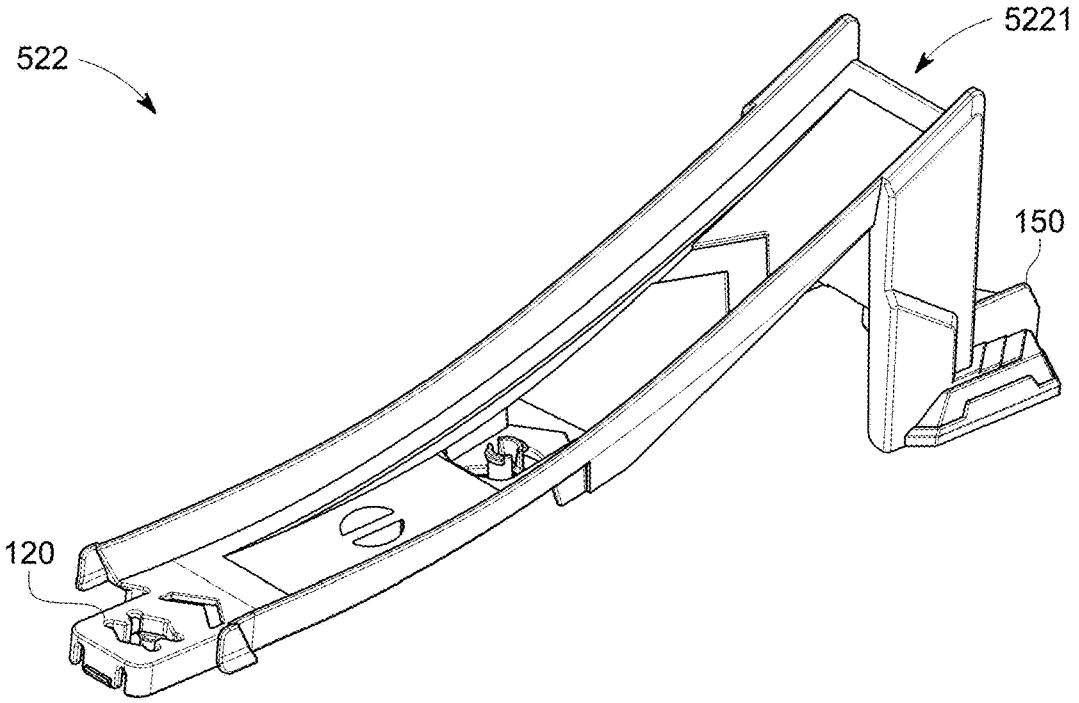
Figure 52:
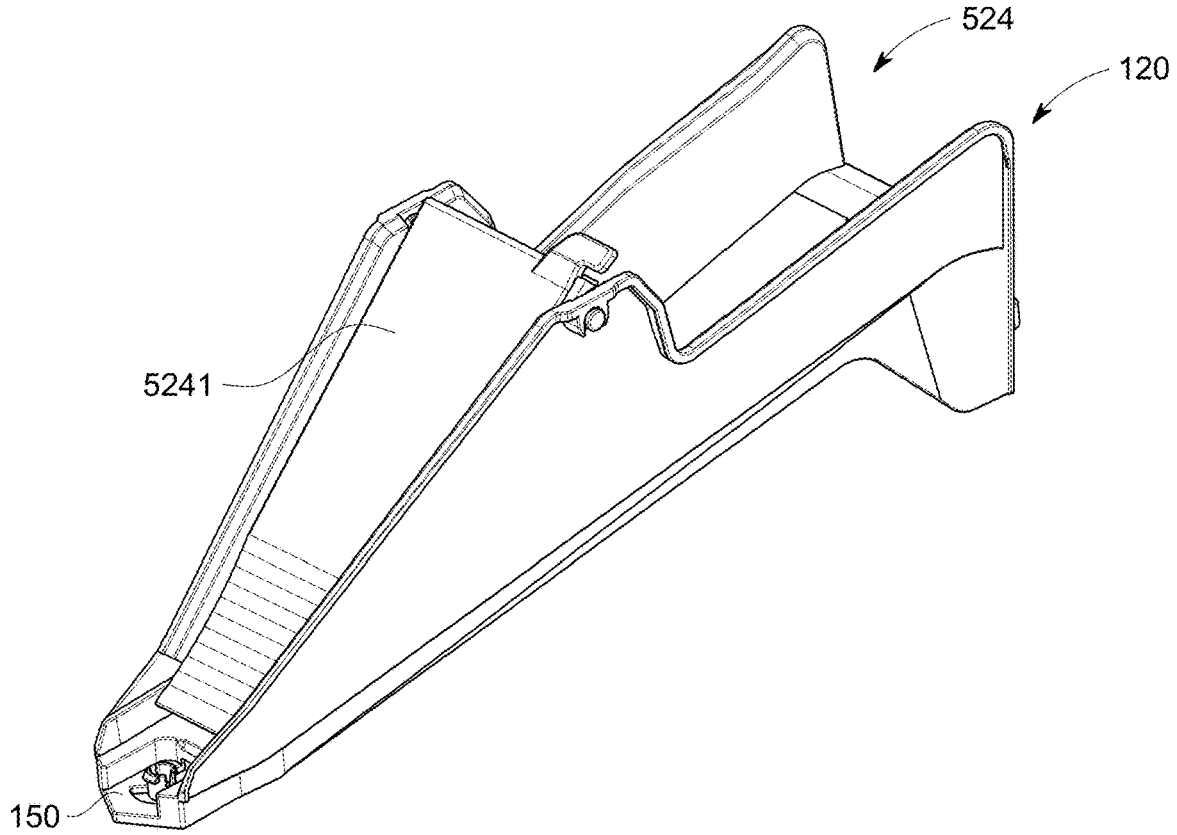

FIGS. 51 and 52 illustrate a jump track 522 and a landing/catch track 524, respectively. The jump track 522 initiates at a female connector 120 and extends upwards to a jump 5221. The jump track 522 also includes a male connector 150, but the male connector 150 is provided separately from the jump 5221 so that the jump can be connected to the landing track 524 via a straight track (e.g., track 202, track 203, etc.) that spaces the landing track 524 from the jump track 522. Accordingly, the landing track 524 also includes a female connector 120 and a male connector 150 but provides a catch 5241 on a decline that guides a toy vehicle towards the male connector 150 without requiring the toy vehicle to traverse the female connector 120.

Figure 53:
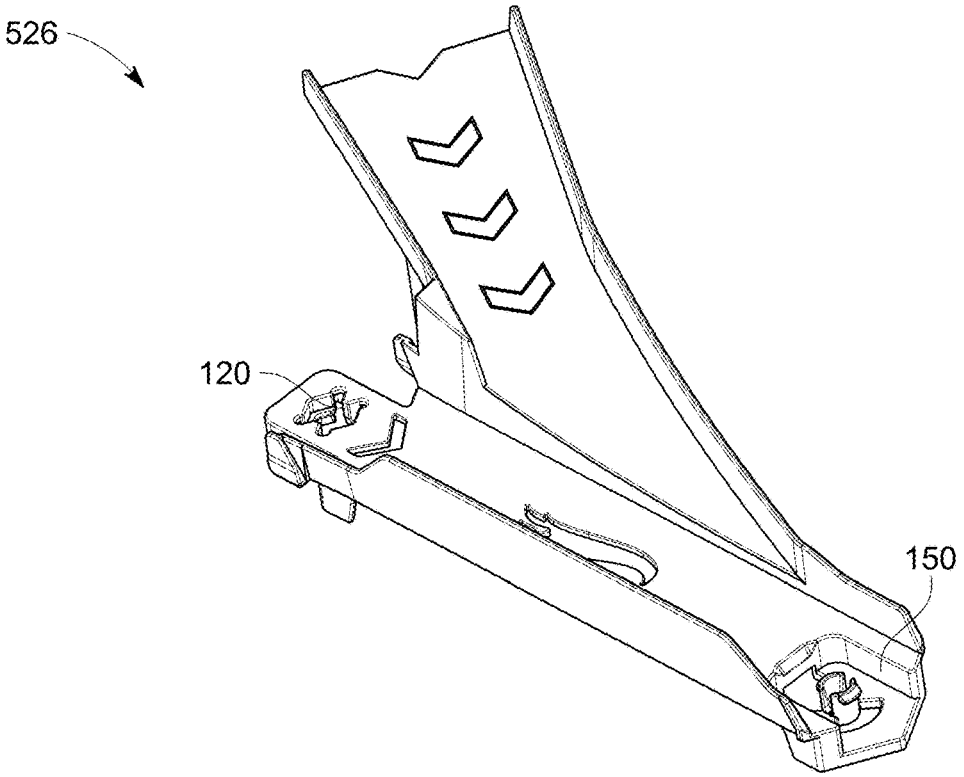

FIG. 53 depicts a decline split track 526. The main pathway extends from a female connector 120 to a male connector 150 while the secondary pathway does not include a connector 120, 150. The secondary pathway could provide a declining ramp or could provide a connection to a different type of track (e.g., via a separate connector). However, in other embodiments, the secondary pathway could also include a female connector 120.

Figure 54:
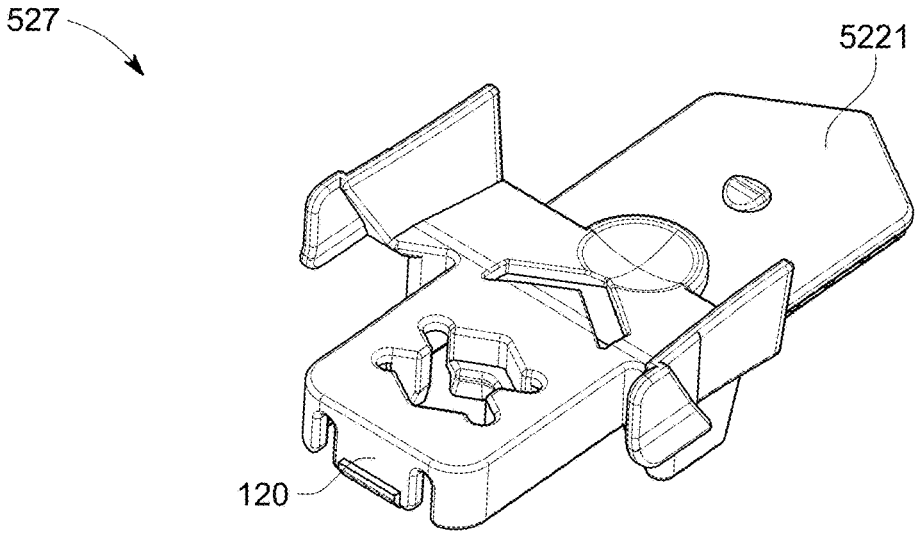

FIG. 54 illustrates an adapter 527 with a female connector 120 that is connected to a legacy connector. Thus, adapter 527 may be used to connect the track pieces presented herein to legacy track pieces that would not otherwise be connectable to the track pieces presented herein.

Figure 21A:
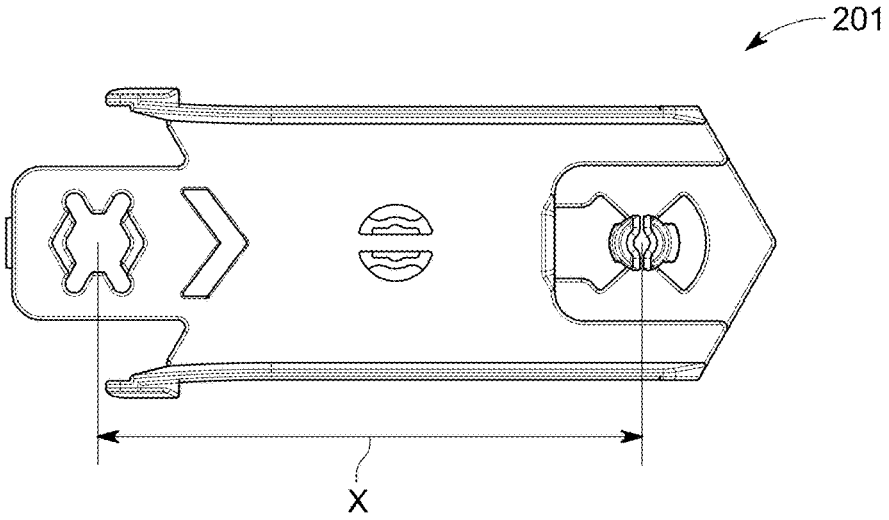
FIGS. 21A-21E provide top, side, bottom, top perspective, and front views of a first track piece of the set of FIG. 20, respectively.
Figure 21B:
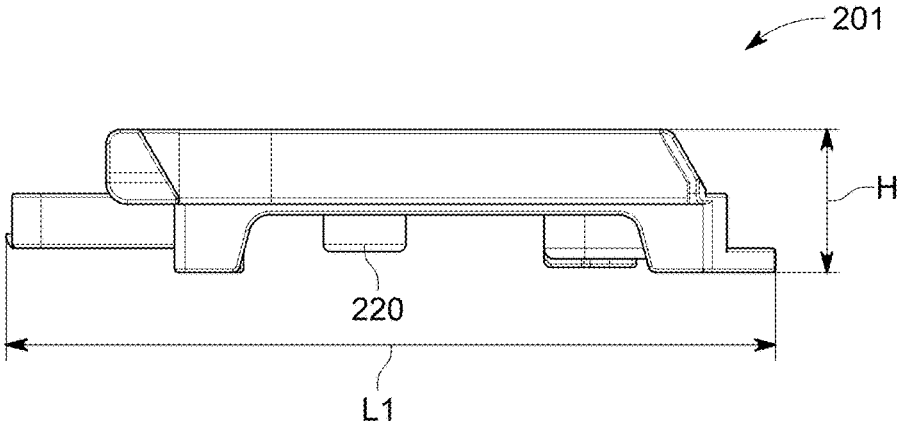
Figure 21C:
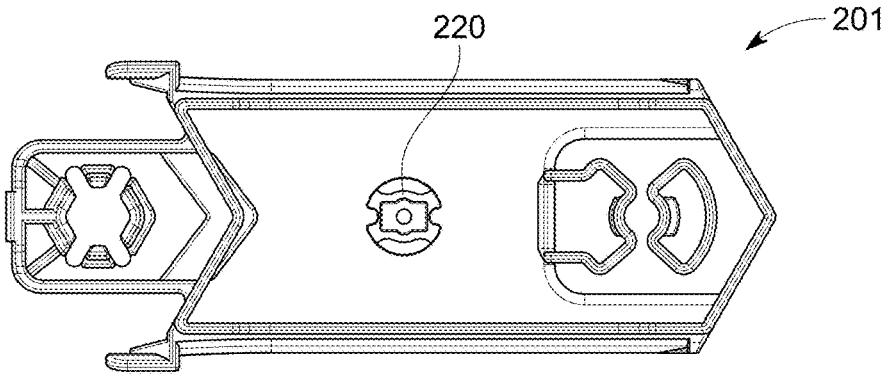
Figure 21D:
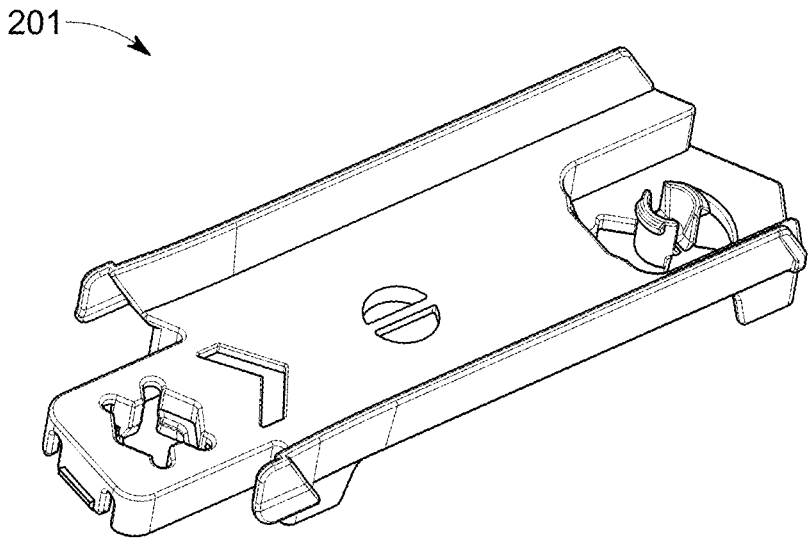
Figure 21E:
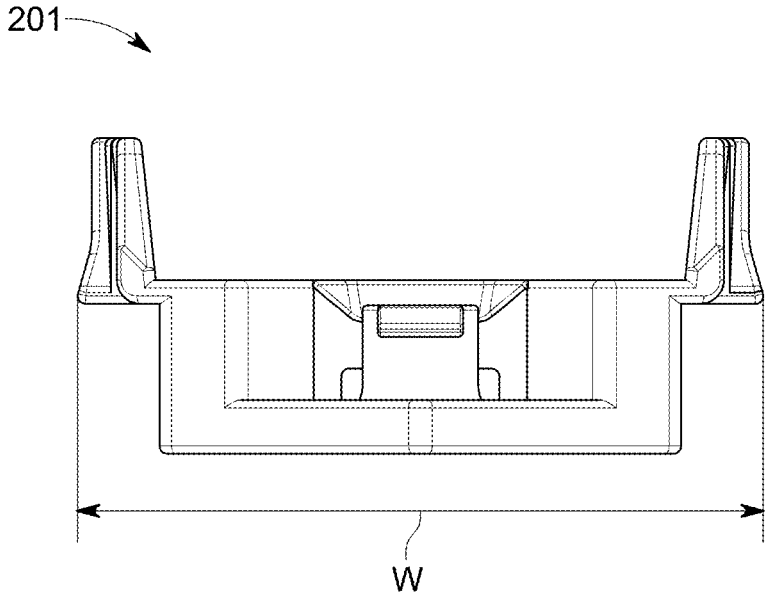
Figure 22A:
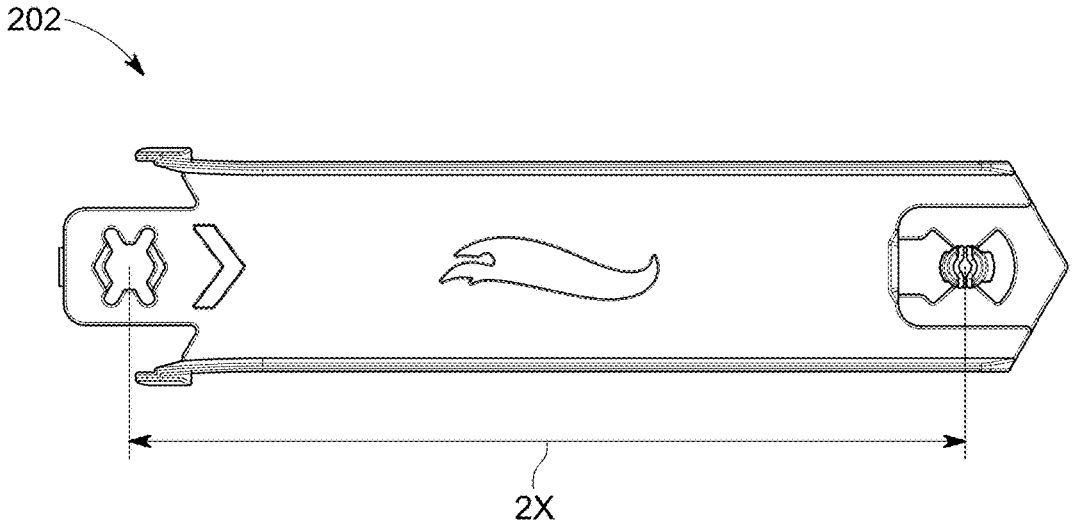
FIGS. 22A-22E provide top, side, bottom, top perspective, and front views of a second track piece of the set of FIG. 20, respectively.
Figure 22B:
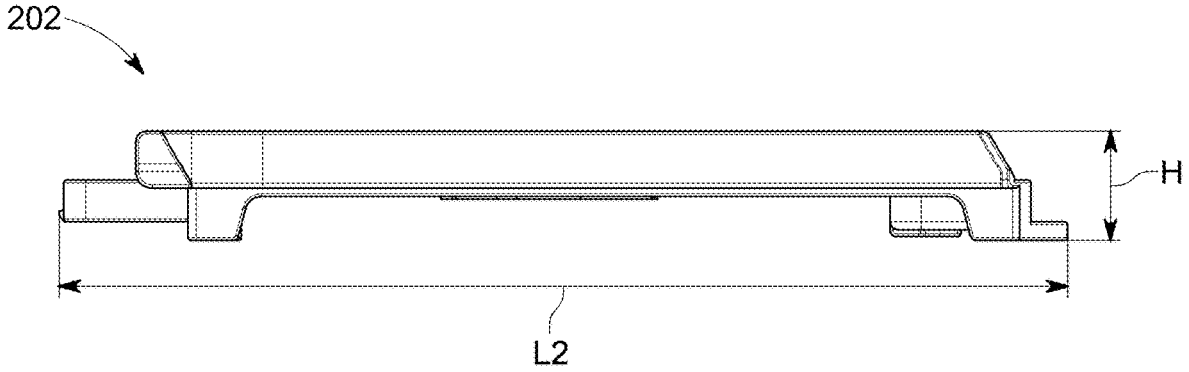
Figure 22C:
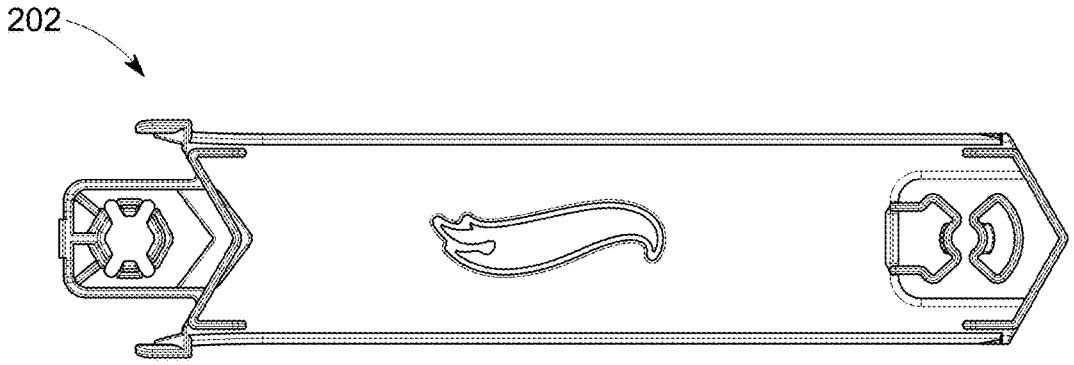
Figure 22D:
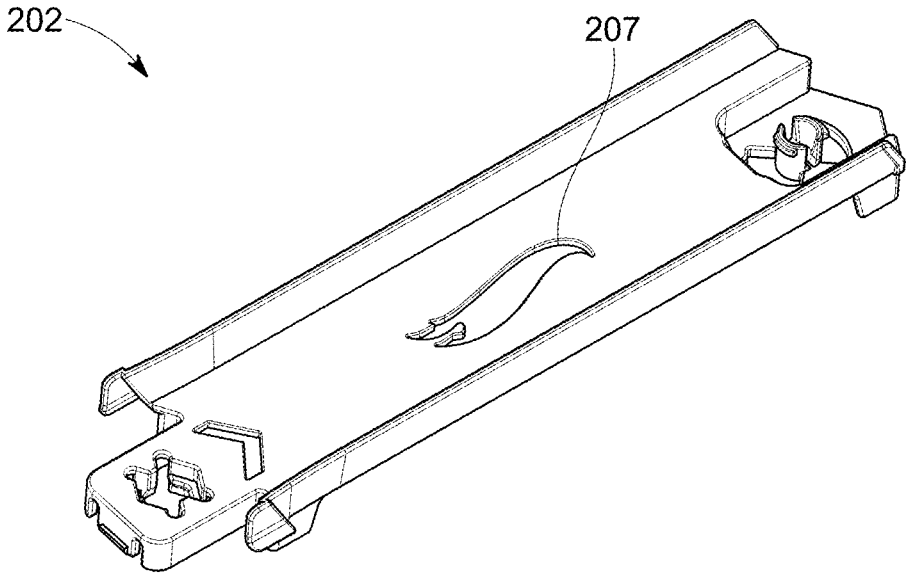
Figure 22E:
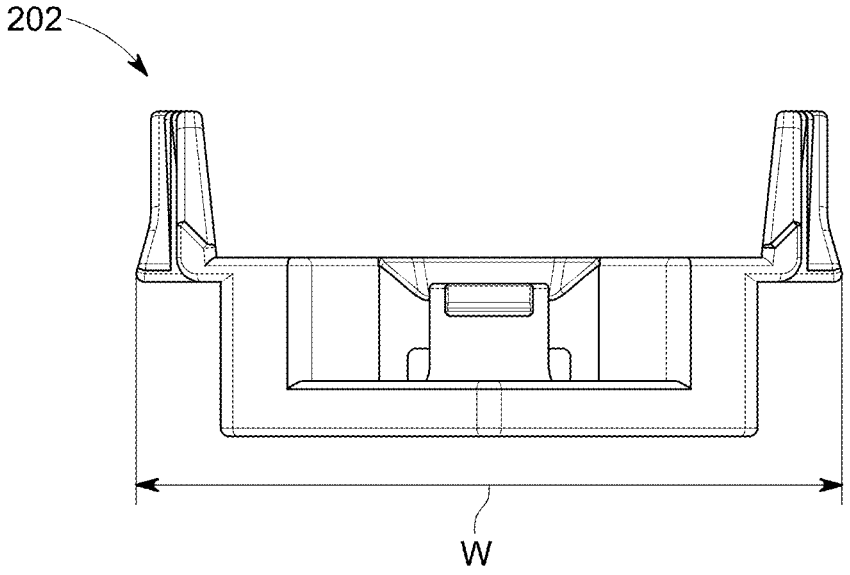
Figure 23A:
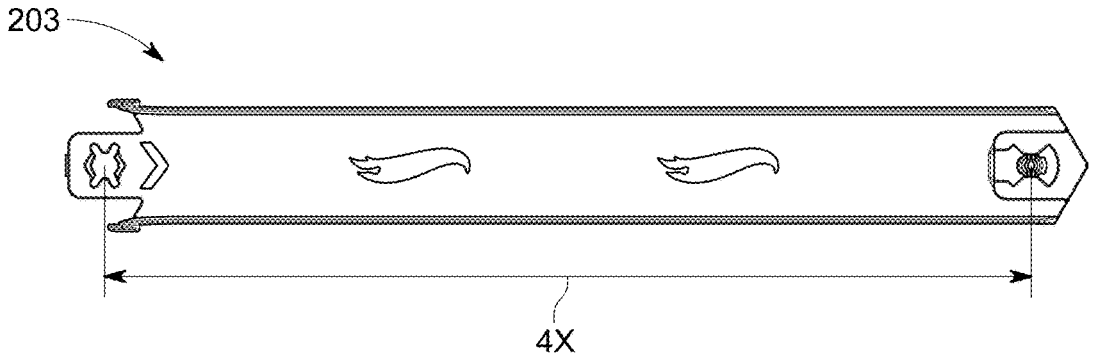
FIGS. 23A-23E provide top, side, bottom, top perspective, and front views of a third track piece of the set of FIG. 20, respectively.
Figure 23B:
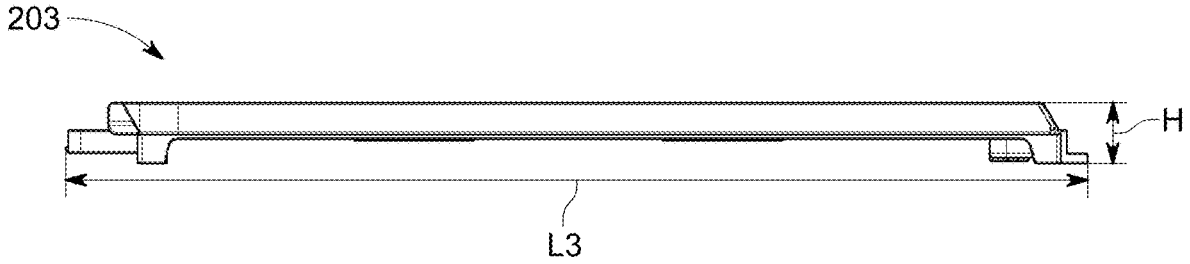
Figure 23C:
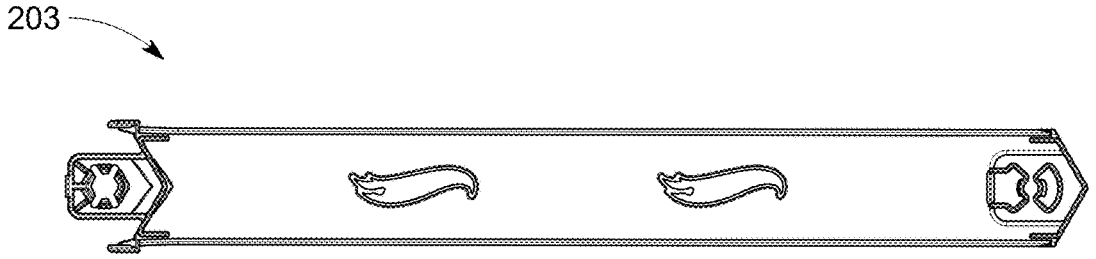
Figure 23D:
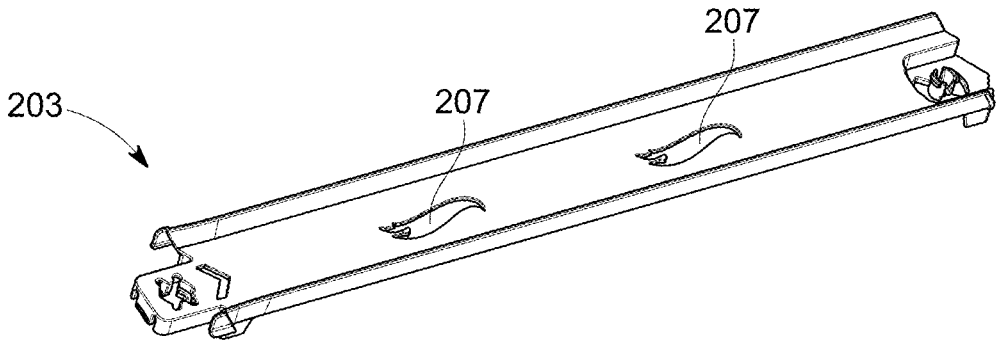
Figure 23E:
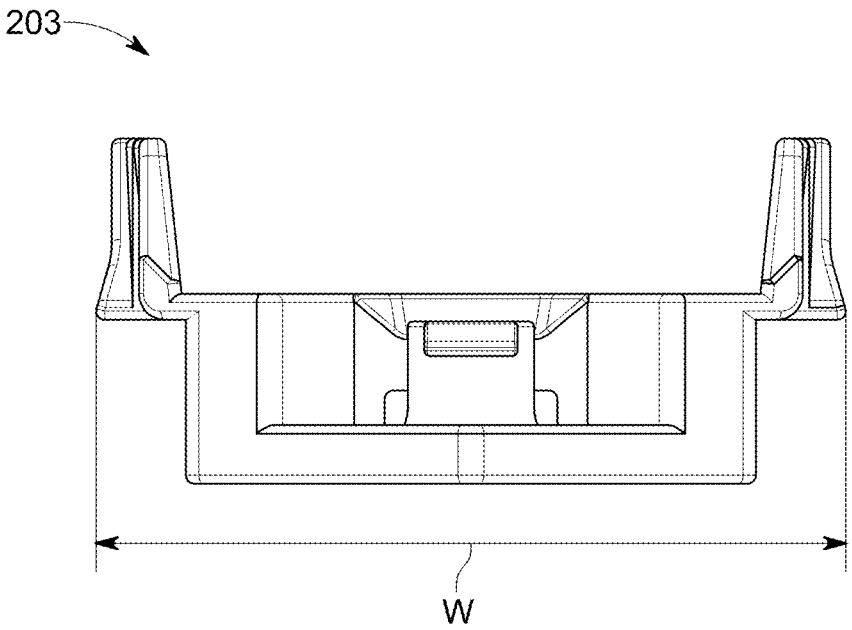
Figure 24A:
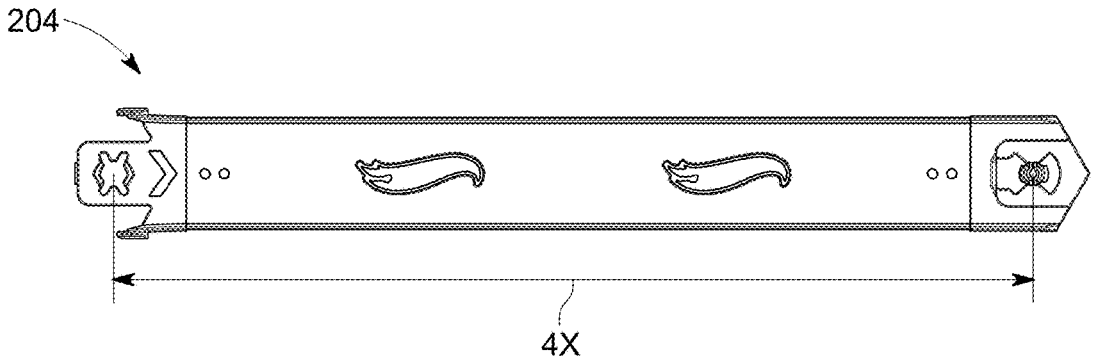
FIGS. 24A-24E provide top, side, bottom, top perspective, and front views of a fourth track piece of the set of FIG. 20, respectively.
Figure 24B:
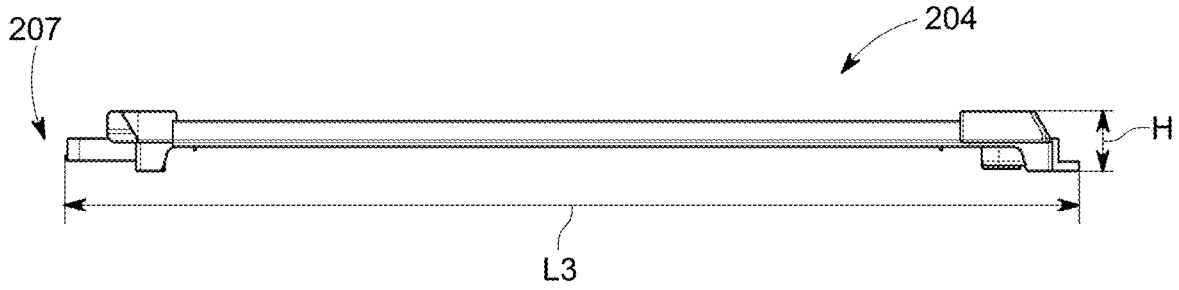
Figure 24C:
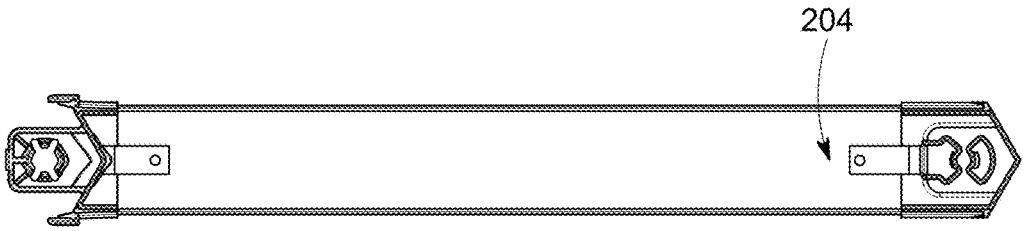
Figure 24D:
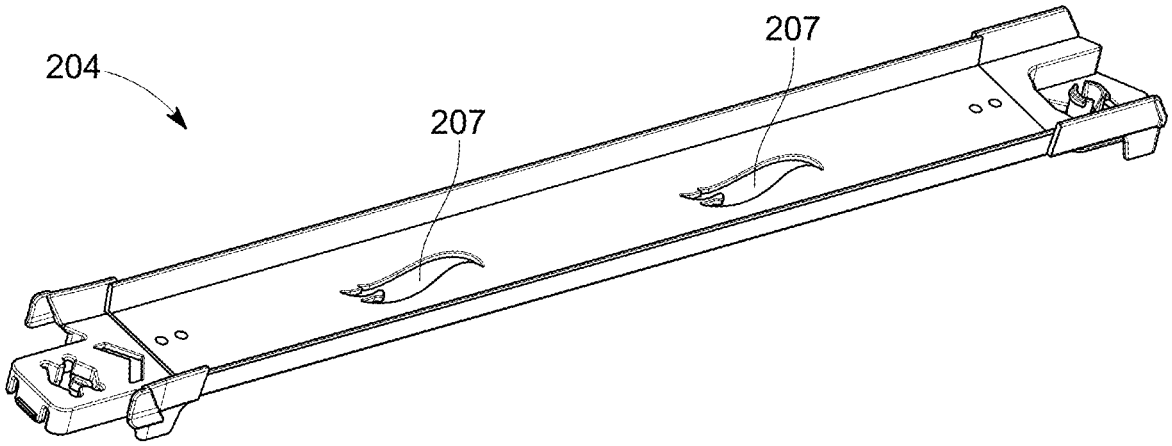
Figure 24E:
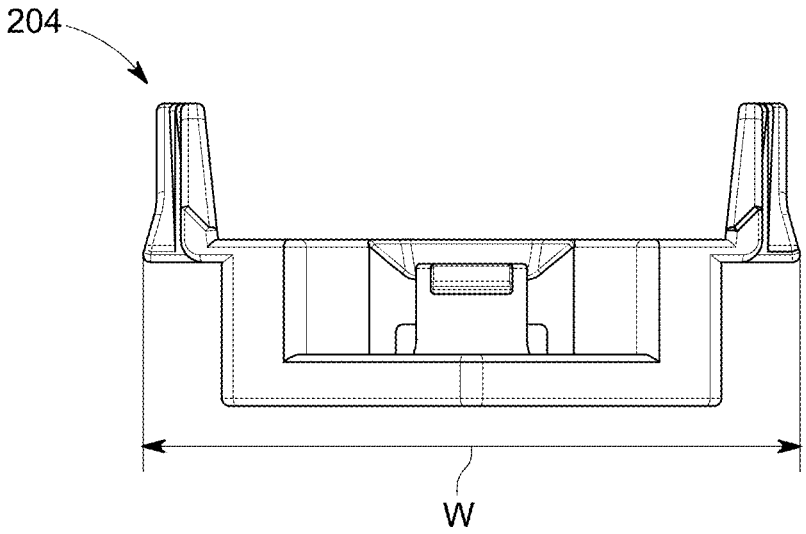
Figure 25A:
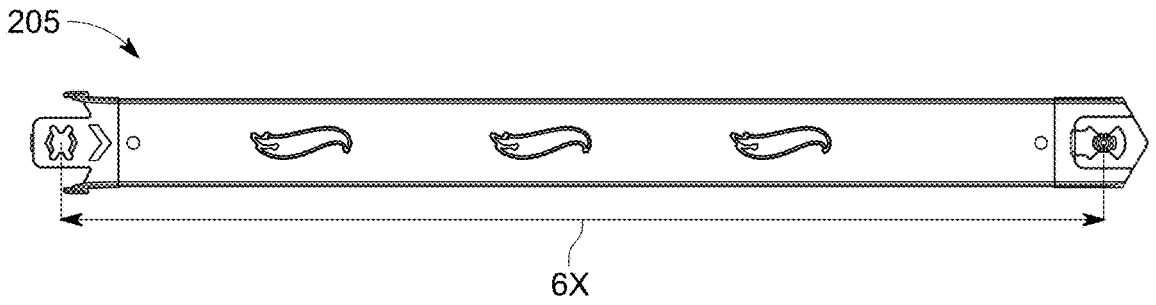
FIGS. 25A-25E provide top, side, bottom, top perspective, and front views of a fifth track piece of the set of FIG. 20, respectively.
Figure 25B:
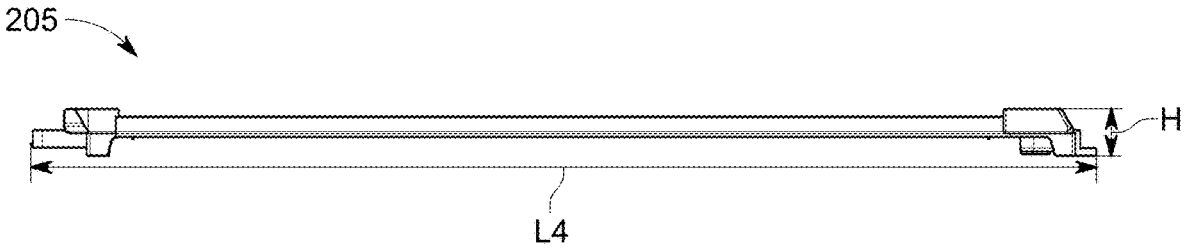
Figure 25C:
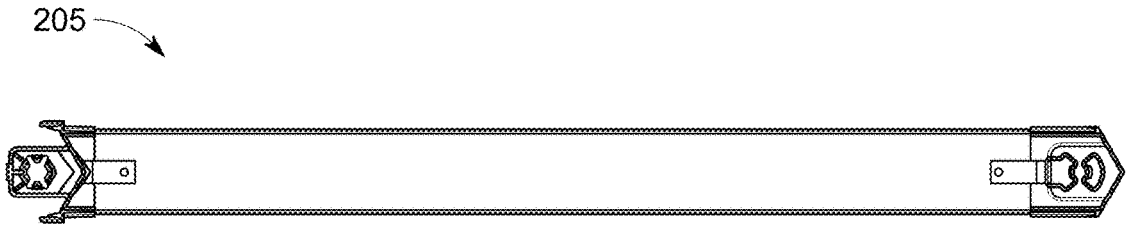
Figure 25D:
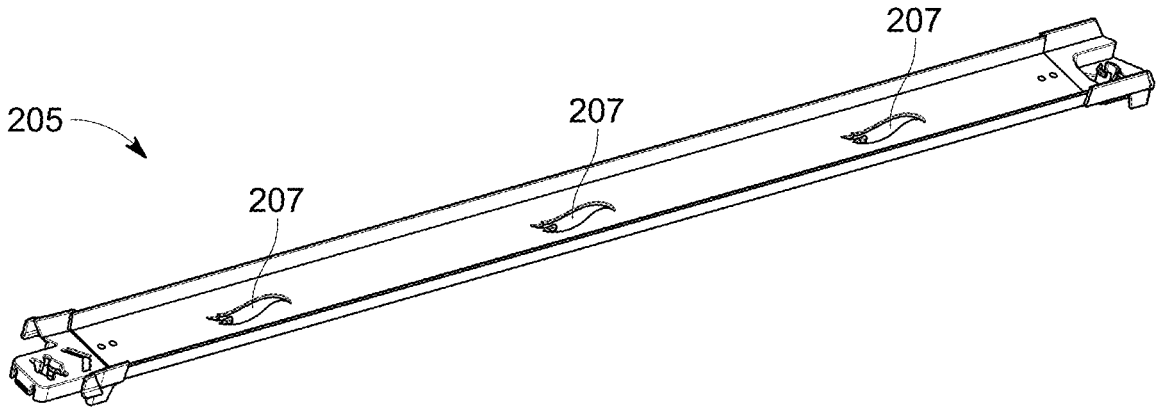
Figure 25E:
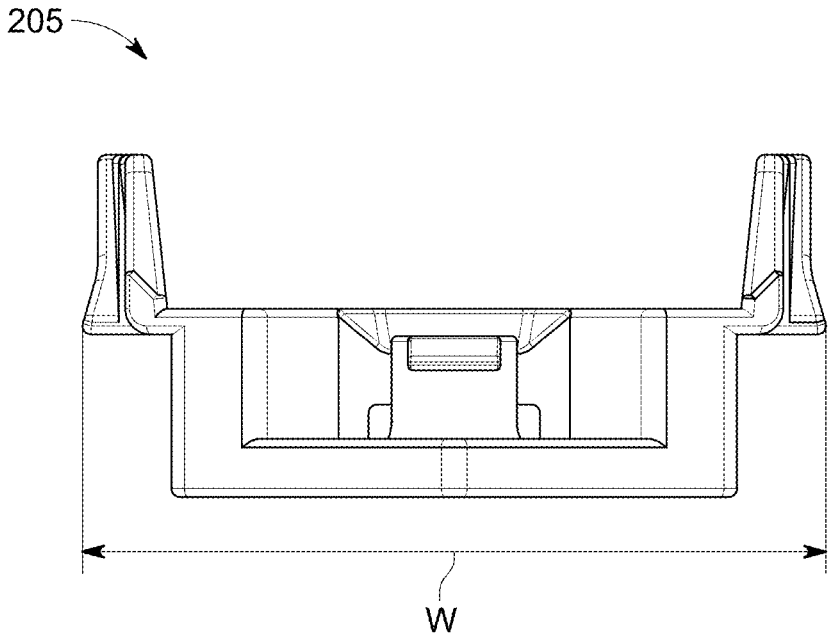
Figure 26A:
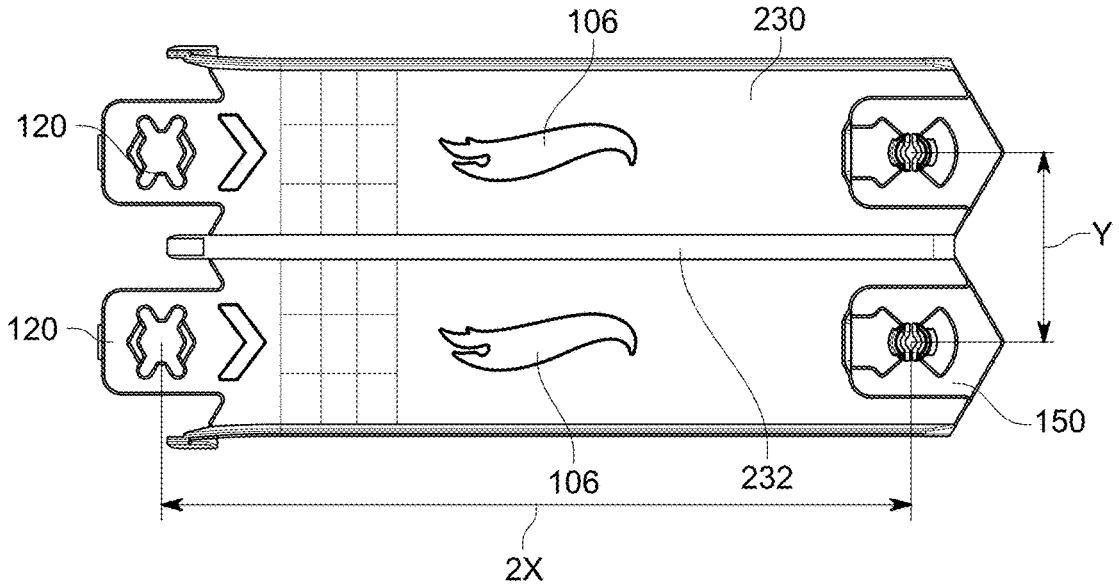
FIGS. 26A-26E provide top, side, bottom, top perspective, and front views of yet another track piece formed in accordance with an example embodiment of the present application.
Figure 26B:
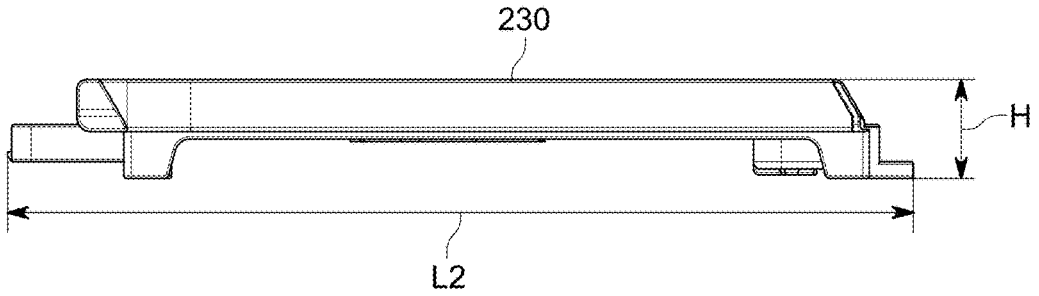
Figure 26C:
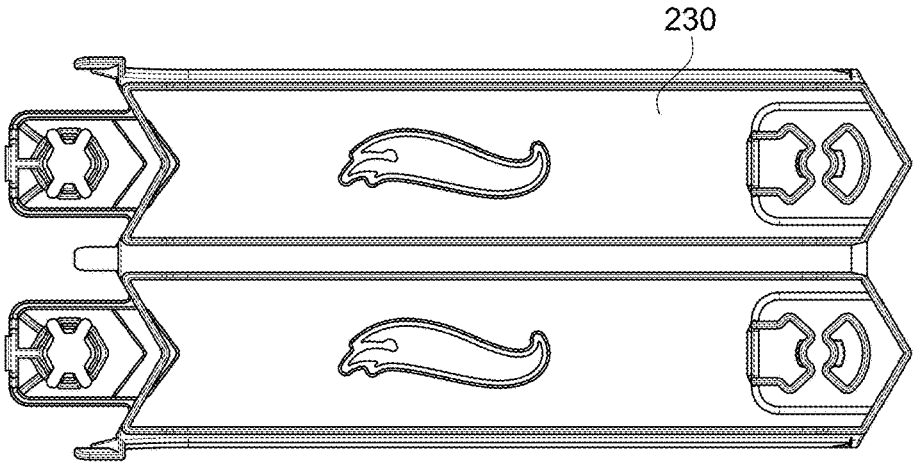
Figure 26D:
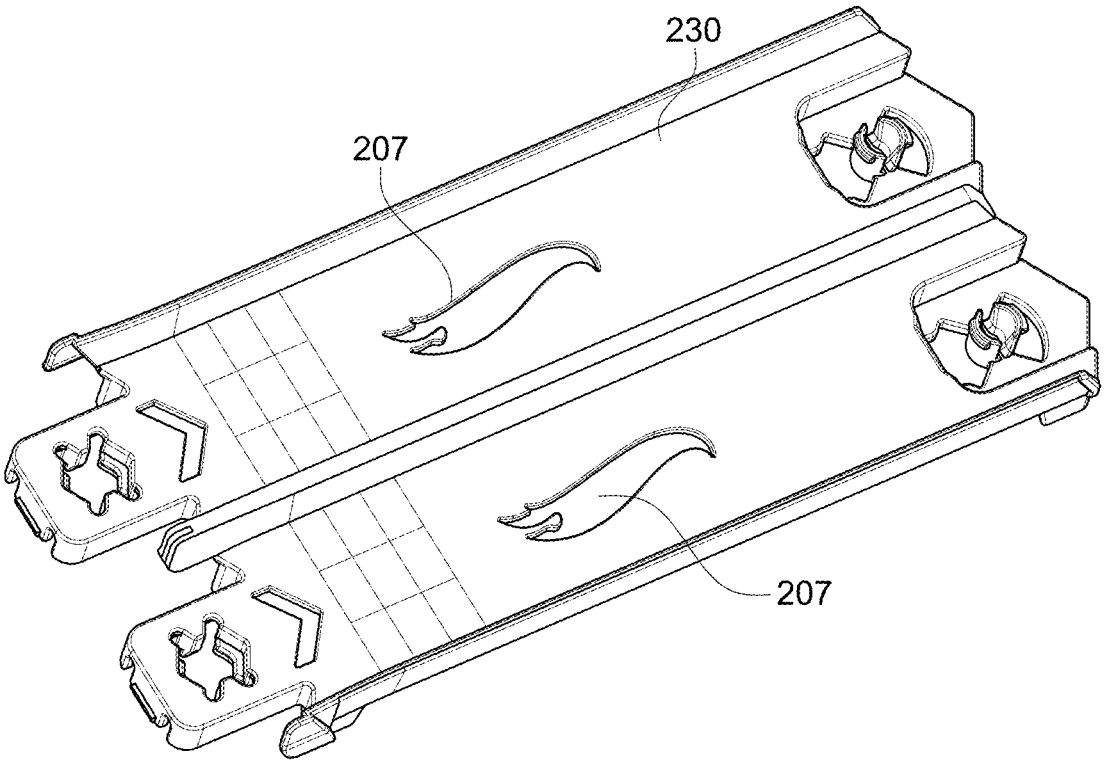
Figure 26E:
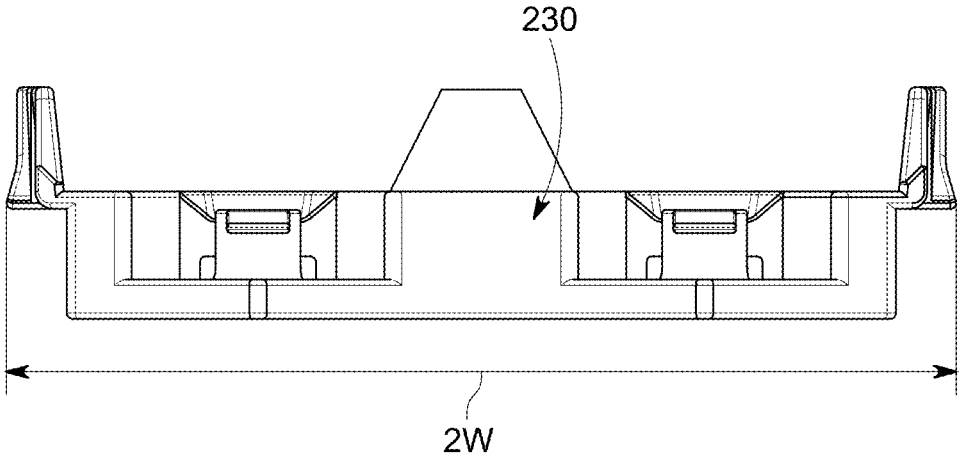
Figure 55:
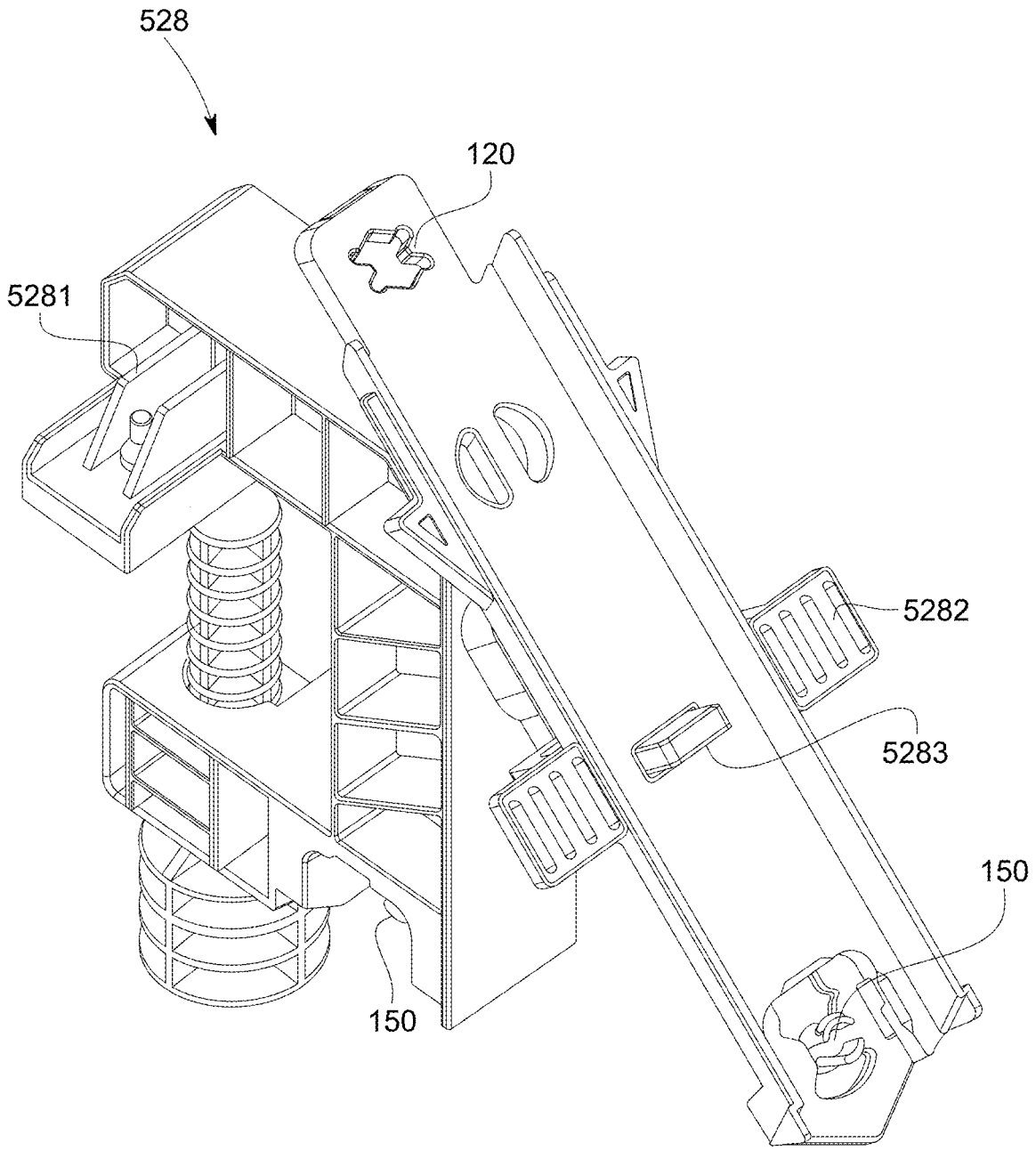
Figure 56:
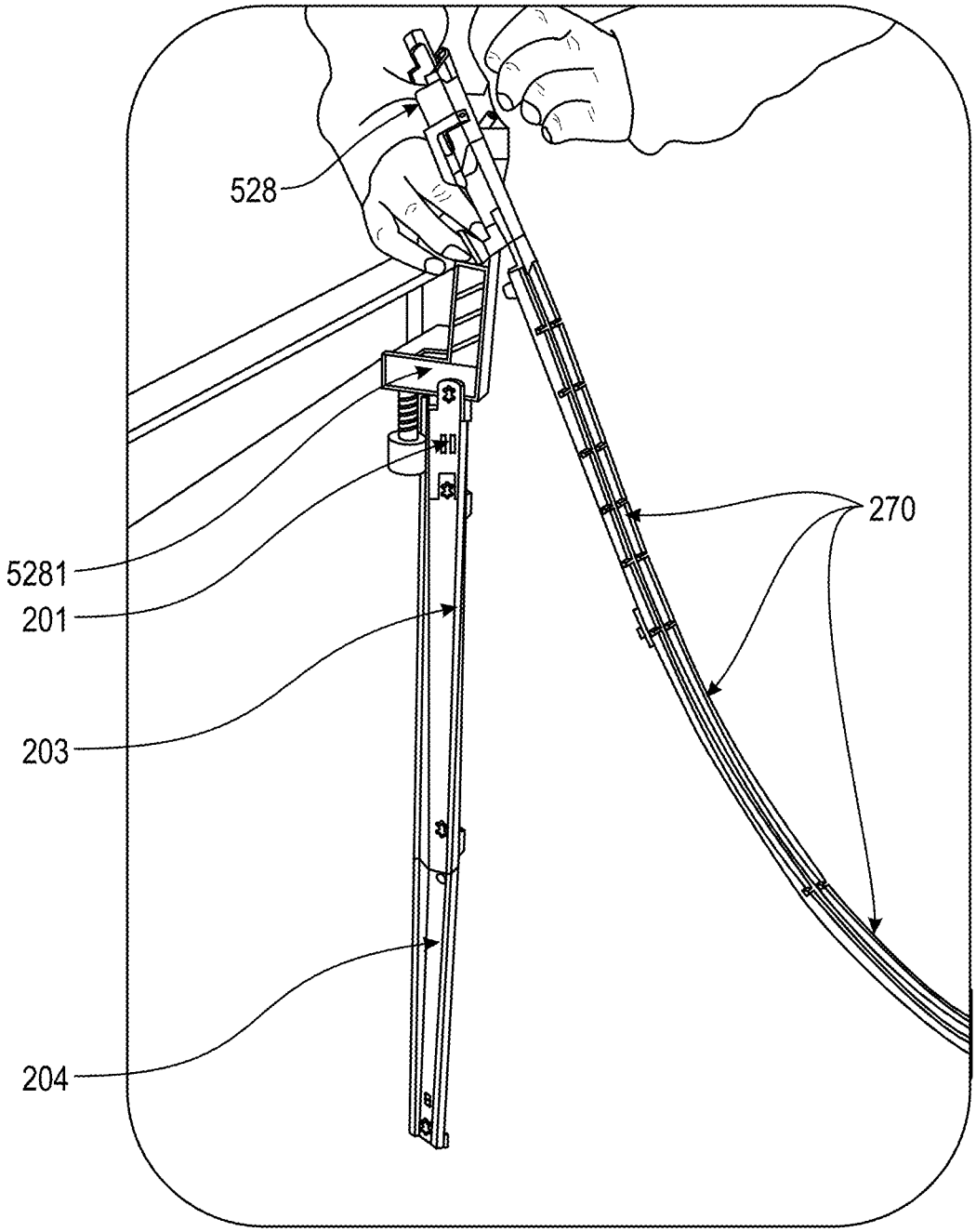
FIG. 56 provides a side perspective view of a portion of a track system including the accessory track piece of FIG. 55.

FIGS. 55 and 56 illustrate a gravity launcher 528 that includes a female connector 120 and a male connector 150. The connectors are included on either side of a track with a retractable stop 5283 that may be actuated via actuator 5282. Often, gravity launchers require a user to actuate the actuator in a direction of launch; however, actuator 5282 can actuate towards a clamp 5281 of the gravity launcher 528. This may reduce or eliminate unintentional actuation and may also prevent a user from unintentionally rearranging track segments connected to the gravity launcher 528 during an actuation. In the depicted embodiment, the track with the retractable stop 5283 is mounted to the clamp 5281 via a ball joint (e.g., formed via structures similar to riser mount 220, as shown in FIGS. 21B-21C and a mount 562, as shown in FIGS. 57 and 58). However, other embodiments may couple the track to the clamp 5281 in any desirable manner.

Moreover, in the depicted embodiment, the clamp 5281 includes a male connector 150. Thus, during setup, a user can measure the distance to the ground with straight track pieces, e.g., as shown in FIG. 58. Such a measurement may help a user to understand or build out a grid, e.g., in accordance with the grid system described in further detail below. In FIG. 58, a user has used tracks 201, 203, and 204 to span the distance between clamp 5281 and the floor. Meanwhile, three pieces of flexible track piece 270 are attached to the track with the retractable stop 5283 (via male connector 150) and provide a gravity track for a toy vehicle.

Notably, across the accessories depicted in FIGS. 41-56, the accessories are generally arranged so that a toy vehicle travels from a female connector 120 to a male connector 150. This creates directional play that will help users (e.g., children) avoid assembling stunts or accessories improperly (e.g., backwards) and help avoid frustration and/or parental intervention. For example, if the kicker loop 516 is installed backwards in a play configuration, the kicker loop 516 will not operate to propel a toy vehicle through the loop. Additionally, while FIGS. 41-56 do not depict dimensions, any of the accessories depicted in FIGS. 41-56 can be sized to fit into/operate within the grid arrangements described herein.

FIGS. 57 and 58 illustrate non-track accessories that may be used with the track pieces presented herein. Specifically, FIG. 57 depicts a first riser or stanchion 560 and FIG. 58 depicts a second riser or stanchion 570. Stanchions 560 and 570 both extend from a base 564 to a top with a mount 562. In the depicted embodiment, the mount 562 is a ball that may form a ball joint with riser mount 220 included on a track portion (see, e.g., FIGS. 21B-21C). However, other embodiments may include any mount of any type.

Regardless of the mount 562, the first stanchion 560 extends to a height Z2 and is taller than the second stanchion 570, which extends to a height Z (e.g., half as high as stanchion 560). These proportions may help to build a three-dimensional grid and/or may align with the dimensions of the track pieces. Moreover, stanchion 560 includes an intermediate support 566 at height Z so that stanchion 560 may be used to support track pieces at height Z and/or Z2.

Grid System and Track Layouts

FIGS. 59A-59C and 60-70B depict grid systems along which the track pieces presented herein may connect during formation of a track configuration. The grid system generally eases and simplifies track construction so that, for example, even a young child can effectively build track configurations. With such a grid system, the track pieces presented herein will continuously align with and interconnect with each other when a user (e.g., a child) uses the track to build a track configuration. More specifically, with the grid system(s) presented herein, a user will always be able to circle a track configuration back to the first piece of a track configuration. Put yet another way, because of the grid system(s), any combination of the pieces can be connected in any incremental order and can still form a closed loop or a portion of a closed loop because all track piece connectors will land on the grid and be appropriately spaced from connectors of other track pieces. Alternatively, the grid can ensure that various accessory track pieces can be interconnected, with or without a closed loop. To be clear, the grid is not a physical structure; instead, the grid is a geometric construct.

To implement the grid system(s) presented herein, the track pieces are each specifically sized and designed to only connect at specific grid locations. For example, as is described above, all track pieces of the track system presented herein may include a coupler span length that is equal to an increment of a base coupler span length "X," such as approximately three or six inches. For straight track pieces, the sizing and design is fairly straight forward: the connectors 120, 150 are laterally aligned and longitudinally separated by a coupler span length that is an increment of a base coupler span length "X", such as X, 2X, 4X, 6X, etc.

On the other hand, curved track pieces and some accessory track pieces are carefully designed to provide a longitudinal separation between connectors 120, 150 that is an increment of a base coupler span length "X", while also providing a lateral separation between connectors 120, 150 that is an increment of a base coupler span length "X". Put another way, curved track pieces and accessory track pieces are designed to space connectors 120, 150 by increments of a base coupler span length "X" along both axes of an x-y plane. Thus, from another perspective, the coupler span lengths of curve track pieces, accessory track pieces, and/or any non-straight track pieces may be understood to be vectors extending along the grid axes, e.g., a x-vector and a y-vector. For example, a curved track piece may have a first coupler span length that is a first length vector extending along one direction of the x-y grid and may also have a second coupler length span that is a second length vector extending a second increment of the base unit along another direction of the x-y grid, such that the first male connector is separated from the first female connector by increments of the base unit along both axes of the x-y grid.

Figure 59A:
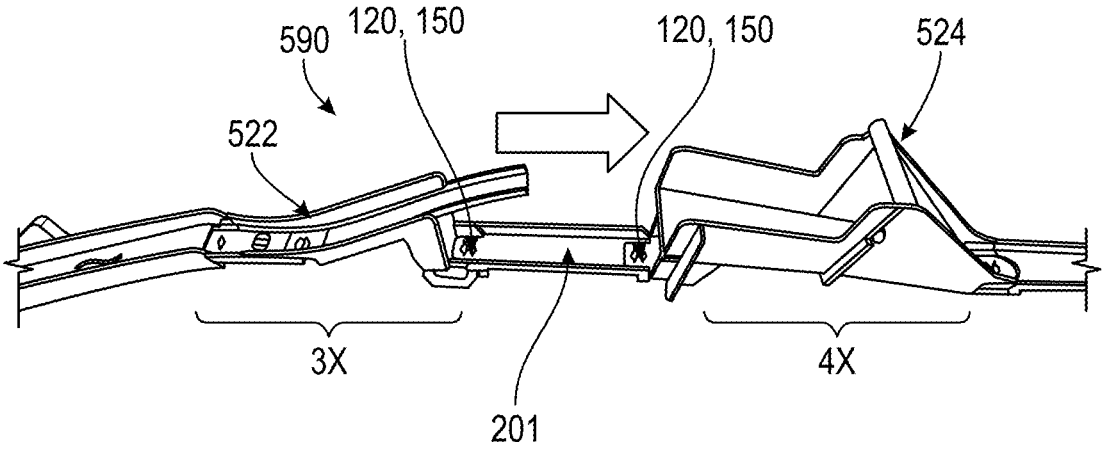
FIGS. 59A-59C, 60, 61A, 61B, 62A, 62B, 63-67, 68A-68D, 69A, 69B, 70A, and 70B depict grid systems along which the track pieces presented herein may connect during the formation of a track configuration.

FIG. 59A depicts an example of how straight track pieces or straight track accessories are longitudinally separated by increments of a base coupler span length "X." In this example, the jump track piece 522 of FIG. 51 is connected to the landing track piece 524 of FIG. 52 by track piece 201 of FIGS. 21A-21E. The jump track piece 522 has a coupler span length of 3X (e.g., three increments of the base coupler span length X), track piece 201 has a coupler span length of X (see FIG. 21A) and the landing track piece 524 has a coupler span length of 4X (e.g., four increments of the base coupler span length X). Thus, the entire jump assembly 590 spans 8X. Additionally, each joint between connectors 120, 150 is spaced by one or more increments of the base coupler span length X, even though the track pathway along the assembly is not continuous (since a toy vehicle may jump from jump track 522 to landing track 524). In fact, in this particular embodiment, the jump track 522 may have a jump angle that is specifically designed to cause a toy vehicle to jump a base coupler span length X in response to a specific propulsion force (e.g., the propulsion force generated by a specific launcher or booster, such as slam launcher 510). However, in other embodiments, the jump track assembly may be configured differently and include a different straight track accordingly.

Figure 59B:
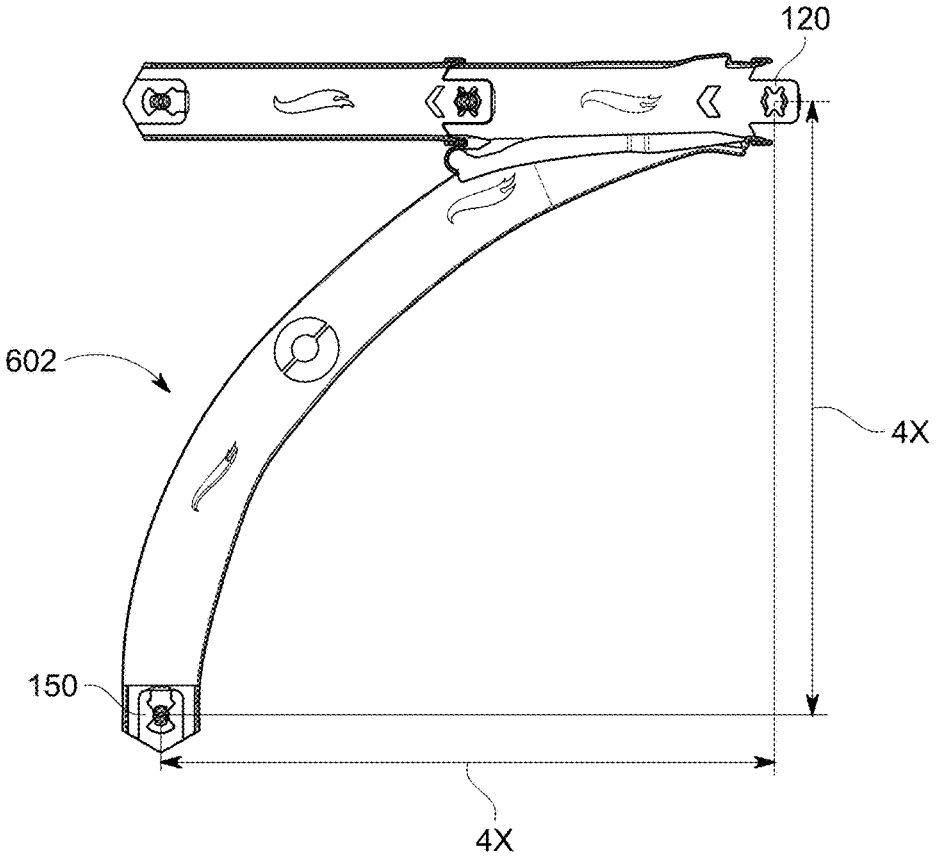
Figure 59C:
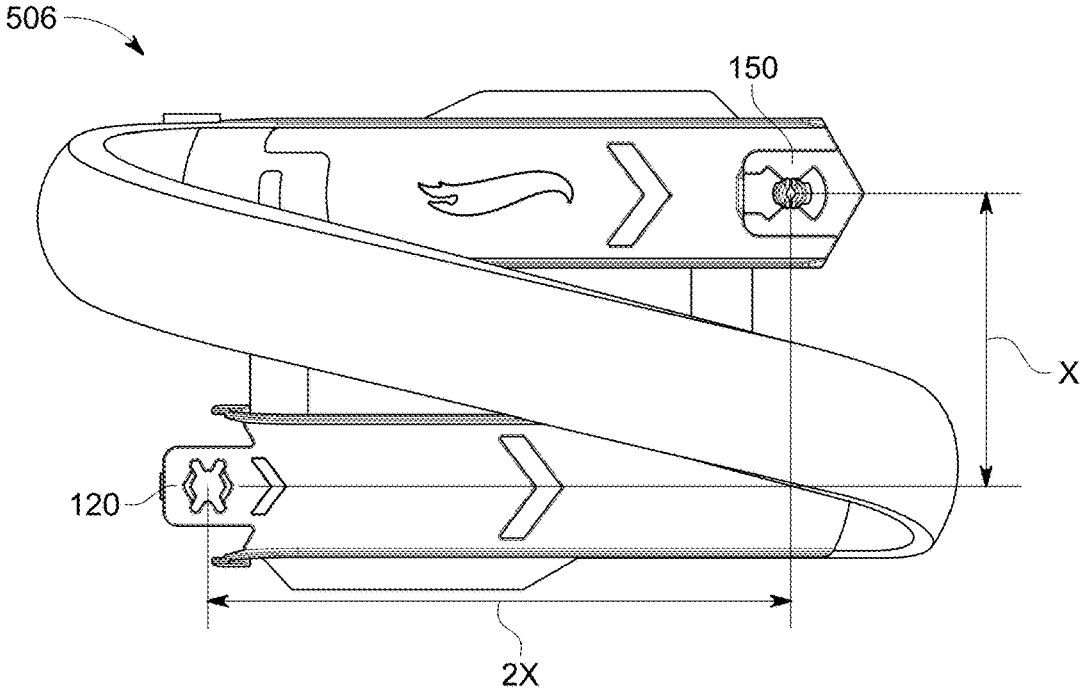

FIGS. 59B and 59C depict two examples of how curved and accessory track pieces separate connectors 120, 150 by increments of a base coupler span length "X" along both axes of an x-y plane. First, in FIG. 59B, curved track piece 602, which is similar to third curved piece 304 of FIG. 33 except that it includes an entrance split, provides a female connector 120 that is laterally and longitudinally separated from the male connector 150 by distances of 4X (e.g., four increments of the base coupler span length X). Next, FIG. 59C provides a top plan view of the loop track piece 506 of FIG. 43. In this view, it is clear that loop 506 provides a female connector 120 that is laterally separated from the male connector 150 by a distance of X (e.g., a single increment of the base coupler span length X) and longitudinally separated from the female connector 150 by a distance of 2X (e.g., two increments of the base coupler span length X).

Figure 60:
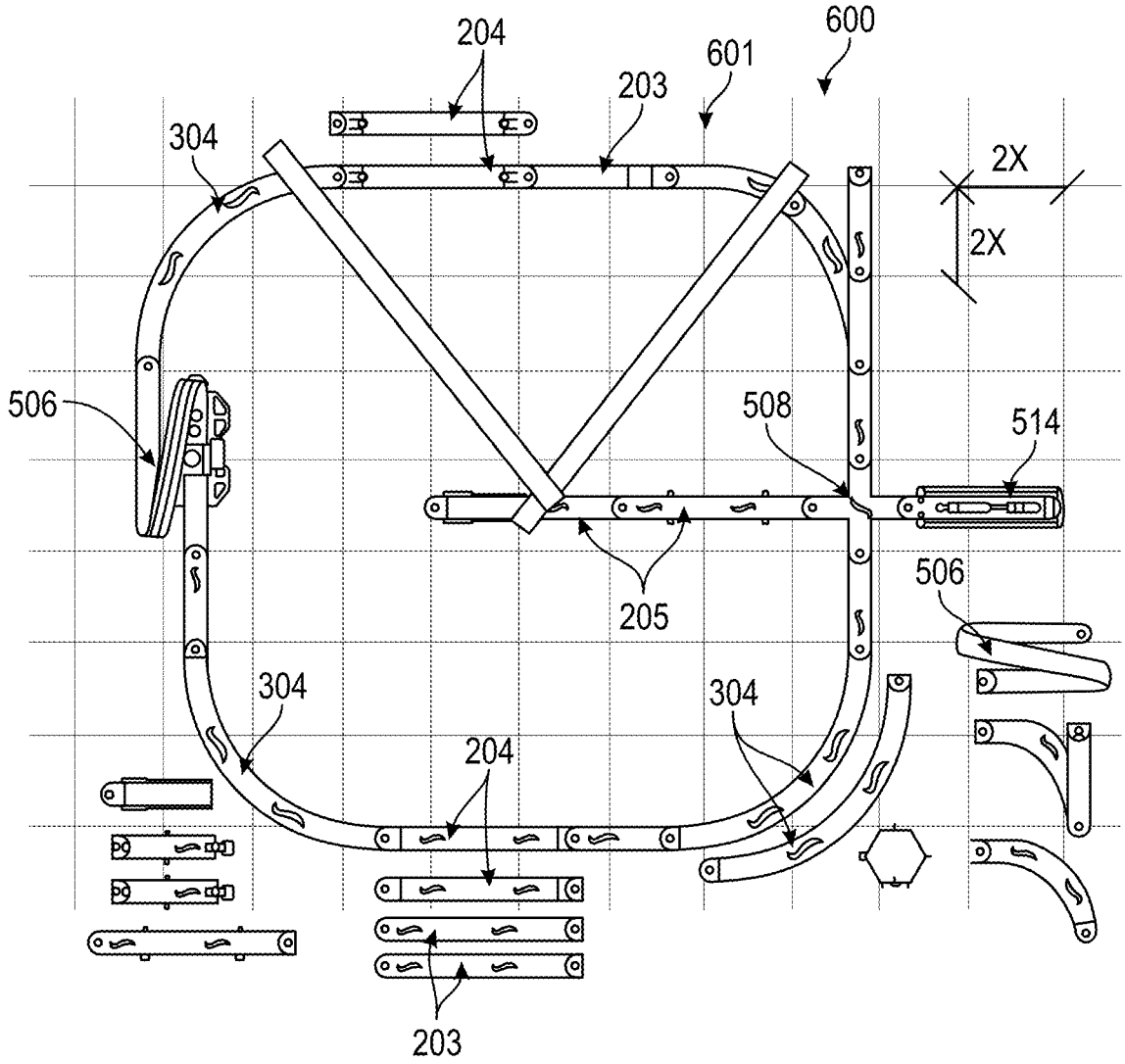

Now turning to FIG. 60, this figure depicts a geometric grid 600 that may govern track construction with the track pieces presented herein. In this instance, grid 600 has grid units that are equal to two increments of the coupler span length X. Thus, the female connector 120 and male connector 150 of each of the various track pieces interconnected with each other to form closed loop track configuration 601 land on at least one axis of grid 600. However, the depicted example is not intended to be definitive or limiting in any manner. Instead, grid 600 is drawn at a size that demonstrates the principle of the grid system presented herein without overcrowding the drawing. If, for example, the grid were visualized with grid units formed at single increments of the coupler span length X, each female connector 120 and each male connector 150 of the various track pieces in closed loop track configuration 601 would land on a vertex of grid 600.

Notably, in FIG. 60, track configuration 601 includes a loop 506 and an intersection 508. Even with these features, every track piece has a coupler span length that causes the female connector 120 and male connector 150 of the various pieces to be disposed on a grid line of grid 600. Thus, while only a subset of the track pieces shown in FIG. 60 are labeled, it should be understood that each track piece on grid 600 is formed in accordance with the techniques presented herein.

Since all of the track pieces are formed in accordance with the techniques presented herein, track configuration 601 can be substantially shaped as a square with rounded corners. By comparison, in other toy vehicle track systems, a loop or intersection (or another such accessory) disposed on one side of a closed-loop, rounded square might offset one side of the closed-loop, rounded square from an opposite side of the closed-loop, rounded square by a distance that prevents straight line interconnections between the two sides. As a specific example, if a track system includes straight track of only one length, a lateral offset on one side of a closed-loop, rounded square will prevent a top and bottom of that side from being interconnected to a top and bottom of the opposite side by straight track pieces.

FIGS. 61A, 61B, 62A, 62B, and 63 provide additional examples in which the grid system facilitates easy track building. In these embodiments, the geometric grid system is strictly a 2-D grid system (e.g., on a x-y plane), even though the track configurations contain track elements that extend vertically (e.g., into the Z-direction).

Figure 61A:
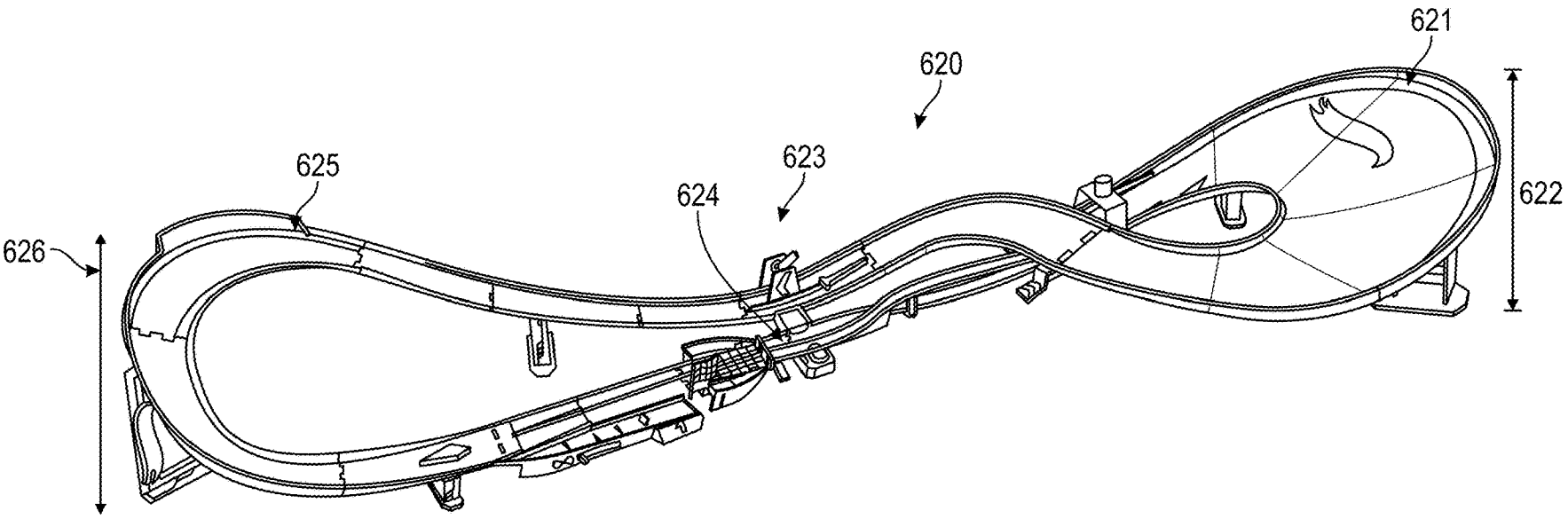
Figure 61B:
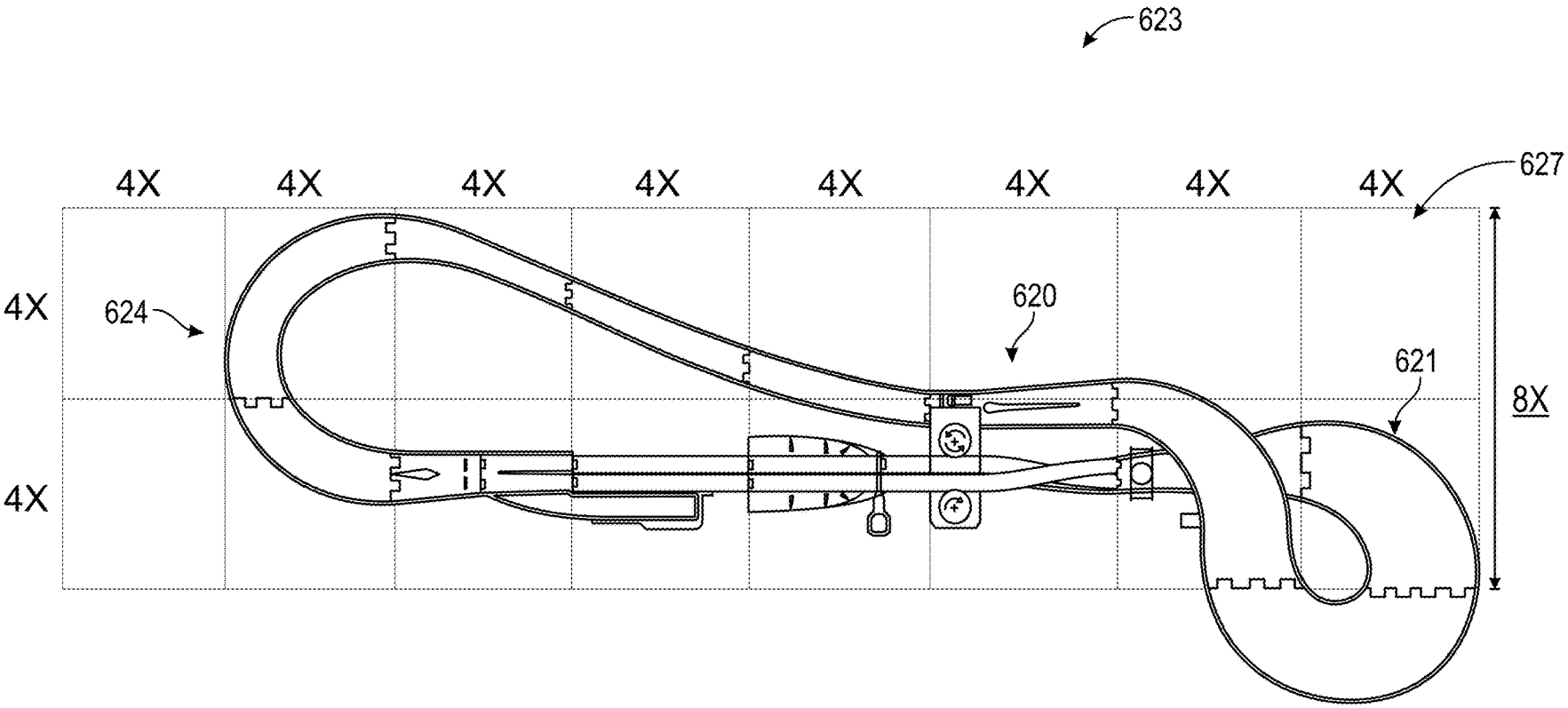

First, FIG. 61A depicts a closed loop track configuration 620 from a top perspective view and FIG. 61B depicts the same track configuration 620 from a top plan view superimposed onto grid system 627. As can be seen in FIG. 61A, closed loop track configuration 620 generally extends from a first turn section 621 to a second turn section 625. Turn sections 621 and 625 are interconnected by an intermediate section 623 that includes a booster 624. Thus, closed loop track configuration 620 is generally configured so that toy vehicles can continuously race (e.g., lap-style racing).

In some instances, turn sections 621 and 625 may be comprised of a single piece (or multiple pieces interconnected by irremovable connections). Alternatively, turn sections may be comprised of multiple track pieces formed in accordance with the techniques presented herein (e.g., multiple 90 degree curved track pieces). Meanwhile, intermediate section 623 can be comprised of any number of track pieces formed in accordance with the techniques presented herein (i.e., any number of track pieces that each include female connector 120 and male connector 150, whether formed integrally with the track pieces or formed separately and coupled thereto). In any case, the various sections 621, 623, 625 of closed loop track configuration 620 are configured to align connectors of track pieces included therein on one or more axes of grid 627.

Thus, notably, while turn element 621 defines a wide track path that allows toy vehicles to pass each other (adding play value to closed loop track configuration 620), both ends of turn element 621 align with grid 627 so that joints of turn sections 621 are aligned with grid 627. Similarly, turn section 625 defines a slightly widened track path (which may also allow toy vehicles to pass each other and add play value to closed loop track configuration 620), but again, both ends of turn element 625 align with grid 627 so that joints of turn sections 625 are aligned with grid 627. Put more simply, in the embodiment of FIGS. 61 and 62, the grid 627 is agnostic to height and track pieces included in closed loop track configuration 620 are designed so that all joints align with x-y grid 627, regardless of height.

Figure 62A:
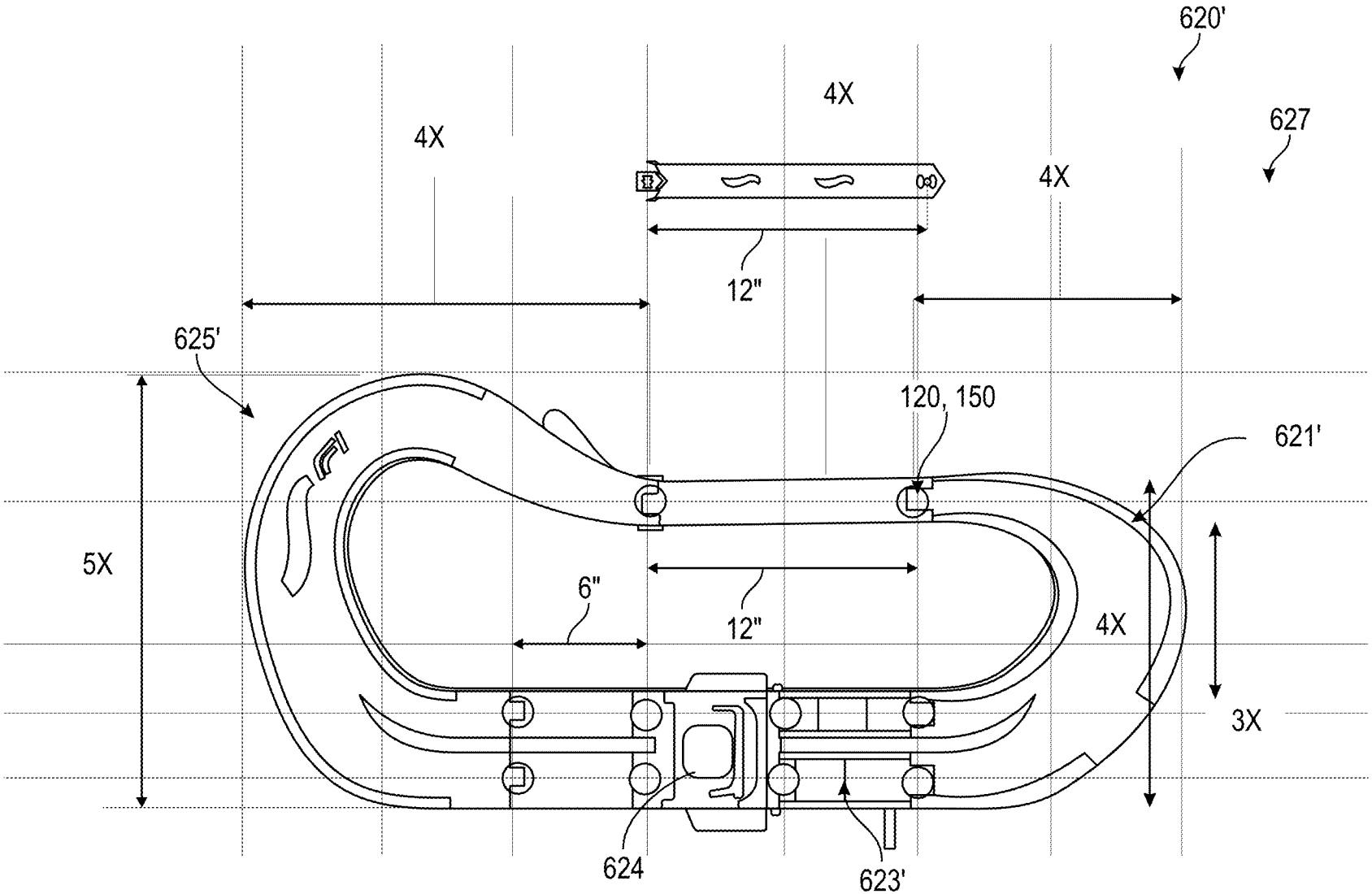
Figure 62B:
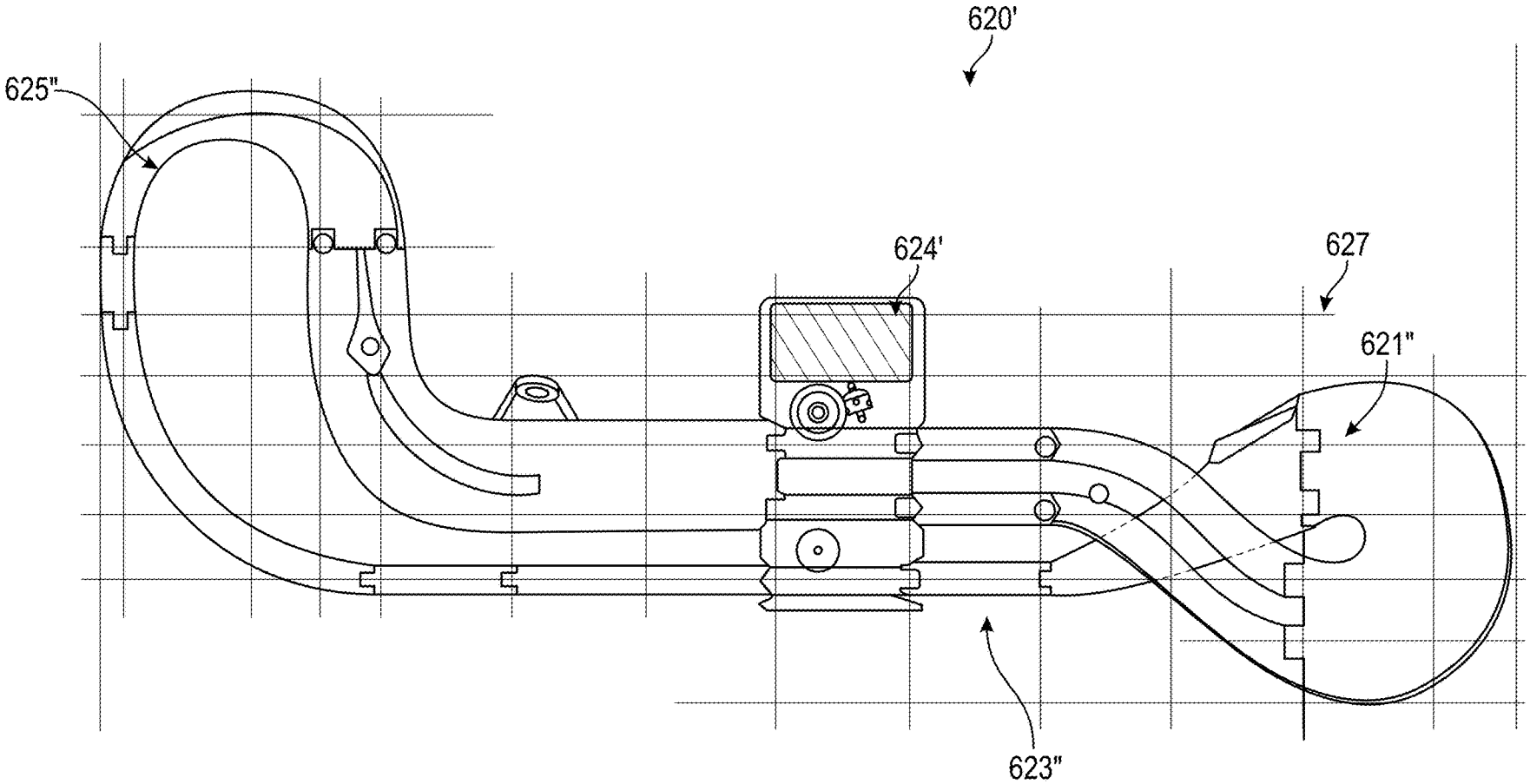

Next, FIGS. 62A and 62B depict variations of closed loop track configuration 620 that also comply with grid 627. In FIG. 62A, the closed loop track configuration 620' still includes an intermediate section 623' that incorporates a booster 624 while interconnecting a first turn section 621' with a second turn section 625'. However, each of sections 621', 623', and 625' is generally flat (e.g., does not have a substantive z-dimension) and includes stylistic differences from corresponding track sections of track 620. Similarly, in FIG. 62B, the closed loop track configuration 620" still includes an intermediate section 623' that interconnects a first turn section 621" with a second turn section 625", but the intermediate section 623" includes cross-overs and a booster 624' that provides a non-boosted trackway. Sections 621", 623", and 625" also include stylistic differences from corresponding track sections of track 620 and/or 620'.

Figure 63:
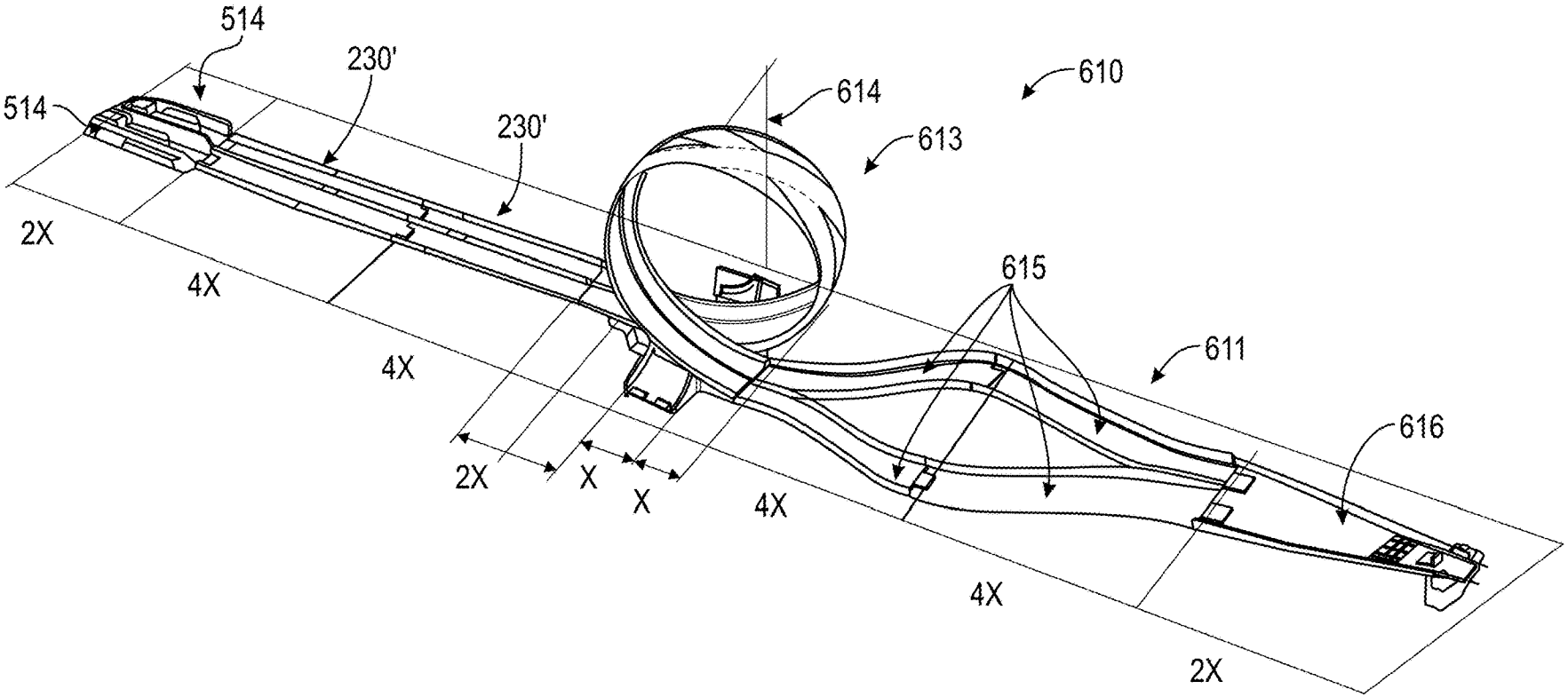

In FIG. 63, track configuration 610 is a one-way, two-lane racing configuration 610. Again, the track pieces used to form track configuration 610 interconnect along a grid 611; however, now each lane of the two-lane track configuration 610 interacts separately with grid 611. More specifically, track configuration 610 starts with two pull-back launchers 514 (see FIG. 47) that separately connect to two-lane straight track pieces 230' (which may be elongated versions of track piece 230 of FIGS. 26A-E), but with all connections of both lanes still aligning with grid 611. Track pieces 230' then separately interconnect with loop 613, again with both connections formed along grid 611. Then, finally, loop 613 connects to two different chicane track pieces 615, which connect to additional chicane track pieces 615, eventually terminating at finishing track piece 616. Each of these connections are also formed on grid 611.

Grid 611 is similar to grid 627 in that it is a two-dimensional grid that is agnostic to height. Thus, even though loop 613 has a height 614, the position of the connectors included on loop 613 are determinative of how the loop 613 fits into the grid 611. Overall, utilizing a two dimensional grid may reduce the number of variables that track designers need to consider when designing track pieces to conform with a grid system. This may also simplify track building for the end user. For example, with a two-dimensional grid, an end user may understand that the track system will conform with the grid system if connections for a particular track system are formed along the support surface on which the track system is being built. Then, the user will know that they are free to modify the track system, incorporate different accessories, etc. without preventing a closed loop or end-to-end track system from being formed.

However, to be clear, not all connections need to be formed along the support surface and/or in accordance with the grid to comply with the grid system as contemplated by the present application. Instead, in some instances, sectional grid compliance may be sufficient to allow an overall track configuration to comply with a grid system. For example, if turn section 621 of FIGS. 61A-and 61B has an entrance and exit that comply with grid system 627, internal connections of section 621 may be non-compliant with grid system 627. This may allow large and/or irregular features to be used together with the track pieces of the present application.

Figure 64:
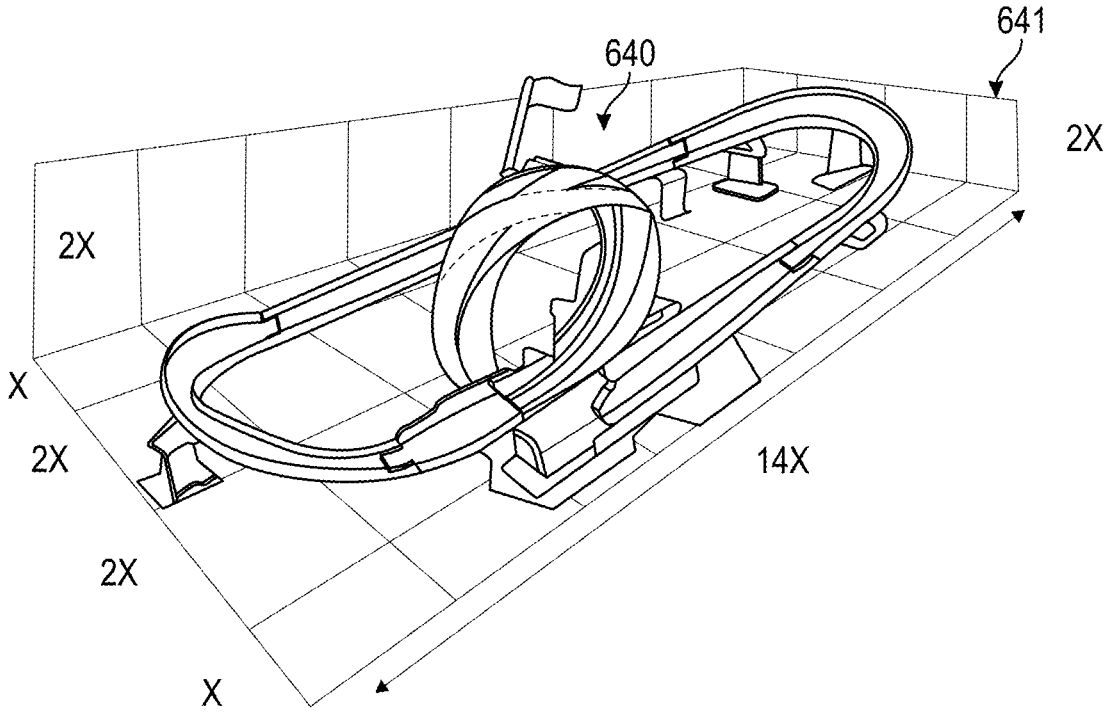
Figure 65:
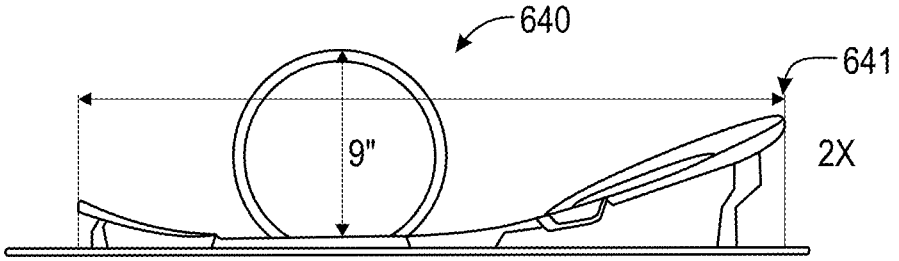
Figure 66:
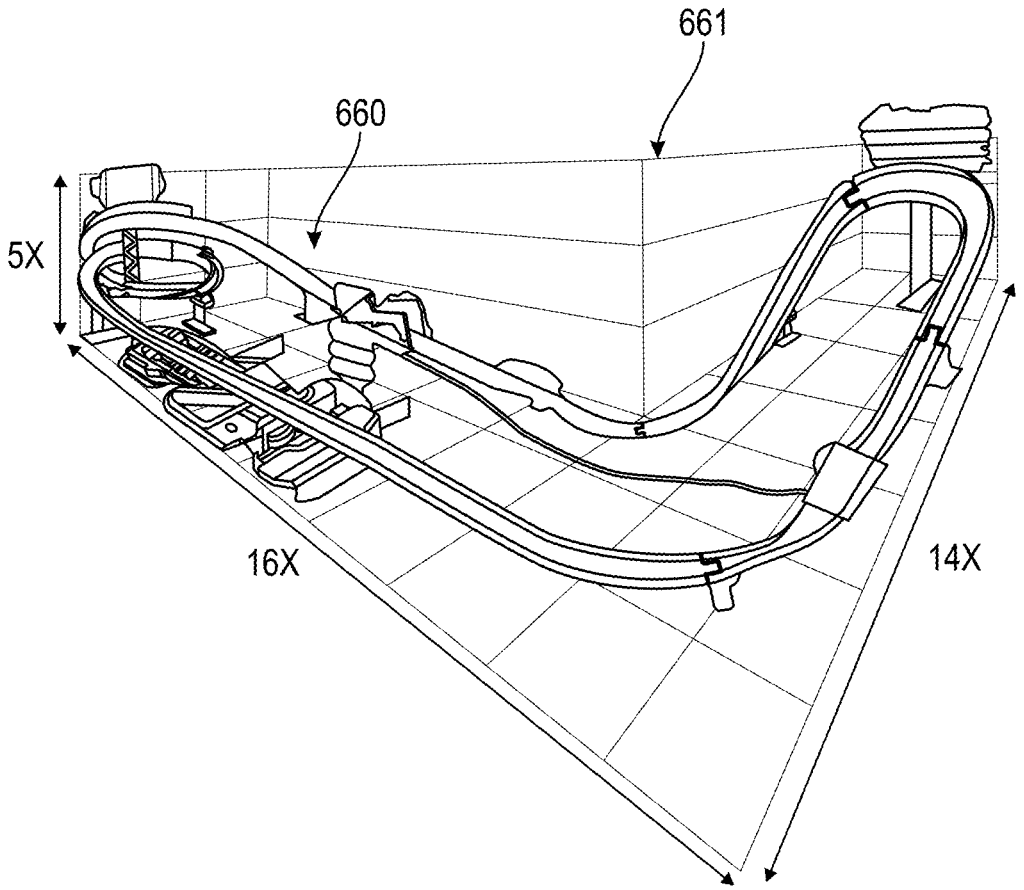
Figure 67:
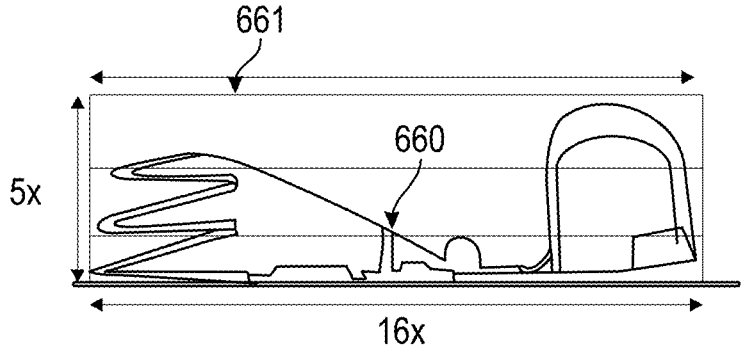
Figure 68A:
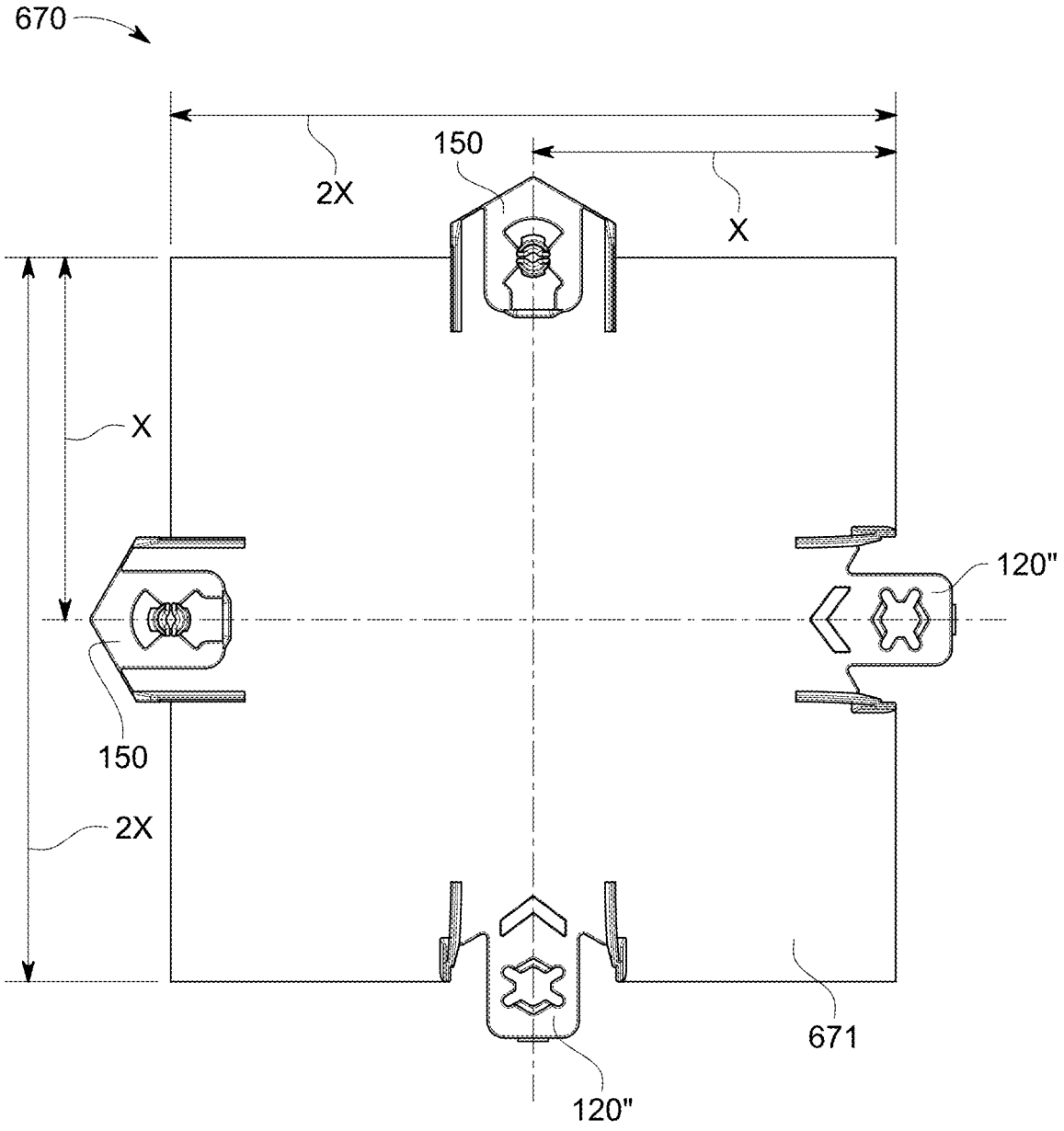
Figure 68B:
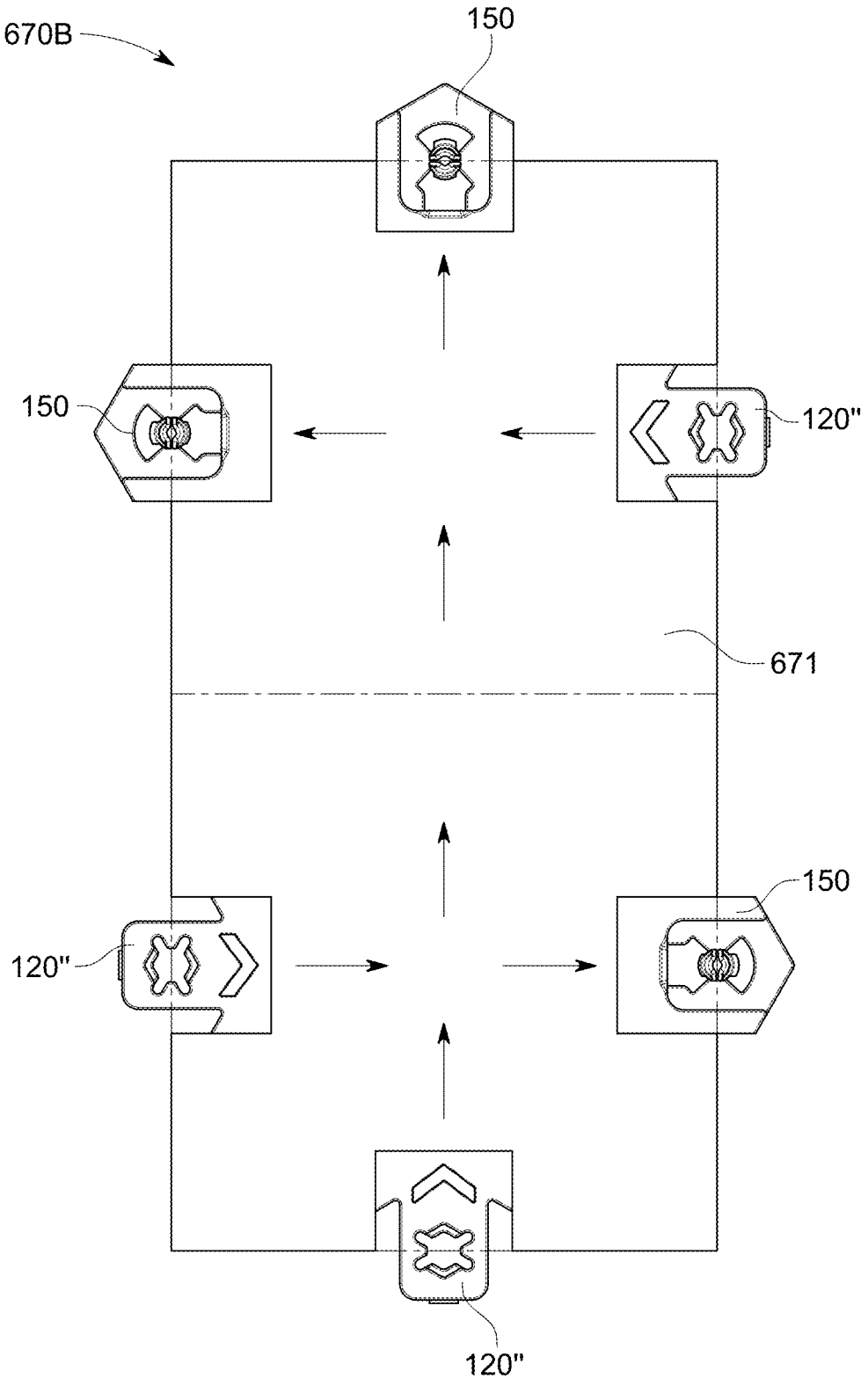
Figure 68C:
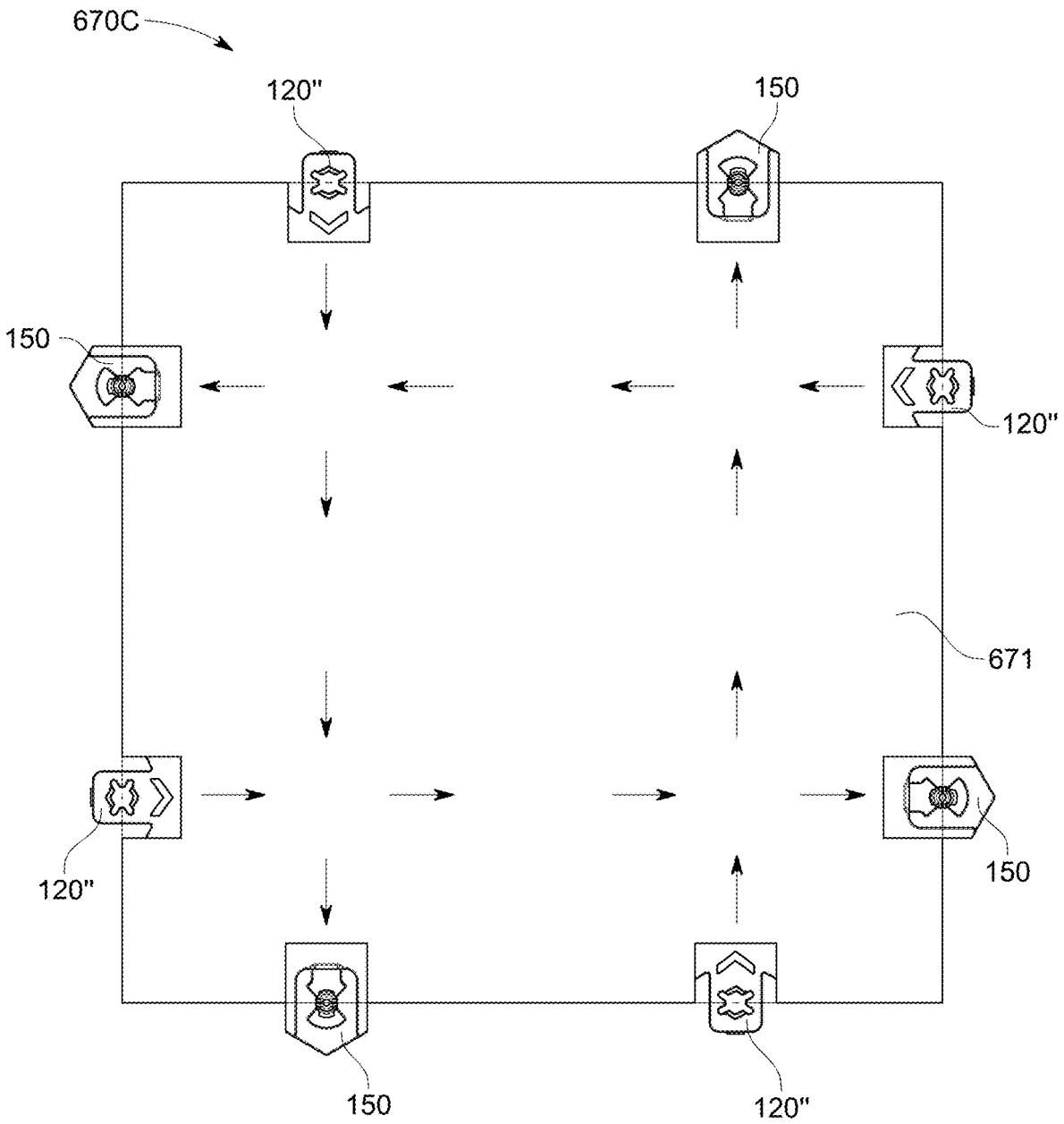
Figure 68D:
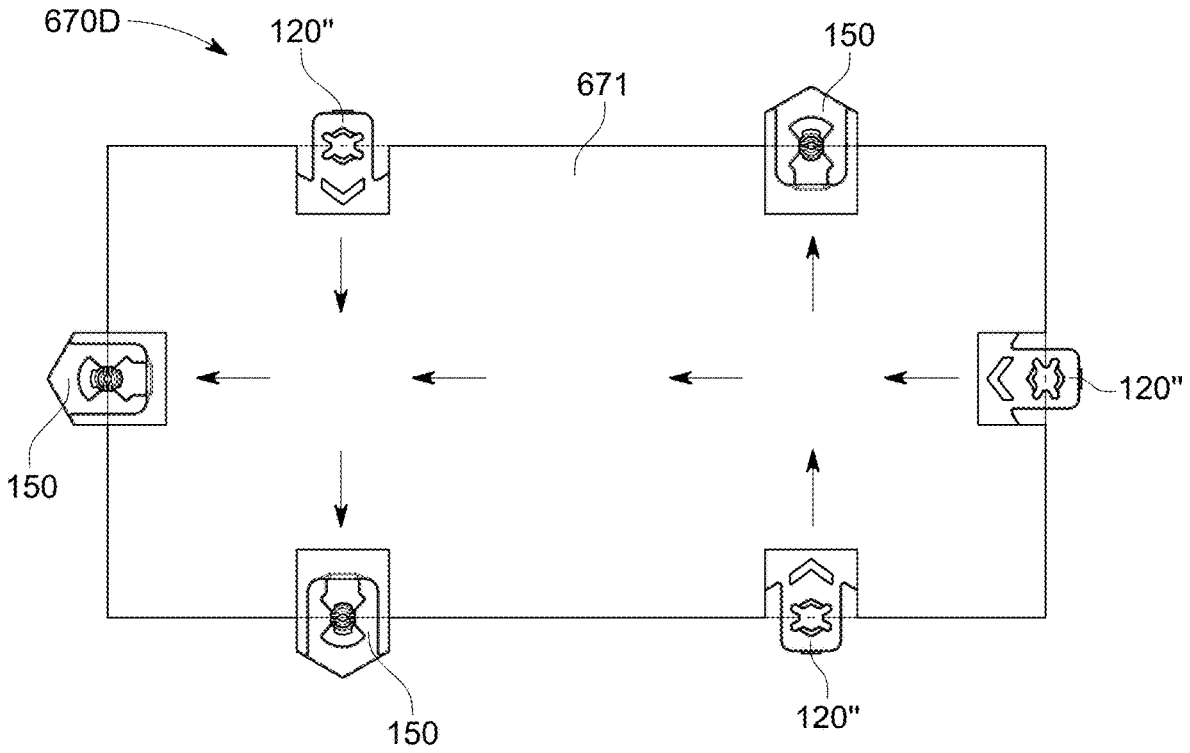

That all said, it is also possible for the track pieces of the present application to comply with a three dimensional grid. FIGS. 64-67 provide examples of such embodiments. FIGS. 64 and 66 depict closed loop track configurations 640 and 660 superimposed onto grid systems 641 and 661, respectively, from top perspective views. FIGS. 65 and 67 depict side views of track configurations 640 and 660 illustrating the height dimensions of grids 641 and 661, respectively.

With a three dimensional grid, the track pieces presented herein are designed so that each piece has a coupler span length configured to span one or more axes of the grid. For example, some toy vehicle pieces may have coupler span lengths that span x-y grid portions while other toy vehicle track pieces are designed to span x-y grid portions while also traversing a z-dimension of the grid system. For example, in FIG. 65, a portion of track configuration 640 rises to a height of 2X while also traversing a 2X by 2X x-y grid dimension. Similarly, in track configuration 660, two different portions of the track span a 5X z-dimension while also traversing x-y dimensions. In some instances, specific curves, specific risers and other such pieces may be intended to create height rises while retaining grid conformity. Then, other pieces can be used between changes in the z-dimension.

Still further, and now referring to FIGS. 68A-68D, 69A, 69B, 70A, and 70B, while the grid system presented herein is mostly discussed in connection with the racing or stunt style track configurations, the grid system may also be applied to "city" style "tiles" or other such track pieces that are typically used more for imaginative play. Then, the tile/city-style pieces can be interconnected with racing/stunt-style pieces as desired. FIGS. 68A-D depict example layouts of grids 670-670D, respectively that may be applied to city style pieces.

Generally, the grids 670-670D tend to follow the path of intersection and/or straight track pieces. However, with a city-style piece, connectors 120, 150 mark the bounds of a piece and the interior space 671 between connectors can include any desirable features or styling. The bounds can have various dimensions and, as examples, FIGS. 68A-68D depict grids that are 2X by 2X, 4X by 2X, 4X by 4X, and 2X by 4X, respectively. These grid sizes, however, are merely examples and other grid layouts generated generally based on these templates can be any shape or size (and need not be square or rectangular). Also, a tile-style piece formed based off a grid need not include connectors 120, 150 in all potential grid locations and can include connectors 120, 150 in a subset of locations. However, generally, connectors on one side of a tile may alternate male-female and connectors on opposite ends of a path across a tile may be male and female connectors (if both ends have connectors).

Figure 69A:
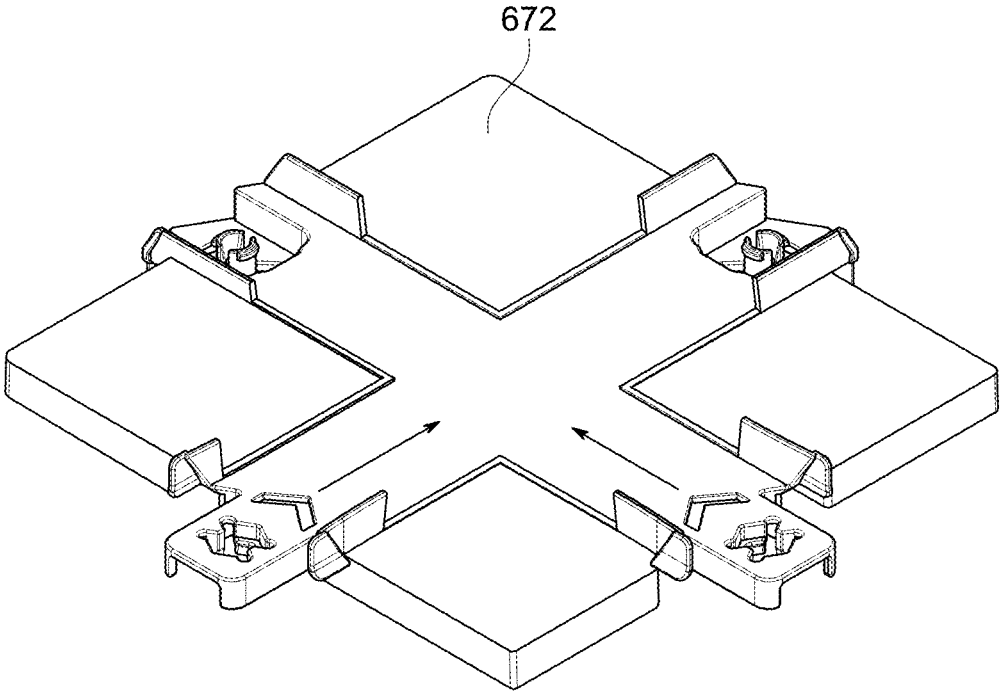
Figure 69B:
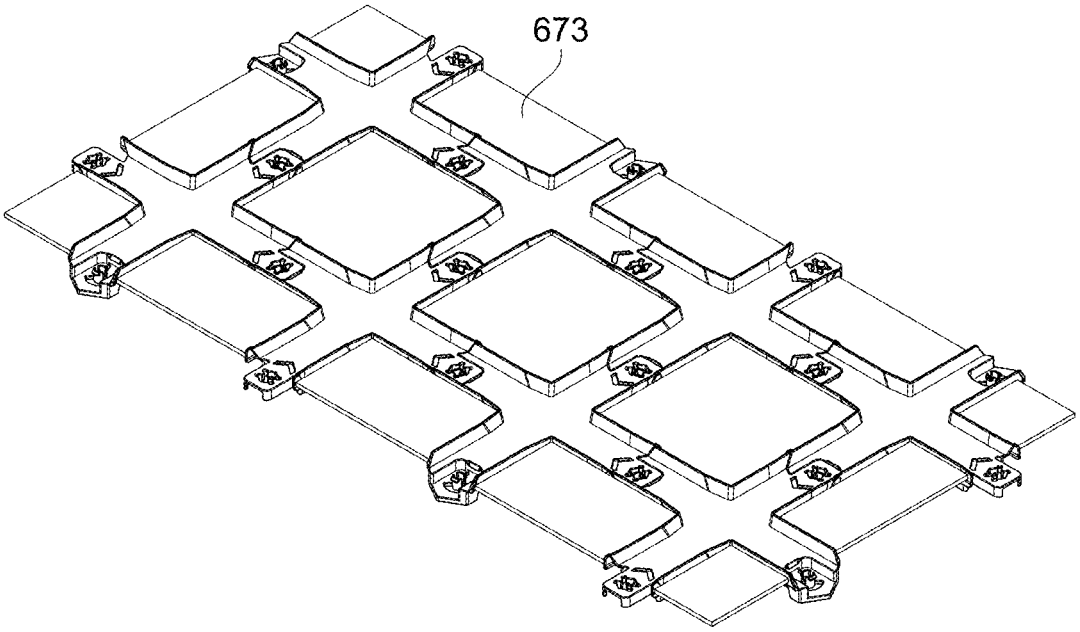
Figure 70A:
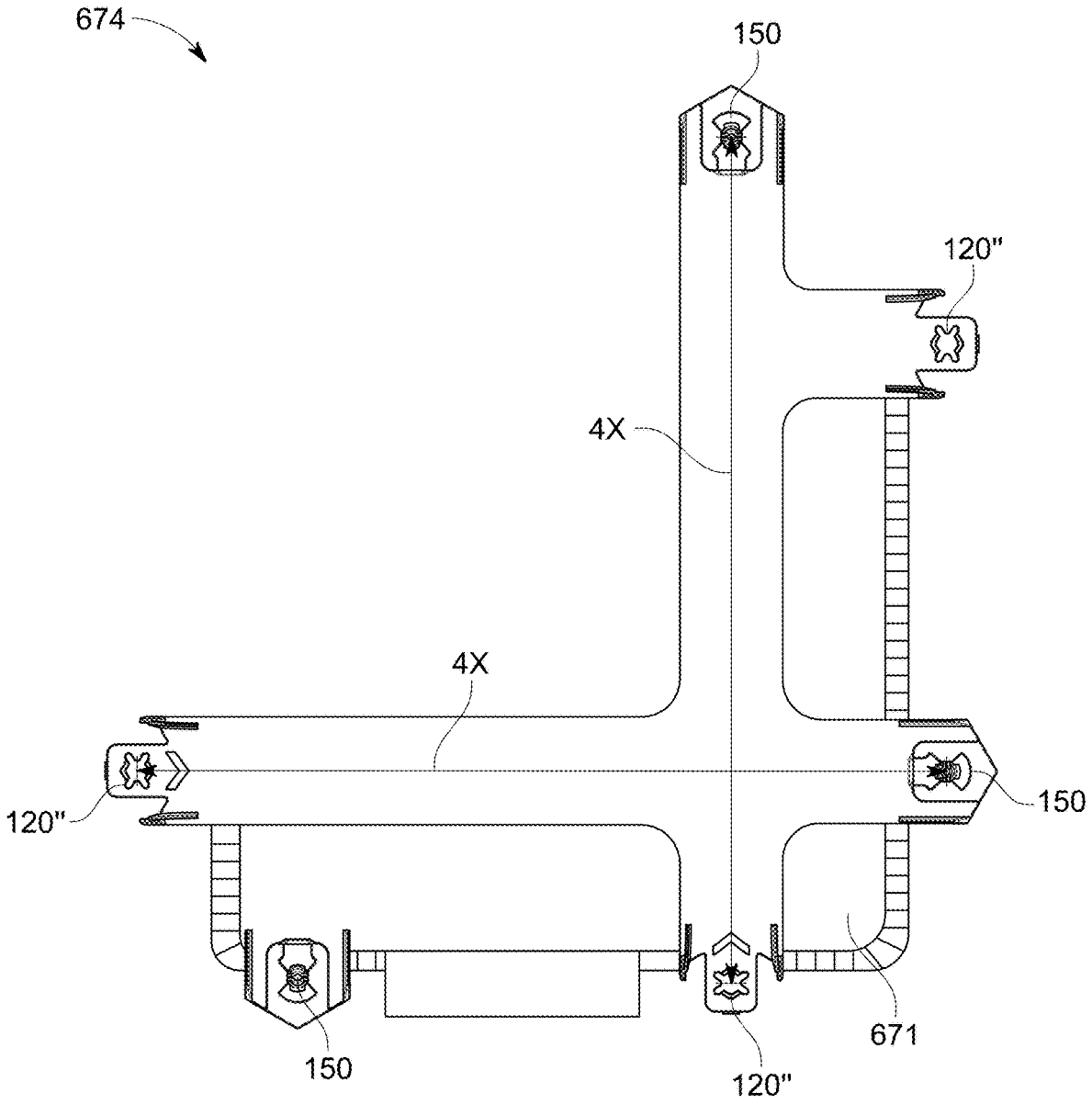
Figure 70B:
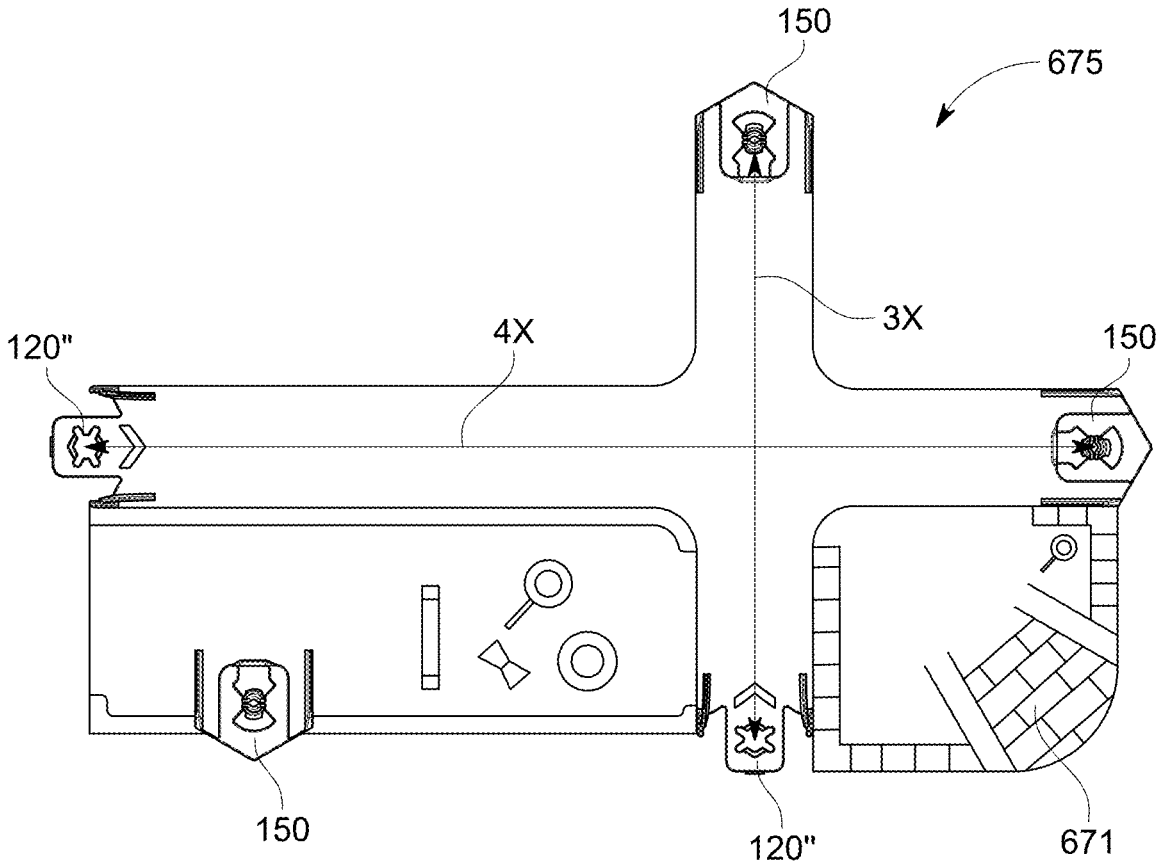

FIGS. 69A, 69B, 70A, and 70B depict example tile-style pieces formed based on a tile grid layout. First, FIG. 69A includes a first example tile-style piece 672 that is a "base tile" and FIG. 69B depicts an example of a tile-style piece 673 that provides a grid of intersecting roads with open spaces defined therebetween. Each is formed in accordance with grids 670-670D. Meanwhile, FIG. 70A includes a third example tile-style piece 674 and FIG. 70B depicts a fourth example tile-style piece 674 that are formed in accordance with grids 670-670D. Pieces 674 and 675 each include example styling in open space 671 defined between connectors 120" and 150. However, to be clear, tile-style pieces can also be formed in other shapes and configurations.

Figure 71:
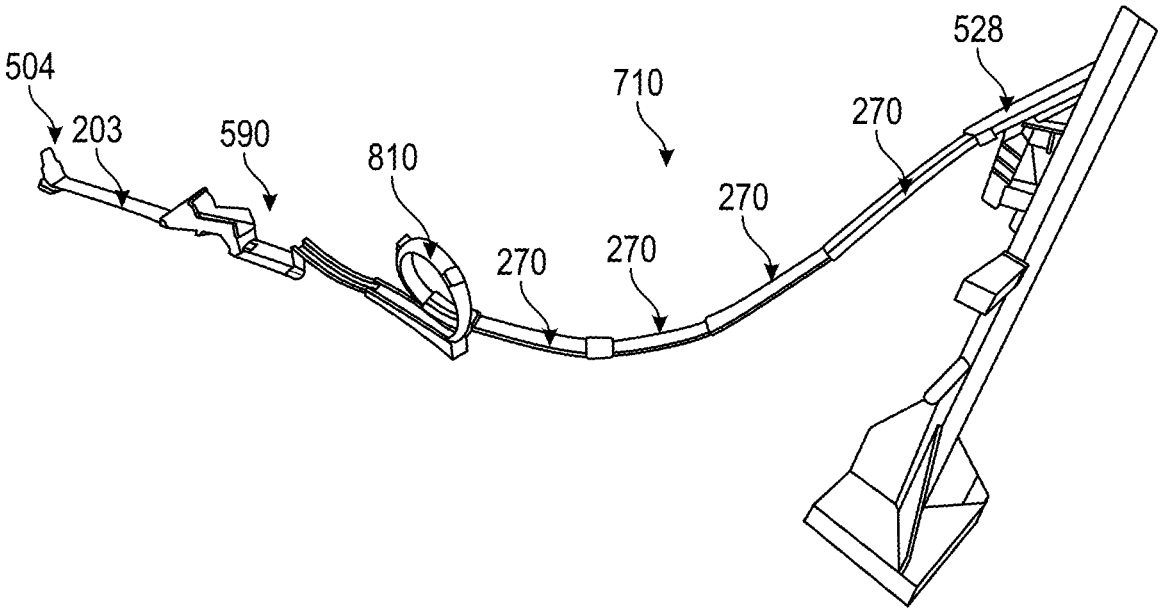
FIGS. 71-76 illustrate three examples of track configurations that can be created with toy vehicle track pieces of the present application.
Figure 72:
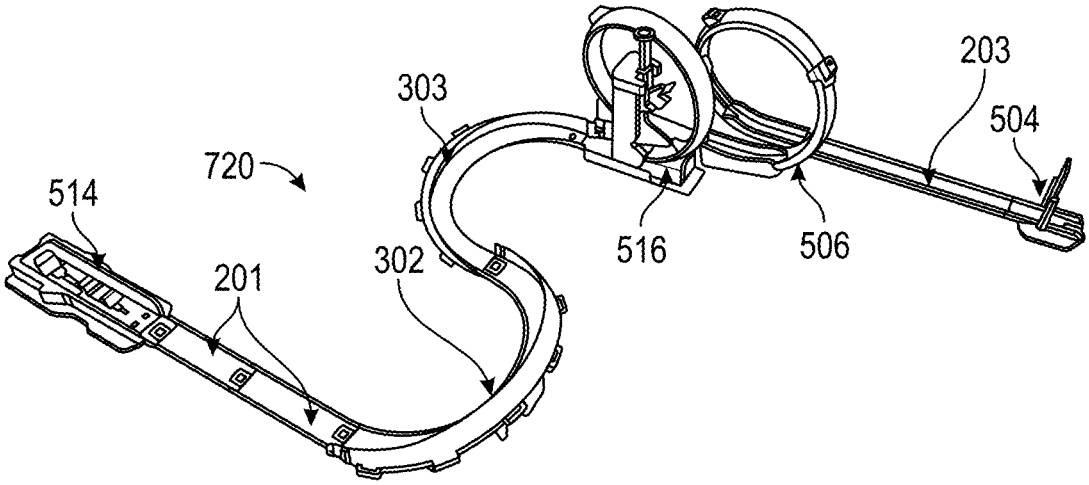
Figure 73:
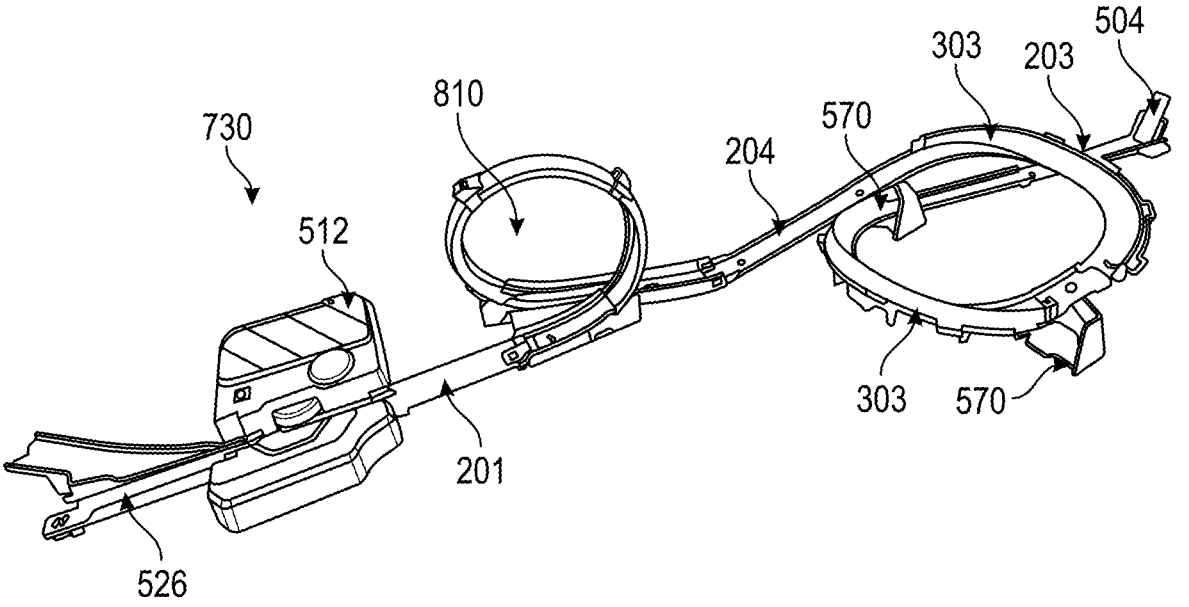
Figure 74:
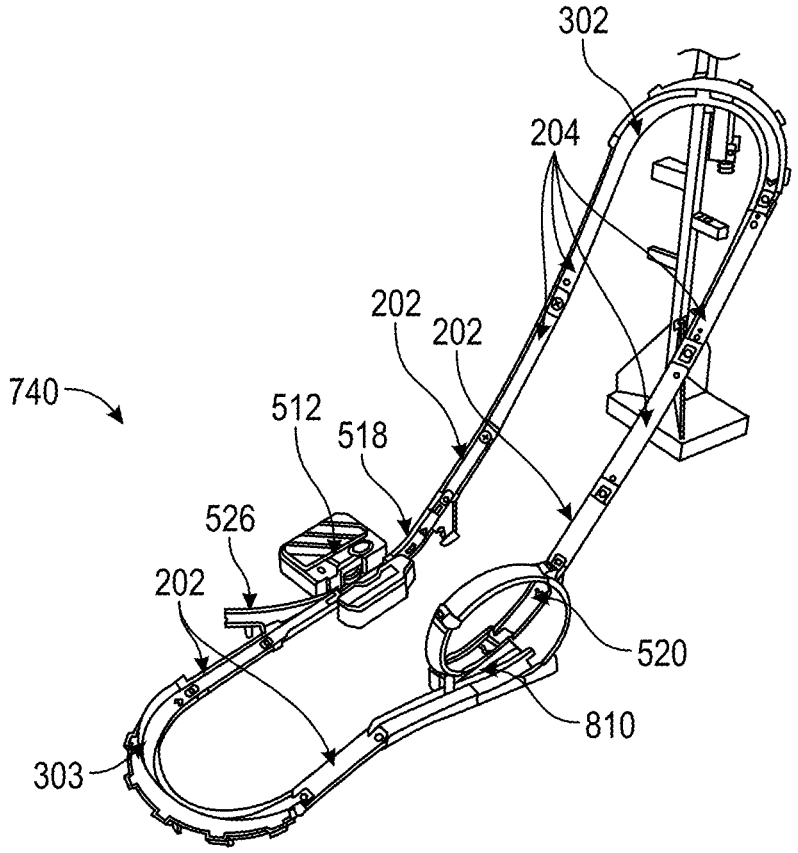

FIGS. 71-74 depict additional track configurations that may be easily constructed, deconstructed, reconfigured, etc. with the track pieces presented herein. FIG. 71 shows a gravity-driven stunt configuration 710 where a toy vehicle attempts to traverse a loop and a jump. FIG. 72 illustrates a gravity-driven stunt configuration 710 where a toy vehicle attempts to traverse a loop and a jump (e.g., the jump shown in FIG. 59A). FIG. 73 shows a boosted stunt configuration 730 where a toy vehicle attempts to traverse a loop and a helical turn. FIG. 73 depicts a boosted stunt configuration 740 where a toy vehicle attempts to climb a steep incline, turn, and traverse a loop. Overall, configurations 710, 720, 730, and 740 are each built from track pieces and accessories described herein. Most of the track pieces included in these configurations are described above, but configurations 710, 730, and 740 also include an in-line loop 810 that is described in further detail below.

Figure 75:
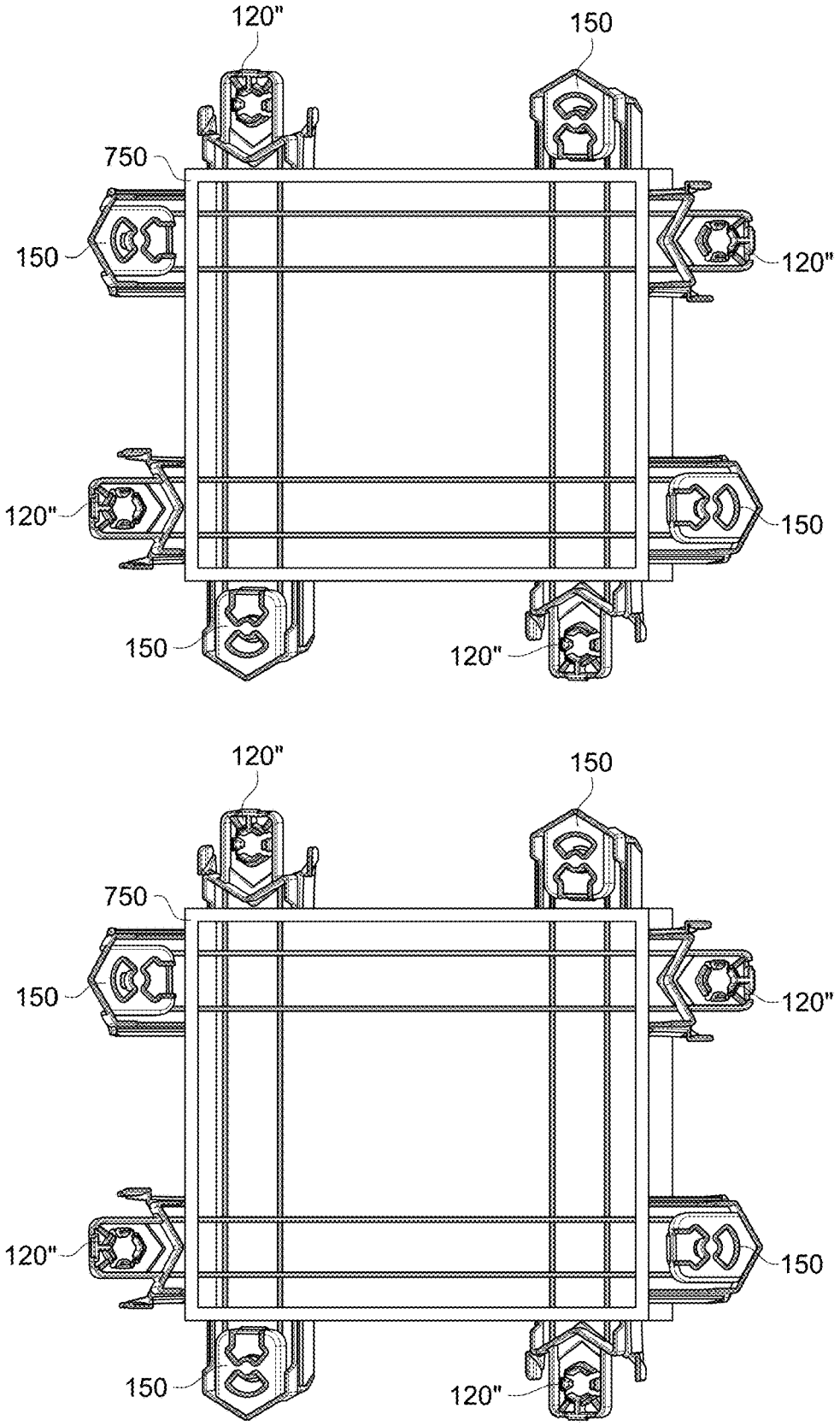
Figure 76:
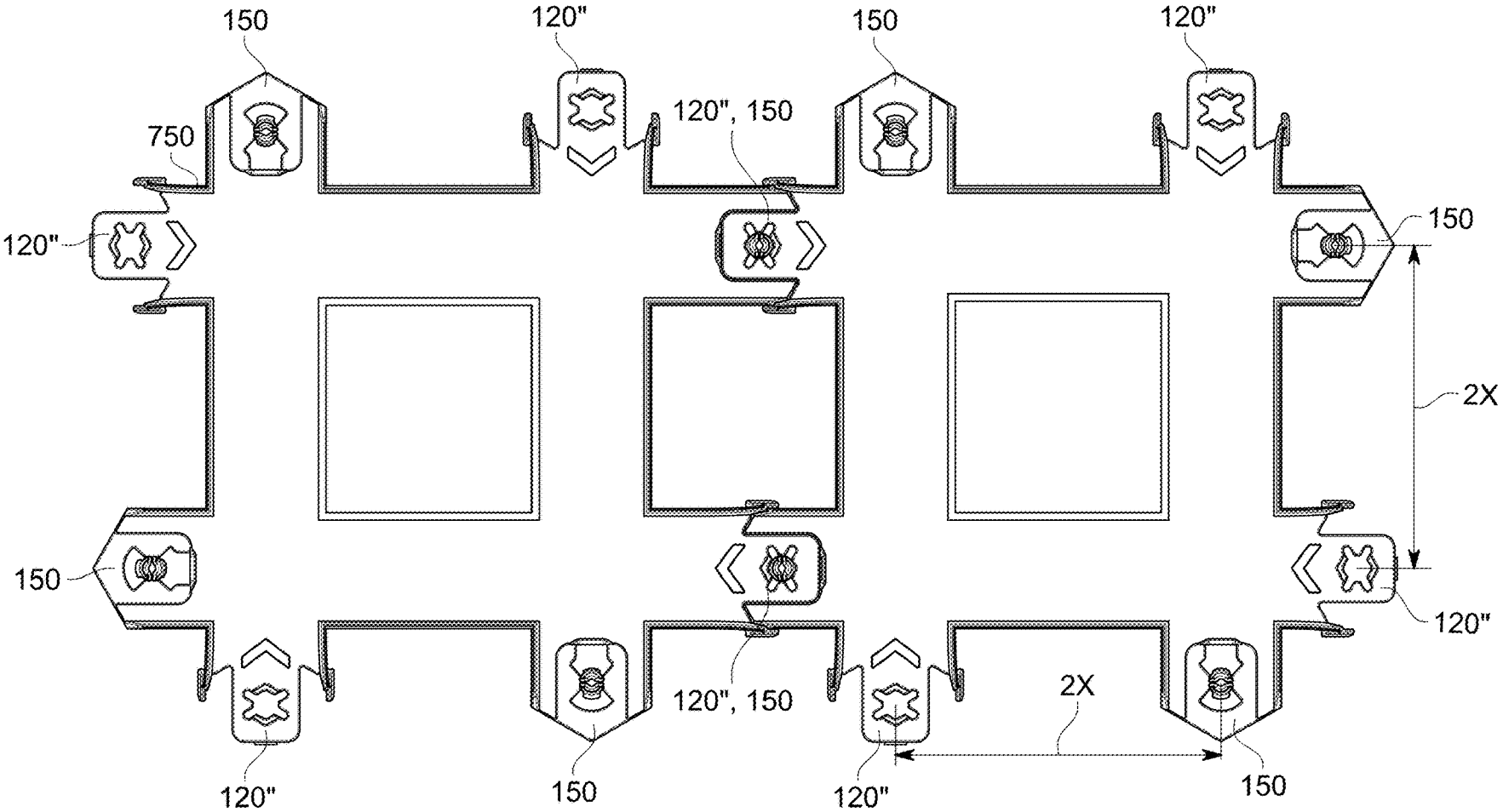

FIGS. 75 and 76 depict how the techniques presented herein may be incorporated into "city" style "tiles" or other such track pieces that are typically used more for imaginative play, as mentioned above. FIG. 75 depicts a bottom view of two tiles 750 while disconnected. FIG. 76 depicts a top view of the two tiles 750 after the two tiles are joined via two sets of connectors 120", 150 disposed on sides of tiles 750. Notably, these tiles 750 include female connector 120" which allows the tiles 750 to be connected in a top-down or a slide-in manner, as is detailed above in connection with FIGS. 19A-19C.

As can be seen, joining the tiles 750 via connectors 120", 150 starts to build a grid of track pathways along which a user can "drive" a toy vehicle. Further tiles, tracks, accessories, etc. can also be coupled to a tile 750 (in addition to or instead of the coupling between tiles 750) to build out a city, track configuration, etc. Importantly, since tiles 750 include female connector 120", these tiles 750 may be connected via sliding, which allows a user (e.g., a young child) to easily connect the tiles 750. A sliding connection avoids any tilting or bending the tiles 750 that would be required to create two different top-down arrangements for the different couplers 120", 150 included on a single side of each tile 750 (and the two different arrangements would be opposite each other, since top-down couplings require a female connector 120, 120', 120" to be disposed above the male connector 150). Also, as mentioned, the weight of tiles 750 may facilitate secure connection during these top-down or slide-in connections, allowing female connectors with less support (e.g., female connector 120") to be used with tiles 750.

Specialty Loops

FIGS. 77-82 depict additional accessory track pieces that may be formed in accordance with the techniques presented herein. That is, FIGS. 77-82 depict additional track pieces that can include or incorporate female connector 120 and/or male connector 150.

Figure 77:
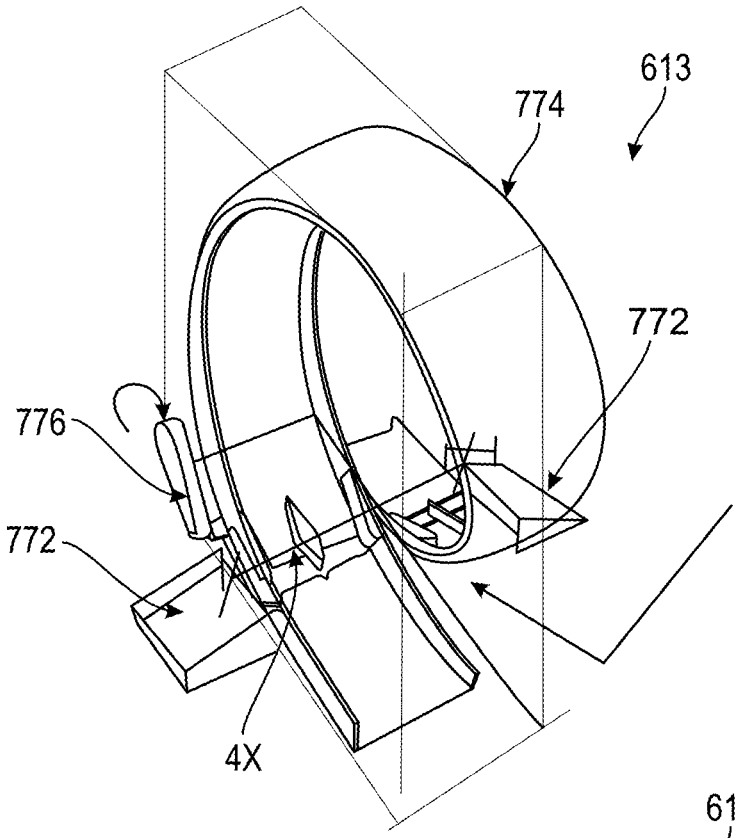
FIGS. 77-82 illustrate specialty loop track pieces formed in accordance with example embodiments of the present application.
Figure 78:
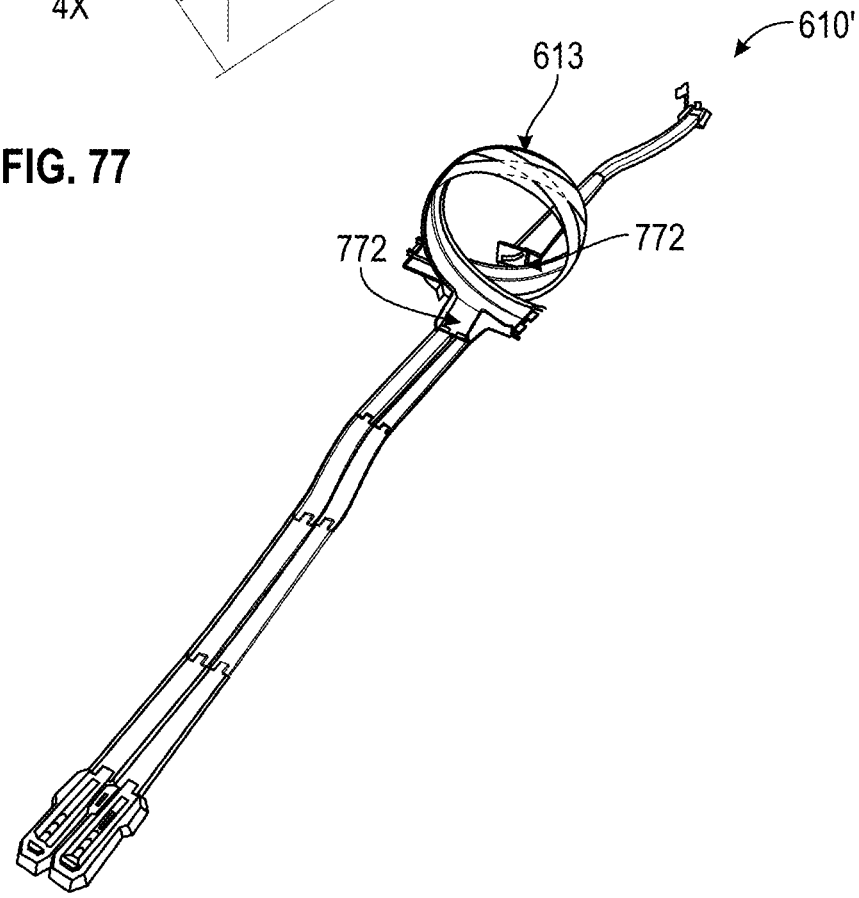
Figure 79:
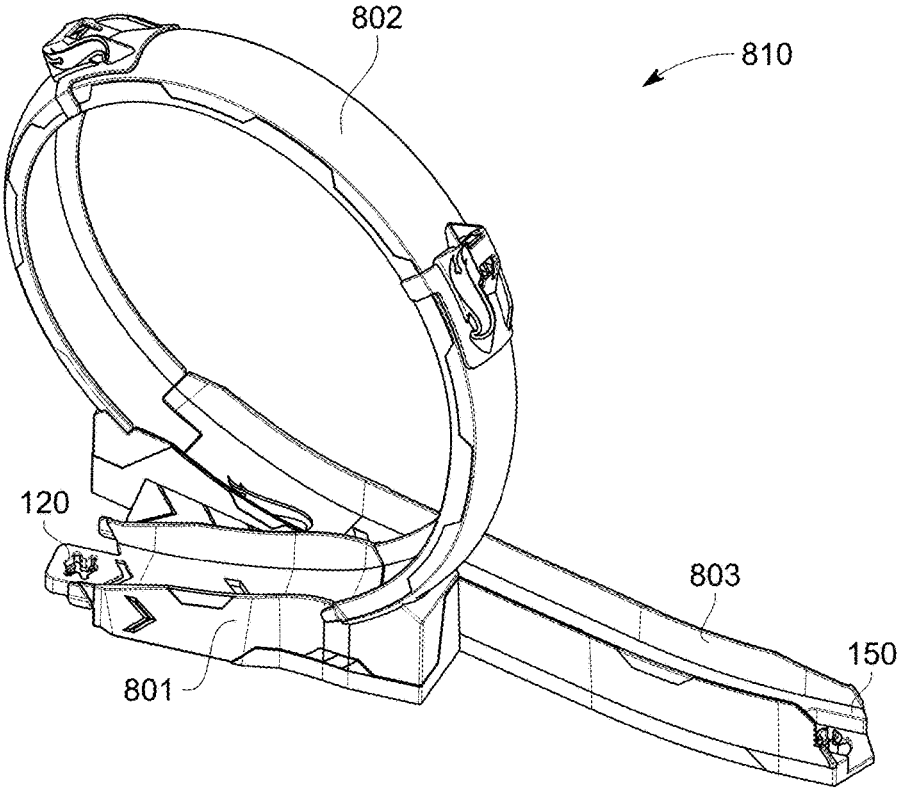
Figure 80:
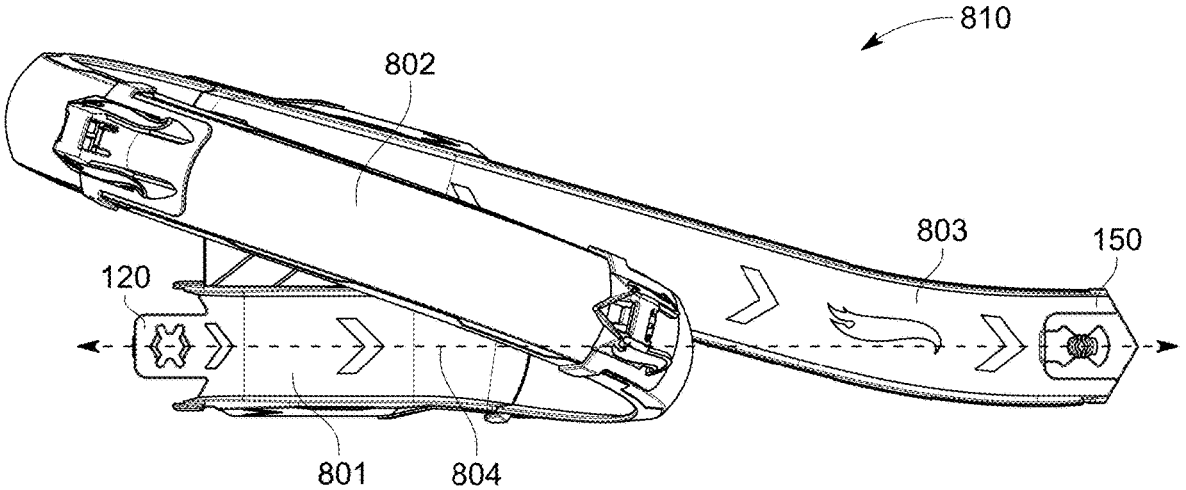
Figure 81:
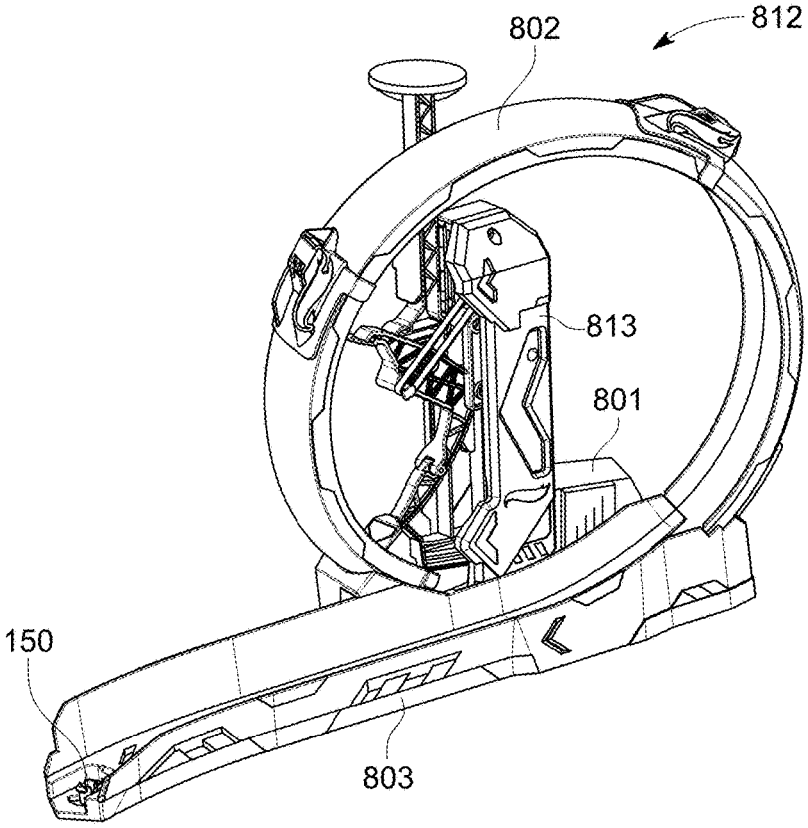
Figure 82:
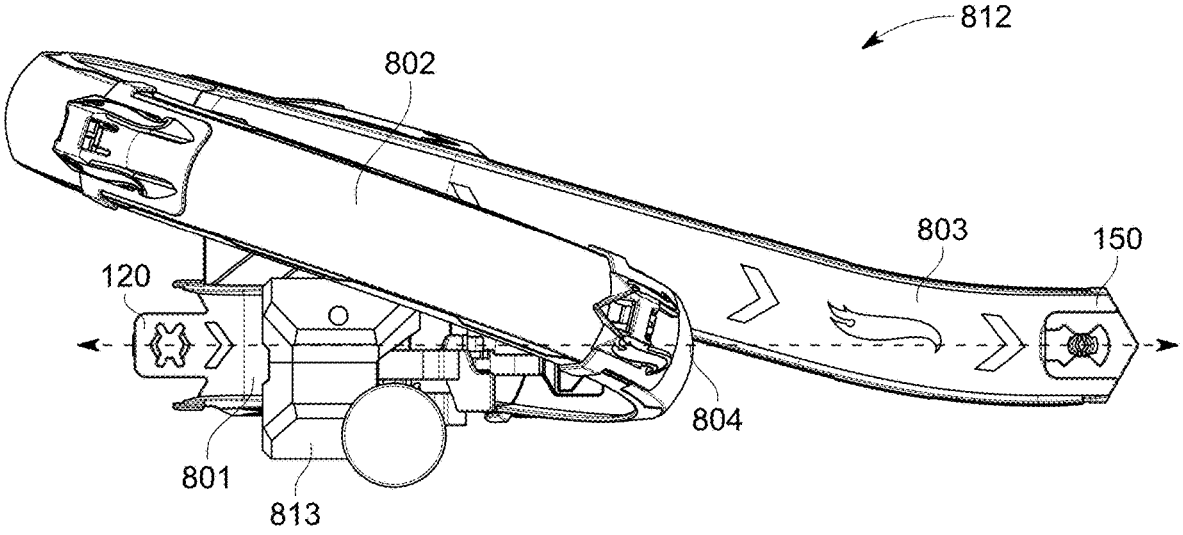

First. FIG. 77 depicts a detailed view of loop 613 from FIG. 63. This loop was not discussed in detail above but includes features that allow the loop to create grid-style track building in two directions. First, the loop 613 can be used to cause vehicles to traverse a vertical loop through loop portion 774, as shown in configuration 610 of FIG. 63. Then, however, loop 613 also includes ramps 772 spaced by a coupler span length that is an increment of the base unit X so that toy vehicles can jump through the loop portion 774 from one ramp 772 to the other ramp 772. Such a configuration 610' is depicted in FIG. 78 with many of the same track pieces as are used in configuration 610.

Moreover, regardless of the grid system, in some instances the loop portion 774 may include a diverter 776 that can cause toy vehicles to veer to a specific portion of loop portion 774 while traversing loop portion 774. For example, a forward (e.g., clockwise) actuation of diverter 776 may direct toy vehicles toward an inner portion of loop portion 774 while a rearward (e.g., counter-clockwise) actuation of diverter 776 may direct toy vehicles toward an outer portion of loop portion 774.

Next, FIGS. 79-82 depict "in-line loops" 810 and 812 where a vertically-oriented loop structure 802 is positioned between a first end 801 and a second end 803 in a manner that causes a directional path of entry into the first end to align, in a straight line 804, with a directional path of exit out of the second end. Loops 810 and 812 are substantially similar, but loop 812 incorporates a kicker 813. Thus, loops 810 and 812 are labeled with like reference numbers.

Overall, loops 810 and 812 are similar, in at least some aspects, to the loop disclosed in U.S. Patent App. Pub No. 2020/0078697, which is entitled "Toy Vehicle Loop," and which was filed by Mattel, Inc. on Sep. 7, 2018 ("the '697 Publication"). Thus, the '697 Publication is hereby incorporated by reference in its entirety. However, by comparison with the '697 Publication, the first ends 801 of loops 810 and 812 are relatively straight and a majority of the curvature that aligns the first end 801 with the second end 803 along line 804 is included after a vertex of the vertically-oriented loop structure 802. This is because curvature may tend to contact and slow a toy vehicle, so including such curvature at the entry/first end 801 and/or the upward portion of loop structure 802 lessens the chance that the toy vehicle can complete the stunt. As has been mentioned repeatedly herein, the toy vehicle track system presented herein is intended to make the track easy to use. This loop structure is yet another feature that eases use and allows a wide variety of toy vehicles to be used with the track system.

Packaging

Figure 83:
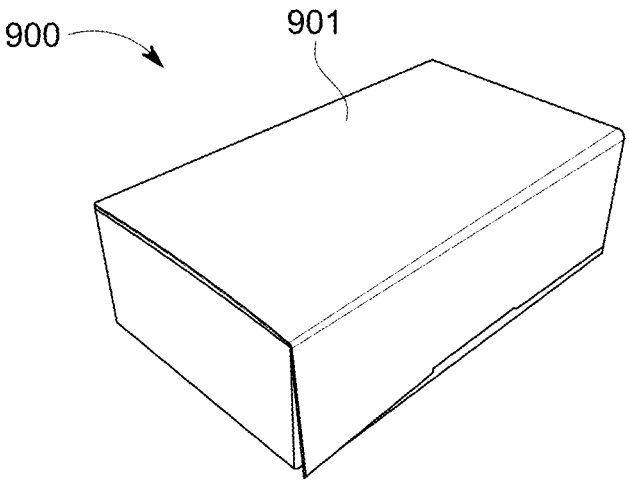
FIGS. 83-85 illustrate packaging that may be used with example embodiments of the track pieces of the present application, according to an example embodiment.
Figure 84:
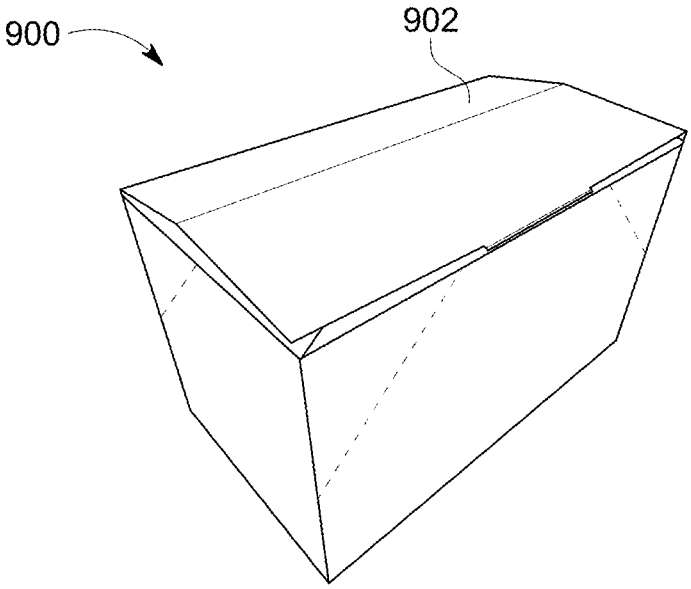
Figure 85:
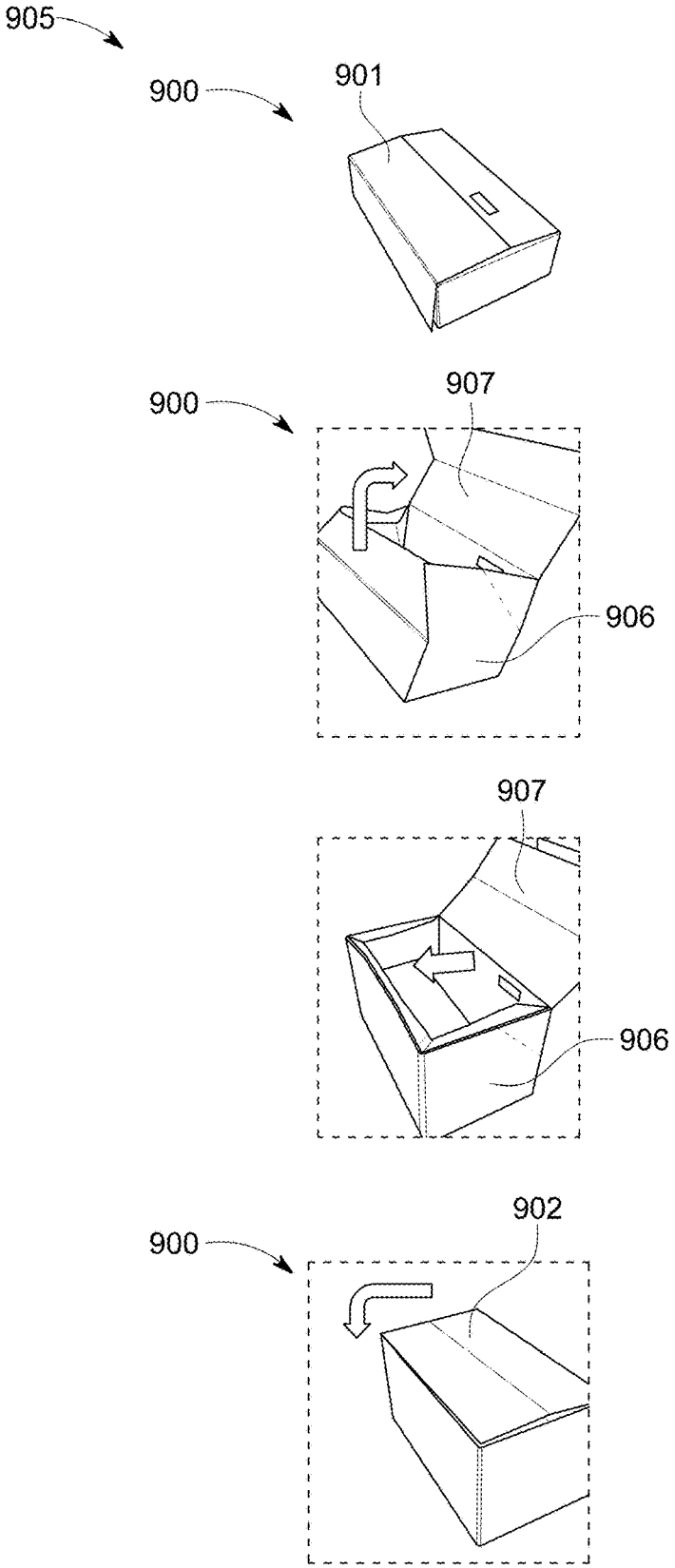

FIGS. 83-85 depict example embodiments of packaging that may be used with track pieces of the present application. Often, packaging holds toy vehicle track pieces at a point-of-sale and/or during shipping. Then, the packaging is often disposed after a child opens the packaging and removes the toy vehicle track pieces included therein. This requires the user (or a parent) to find a separate storage solution, which can be difficult as a toy vehicle track system expands to include additional pieces for larger track configurations and/or as larger track pieces (e.g., curves) are assembled into their usable form. To combat these issues, the toy vehicle track system presented herein may be packaged in expandable packaging 900.

FIG. 83 depicts the expandable packaging 900 in a first state 901, which is a state prior to expansion (i.e., a narrow state) that may be used for shipping, point-of-sale, and/or other space restricted uses. FIG. 84 depicts the expandable packaging 900 in a second state 902, after expansion (i.e., an expanded state), which may be used for consumer/end user storage. FIG. 85 depicts a method 905 of converting the expandable packaging 900 from the first state 901 to the second state 902.

As can be seen in method 905, when the expandable packaging 900 is initially opened, a top 907 of the expandable packaging 900 is removed from the remainder of the box while remaining intact. This is done by removing flaps from a front and sides of the box interior and pivoting the top 907 about its back edge, which is pivotally connected to the remainder of the expandable packaging 900. Then foldable flaps 906 stored under the top 907 can be unfolded to raise the overall height of the box at the front and at its sides. Finally, the top 907 can releasably close a top opening of the foldable flaps 906 to store track pieces in a closed container. This process expands the overall volume of the box but still retains a closable lid. Thus, the expandable box may be suitable for product storage.

Conclusion

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy vehicle kit comprising:

a first track piece including: a first pathway bounded by first opposing sidewalls and extending from a first end to a second end; a first male connector disposed at the first end of the first pathway, the first male connector including a first male main body with a recess formed therein to provide a first inset laterally bounded by surfaces that are elevationally aligned with the first pathway, such that the first inset and the surfaces laterally span a width between the first opposing sidewalls, and the first male connector also including a first protrusion extending elevationally away from the first inset towards, but not above, the first pathway; and a first female connector disposed at the second end of the first pathway, wherein the first male connector is separated from the first female connector by a first coupler span length that is a first increment of a base unit; and a second track piece including: a second pathway bounded by second opposing sidewalls and extending from a third end to a fourth end; a second male connector disposed at the third end of the second pathway, the second male connector including a second male main body with a second inset and a second protrusion extending elevationally away from the second inset towards, but not above, the second pathway; and a second female connector disposed at the fourth end of the second pathway, wherein the first male connector and the second male connector have matching configurations, the first female connector and the second female connector have matching configurations, and the second male connector is separated from the second female connector by a second coupler span length that is a second increment of the base unit, such that connecting the first track piece to the second track piece via a male-female coupling places uncoupled connectors along an x-y grid with grid increments of the base unit.

2. The toy vehicle kit of claim 1, wherein the first male connector is coupleable directly to the second female connector without any additional pieces that are not part of the first track piece and the second track piece, and the first female connector is coupleable directly to the second male connector without any additional pieces that are not part of the first track piece and the second track piece.

3. The toy vehicle kit of claim 1, wherein the first track piece and the second track piece are both straight track pieces with equal widths, equal heights, and equal trackway heights, but the second increment of the base unit is different than the first increment of the base unit.

4. The toy vehicle kit of claim 1, wherein the first opposing sidewalls and the second opposing sidewalls have equally sized heights so that coupling the first track piece to the second track piece provides a continuous track pathway bounded by continuous walls of equal height.

5. The toy vehicle kit of claim 1, wherein the first coupler span length is a first length vector extending along one direction of the x-y grid and the first male connector is also separated from the first female connector by a third coupler span length-that is a second length vector extending a third increment of the base unit along another direction of the x-y grid, such that the first male connector is separated from the first female connector by increments of the base unit along both axes of the x-y grid.

6. The toy vehicle kit of claim 5, wherein the first track piece is a curved track piece or an accessory track piece.

7. The toy vehicle kit of claim 5, wherein the x-y grid further extends in a z-dimension to provide a three-dimensional x-y-z grid and the first male connector is also separated from the first female connector by a fourth coupler span length that is a third length vector extending a fourth increment of the base unit along the z-dimension of the x-y-z grid, such that the first male connector is separated from the first female connector by increments of the base unit along all three axes of the x-y-z grid.

8. The toy vehicle kit of claim 1, wherein the first track piece includes one or more first indicia representative of the first increment of the base unit and the second track piece includes one or more second indicia representative of the second increment of the base unit.

9. The toy vehicle kit of claim 8, wherein the one or more first indicia are spaced along a length of the first pathway.

10. The toy vehicle kit of claim 8, wherein the one or more first indicia also act as directional indicia that indicate a direction of intended travel for a toy vehicle across the first track piece or the first track piece further comprises one or more third indicia that indicate the direction of intended travel for the toy vehicle across the first track piece.

11. The toy vehicle kit of claim 1, wherein the first track piece further comprises:

a third pathway bounded by third opposing sidewalls, with one sidewall of the third opposing sidewalls being connected to or part of the first opposing sidewalls, the third pathway extending from a fifth end aligned with the first end to a sixth end aligned with the second end;

a third male connector disposed at the fifth end of the third pathway; and a third female connector disposed at the sixth end of the third pathway, wherein the third male connector is separated from the third female connector by the first coupler span length that is the first increment of the base unit, and wherein the third male connector and the third female connector are each respectively separated from the first male connector and the first female connector by a lateral coupler span length sufficient to allow independent connections of additional track pieces to the first male connector, the first female connector, the third male connector, and the third female connector.

12. The toy vehicle kit of claim 1, wherein the first female connector is coupleable directly to the second male connector via a first lateral, slide-in coupling and via a first top-down coupling formed separately from the first lateral, slide-in coupling and the second female connector is coupleable directly to the first male connector via a second lateral, slide-in coupling and via a second top-down coupling formed separately from the second lateral, slide-in coupling.

13. The toy vehicle kit of claim 11, wherein the first male connector, the first female connector, and the first pathway are formed integrally, as a monolithic piece.

14. A curved track piece comprising:

a curved pathway bounded by opposing sidewalls and extending from a first end to a second end;

a male connector disposed at the first end of the curved pathway, the male connector including a first main body with an inset, a protrusion extending elevationally away from the inset towards, but not above, the curved pathway, the protrusion including a first extension and a second extension separated from one another via a gap, and openings formed through the inset around the first extension and the second extension to enable the first extension and the second extension to flex relative to one another; and a female connector disposed at the second end of the curved pathway, wherein the male connector is separated from the female connector by a first coupler span length that is a first length vector extending a first increment of a base unit along one direction of an x-y grid and the male connector is also separated from the female connector by a second coupler span length that is a second length vector extending a second increment of the base unit along an other direction of the x-y grid, such that the male connector is separated from the female connector by increments of the base unit along both axes of the x-y grid.

15. The curved track piece of claim 14, further comprising:

a riser mount disposed beneath the curved pathway; and a trackway indicator visible during usage of the curved track piece that shows a location of the riser mount.

16. The curved track piece of claim 14, wherein the curved pathway comprises:

a banked bottom;

an extended exterior sidewall assembly forming one of the opposing sidewalls; and an extended interior sidewall assembly forming an other of the opposing sidewalls, wherein the extended exterior sidewall assembly and the extended interior sidewall assembly bound the banked bottom and are configured to retain a toy vehicle on the curved track piece without preventing the toy vehicle from traversing the curved pathway.

* * * * *